US008507414B2

(12) United States Patent
Takahama et al.

(10) Patent No.: US 8,507,414 B2
(45) Date of Patent: Aug. 13, 2013

(54) OIL-IN-WATER EMULSION COMPOSITION

(75) Inventors: Shogo Takahama, Yokohama (JP); Shu-ichi Takeda, Hiratsuka (JP)

(73) Assignees: Applied Diamond Inc., Kanagawa (JP); Japan Lublight Ltd., Kanagawa (JP)

( * ) Notice: Subject to any disclaimer, the term of this patent is extended or adjusted under 35 U.S.C. 154(b) by 301 days.

(21) Appl. No.: 12/937,670

(22) PCT Filed: Apr. 14, 2009

(86) PCT No.: PCT/JP2009/001721

§ 371 (c)(1),
(2), (4) Date: Nov. 17, 2010

(87) PCT Pub. No.: WO2009/128258

PCT Pub. Date: Oct. 22, 2009

(65) Prior Publication Data

US 2011/0059876 A1 Mar. 10, 2011

(30) Foreign Application Priority Data

Apr. 14, 2008 (JP) ..... 2008-105196
Mar. 19, 2009 (JP) ..... 2009-069128

(51) Int. Cl.
*C10M 125/02* (2006.01)
*C10M 129/26* (2006.01)

(52) U.S. Cl.
USPC ..... 508/113; 508/517

(58) Field of Classification Search
USPC ..... 508/113, 517
See application file for complete search history.

(56) References Cited

U.S. PATENT DOCUMENTS

2005/0240051 A1 10/2005 Yasuda et al.
2008/0248979 A1* 10/2008 Nakagawa et al. ..... 508/128

FOREIGN PATENT DOCUMENTS

| | | | |
|---|---|---|---|
| CN | 1699157 | A * | 11/2005 |
| JP | 5-171169 | A | 7/1993 |
| JP | 2000-119674 | A | 4/2000 |
| JP | 2004-182879 | A | 7/2004 |
| JP | 2005-343778 | A | 12/2005 |
| JP | 2007-331990 | A | 12/2007 |
| WO | WO 2004/039483 | A1 | 5/2004 |
| WO | WO 2007/019125 | A1 | 2/2007 |

OTHER PUBLICATIONS

International Search Report, dated Aug. 18, 2009, issued in corresponding International Application PCT/JP2009/001721.
English translation of the International Preliminary Report on Patentability for International Application No. PCT/JP2009/001721 dated Dec. 9, 2010 (Forms PCT/IB/338; PCT/IB/373; and PCT/ISA/237).

* cited by examiner

*Primary Examiner* — Jim Goloboy
(74) *Attorney, Agent, or Firm* — Birch, Stewart, Kolasch & Birch, LLP

(57) ABSTRACT

An oil-in-water type (O/W) emulsion lubricant composition includes safe and renewable components that do not have environmental load, exhibits excellent lubrication properties, has excellent handling capability, is economical, and may be applied to tribological fields.
The lubricant composition includes water or oil dispersant-treated ultrafine diamond particles in the aqueous phase (W phase) and/or the oil phase (O phase) of an oil-in-water (O/W) emulsion, or includes at least one multiple emulsion state that includes an oiliness improver and/or a composite state that includes a solid lubricant other than the ultrafine diamond particles in the same configuration.

15 Claims, 12 Drawing Sheets

| Name | A, B, C | DW | A~DW | A~DO | A~DW~DO |
|---|---|---|---|---|---|
| Configuration | Base emulsion | ND, water dispersion | ND dispersion in water (W-phase) | ND dispersion in oil (O-phase) | ND dispersion in water (W-phase) and oil (O-phase) |
| | : Emulsion particle (Oil (O-phase)) | | : Emulsion particle containing ND in Oil (O-phase) | | : ND |

A : Emulsion type
B : Microemulsion type
C : Grease type

ND : Diamond-like ultrafine particles

| | Base emulsion | Dispersant treatment ND, water dispersion | O/(W+ND) emulsion | (O+ND)/ W emulsion | (O+ND)/(W+ND) emulsion |
|---|---|---|---|---|---|
| Name | A | DW | A~DW | A~DO | A~DW~DO |
| Friction surface | | | | | |
| Wear | 3.5mg | 8.9mg | 0.9mg | 0.5mg | 2.9mg |

ND : Diamond-like ultrafine particles

| Sample Name | BOM | MOS2 | MOSI | MOCL | NDMO-1 |
|---|---|---|---|---|---|
| Solid lubricant | — | MoS2 | SiO2 | CL-40 | ND |
| Friction surface |  |  |  |  |  |
| F. C. | 0.261 | 0.171 | 0.190 | 0.154 | 0.140 |

$MoS_2$ : molybdenum disulfide
$SiO_2$ : silica ultrafine particles (average particle size: 40 mm)
CL-40 : CL 40% chlorinated paraffin
ND : ND : Diamond-like ultrafine particles(average particle size: 40 mm)
F. C. : Friction coefficient

| Addition effects to base emulsion | | | |
|---|---|---|---|
| Sample name | A | A-TY1 | A-TZ2 |
| No addition of ND |  |  |   |
| Specific Wear | $56.12\times10^{-9}$ | $27.38\times10^{-9}$ | $9.36\times10^{-9}$ |

| Addition effects to (O + diamond-like ultrafine particle) / W-emulsion | | | |
|---|---|---|---|
| Sample name | A-DO | A-DO-TY2 | A-DO-TZ2 |
| Addition of ND |  |  |   |
| Specific Wear | $3.19\times10^{-9}$ | $1.48\times10^{-9}$ | $1.40\times10^{-9}$ |

| Sample name | A-DO-TY1-TZ2 |
|---|---|
| Wear scar |   |
| Specific Wear | $0.42\times10^{-9}$ |

| Sample name | [illegible] | [illegible] | [illegible] |
|---|---|---|---|
| Wear scar |  |  |  |
| Specific Wear | [illegible] | [illegible] | [illegible] |
| Sample name | [illegible] | [illegible] | [illegible] |
| Wear scar |  |  |  |
| Specific Wear | [illegible] | [illegible] | [illegible] |

OIL-IN-WATER EMULSION COMPOSITION

TECHNICAL FIELD

The present invention relates to an oil-in-water emulsion composition that includes ultrafine particles, a lubricant composition and a coating agent using the same, a method of producing an oil-in-water emulsion composition, and solid particles.

The oil-in-water emulsion composition is known as (1) a microemulsion-type (solubilisation) oil-in-water emulsion composition (transparent) having an oil particle size of 0.1 to 1 μm that contains a large amount of emulsifier added to stabilize the dispersion system, and undergoes self-emulsification without forcible stirring, or (2) an emulsion-type (milky-white) oil-in-water emulsion composition having an oil particle size of 1 to 10 μm that contains a small amount of emulsifier, and needs to be subjected to phase inversion emulsification. These oil-in-water emulsion compositions including all of these are collectively referred to herein as "oil-in-water emulsion composition (O/W emulsion composition)" unless otherwise indicated.

However, the oil-in-water emulsion composition is specifically referred to respectively as the microemulsion-type oil-in-water emulsion composition (1) or the emulsion-type oil-in-water emulsion composition (2), if it is necessary to specify in detail. Note that the emulsion-type oil-in-water emulsion composition (2) may also be referred to herein as "oil-in-water emulsion". The oil-in-water emulsion composition may be classified to liquid or paste based on the appearance in addition to the classification of the particle size.

The "O/W emulsion composition" includes an emulsion composition that includes at least one base oil forming an oil phase (O phase), at least one emulsifier, water, and the like. The O/W emulsion composition may also be referred to herein as "base emulsion (A)". The O/W emulsion composition may appropriately be added with various additives in addition to the constituent components.

BACKGROUND ART

A lubricant that includes an oil-in-water emulsion (O/W emulsion), in more detail a high-viscosity lubricant that includes a thickener that may stabilize an aqueous composition and an oil-in-water emulsion, and a method of producing the same have been known (see Patent Document 1, for example). Patent Document 1 discloses a lubricant that includes an oil-in-water emulsion having a certain viscosity measured using a Brookfield viscometer, wherein water as the main component includes a water-insoluble oil-soluble EP agent (extreme pressure agent), and a water-soluble liquid organic dispersant that dissolves the EP agent and stably disperses the EP agent in water, and the oil of which discontinuous dispersion phase is formed is a synthetic oil, and a method of producing the same. The main components of the patent, that is, sulfur, chloro-sulphur, chlorinated aliphatic hydrocarbon, and phosphorus EP agent produce corrosion products, such as sulfide, chloride, phosphide and the like on a sliding friction surface to form a solid lubricant layer on the surface, and thus have a function to improve the lubrication properties. Patent Document 1 discloses that the above configuration achieves excellent lubrication properties as compared with EP agent-containing mineral oil which is a component of the invention or an aqueous composition in which the EP agent is stably dispersed in the presence of a grease and a water-soluble liquid organic dispersant. Patent Document 1 also discloses that the lubricant may include a small amount of solid lubricant selected from graphite, molybdenum disulfide, and a polytetrafluoroethylene powder as a corrosion inhibitor, friction modifier (friction reducing agent), film-forming agent or the like in order to further compensate for the lubrication effect of the EP agent.

A inventor of the present application have developed a method of producing an ultrafine diamond particle dispersant that may be usable to produce a lubricant, and disclose the ultrafine diamond particle dispersant which includes a dispersion medium that form an emulsion-type solvent and the form thereof is slurry or paste-type (see Patent Document 2).

The term "ultrafine diamond particles" used herein refers to ultrafine diamond particles produced by the detonation technique, fine diamond particles with an average particle size of 100 nm or less produced conventionally by a static ultrahigh-pressure method or a vapor phase synthesis method, and a mixture of ultrafine diamond particles or fine diamond particles and non-diamond or quasi-diamond (amorphous) carbon that is at least partially bonded thereto, or a mixture of the ultrafine diamond particles or fine diamond particles and isolated particulate non-diamond or quasi-diamond carbon. All of these particles and mixtures may be within the scope of the present invention unless otherwise indicated herein.

A lubricant in which ultrafine diamond particles are dispersed in a lubricating oil has been known (see Patent Documents 3, 4, 5, and 6, for example). More specifically, Patent Document 3 discloses a lubricant for rolling bearing that ultrafine diamond particles having an average particle size of 0.1 μm or less are added to a lubricating oil in a proportion of 0.05 to 15 wt % of the lubricating oil. Patent Document 4 discloses a nanoparticle-containing lubricating oil composition that contains a base oil, a hydroxyl group-containing additive, and nanodiamond particles having a particle size of 10 nm or less. Patent Document 5 discloses a lubricant composition that is produced by adding 0.01 to 1.0 mass % of a solid friction modifier to a base oil, wherein the solid friction modifier contains 2 to 99 mass % of abrasion-resistant diamond having a cluster size of 1 to 10 nm, and 1 to 98 mass % of graphite. Patent Document 6 discloses a lubricant in which ultrafine diamond particles with rounded shape and having a particle size of 10 nm or less are dispersed in a lubricating oil.

A lubricant produced by adding ultrafine diamond particles to lithium soap grease has been known (see Non-patent Document 1, for example). Non-patent Document 1 discloses that the ultrafine diamond particles improve abrasion resistance and seizure resistance based on the Falex test results.

Non-patent Document 3 discloses that the lubrication properties of a rolling oil have a correlation with the thickness of an oil film (i.e., the plate-out behaviors (i.e., the emulsion breaks on the working surface so that the surface is wetted only with the oil) have a correlation with the friction coefficient, and improve the lubricating performance). Specifically, Non-patent Document 3 discloses that excellent lubrication properties are obtained in the order of the emulsion configuration of (O/W)<(W/O)<(W/O/W), and it is desirable that the final emulsion configuration on the working surface be a W/O emulsion configuration.

A metal slide member which is provided a layer containing molybdenum disulfide which is a solid lubricant in a surface layer having a depth of 20 μm or less by causing a fine molybdenum disulfide powder to collide with the surface of the metal slide member, a surface treating method therefor, and an injection material thereof have been disclosed (see Patent Documents 7 and 8). A composition for multilayer lubricating film that may form a dry film that exhibits excellent sliding properties and adhesion to a substrate, such as piston skirt or the like, a multilayer lubricating film, and a piston having the film have been disclosed (see Patent Document 9).

PRIOR ART DOCUMENT

Patent Document

Patent Document 1: JP-A-H01-292096
Patent Document 2: JP-B-3936724
Patent Document 3: JP-A-H07-118683
Patent Document 4: JP-A-2006-241443
Patent Document 5: JP-A-H04-502930
Patent Document 6: JP-A-H05-171169
Patent Document 7: WO2002/040743
Patent Document 8: JP-A-2002-339083
Patent Document 9: JP-A-2008-56750

Non-Patent Document

Non-patent Document 1: Seiichiro Hironaka, "Ceramics as Solid Lubricant", Proceeding, Kogyo Seihin Gijutsu Kyokai, pp. 18-21, Jul. 1, 1998
Non-patent Document 2: Journal of the Japan Petroleum Institute, Vol. 25, No. 6, pp. 376-379, November 1982
Non-patent Document 3: Masataka Shirota and Kenji Sakai; Junkatsu, Vol. 27, No. 8, pp. 594-599 (1982)

SUMMARY OF THE INVENTION

Problems to be Solved by the Invention

The present invention was conceived as a result of focusing on unknown lubricating behavior of the O/W emulsion that has conventionally been used as a cutting lubricant or a plastic working lubricant, conducting extensive studies on the lubricating behavior of the O/W emulsion composition when adding ultrafine diamond particles to the O/W emulsion composition, and finding that nonconventional excellent lubrication properties are obtained by dispersing the ultrafine diamond particles in each phase of the O/W emulsion in controlled various manner.

The inventors found on the way to the invention that an improvement in frictional properties and friction fatigue properties due to the addition of ultrafine diamond particles cannot be achieved only by selecting a dispersant that merely disperses the ultrafine diamond particles in water, and in order to make these possible, it is inevitable for the water dispersant to have lubrication properties, and it is necessary to clarify the combined effect of the dispersant. The inventors conducted extensive studies on selection of a dispersant and an emulsifier suitably used for dispersion in oil, means of optimizing in whole by suppressing interference between the dispersant and the emulsifier, a production method, and the like. As a result, the inventors found that an O/W emulsion lubricant composition including the ultrafine diamond particles exhibits particularly excellent lubrication properties in comparison with conventional products. This finding has led to the completion of the present invention.

The O/W emulsion composition in which the ultrafine diamond particles are dispersed may have following configurations: for example, a configuration in which the ultrafine diamond particles are stably dispersed in water (continuous phase) (O/(W+ultrafine diamond particle) emulsion), a configuration in which the ultrafine diamond particles are stably dispersed in oil (dispersion phase) ((O+ultrafine diamond particle)/W emulsion), a configuration in which the ultrafine diamond particles are stably dispersed in both water and oil ((O+ultrafine diamond particle)/(W+ultrafine diamond particle) emulsion), or a configuration in which each oil particle includes a number of water drops including the ultrafine diamond particles. Any of these O/W emulsion composition may be within the scope of the present invention unless otherwise indicated herein.

Patent Document 1 discloses only that the addition of a solid lubricant to the oil-in-water emulsion (O/W emulsion) merely compensates for the lubricating effect of the EP agent as the concrete problems and effects thereof, but is absolutely silent about the effect on the frictional properties of dispersion of the ultrafine diamond particles having a predetermined average particle size, selection of dispersant, and addition of a plurality of dispersants, the dispersion state of the ultrafine diamond particles, unconventional excellent lubrication properties obtained by the present invention, use of an oil that exhibits both biodegradability and non-endocrine disrupter properties, an appropriate combination of a dispersant for the ultrafine diamond particles and an emulsifier, a method of producing the above lubricant composition, and the like.

Patent Documents 3, 4, 5, and 6 specify the particle size range, the adding concentration, the graphite content, the ashless friction adjusting additive, and the like, and disclose the functions of the solid lubricant particles in the assumed lubrication mechanism. However, Patent Documents 3, 4, 5, and 6 merely add the ultrafine diamond particles to a lubricating oil (mineral oil or synthetic oil) as a solid lubricant. An excellent friction coefficient and stable friction fatigue properties cannot be achieved by merely adding the ultrafine diamond particles. Patent Documents 3, 4, 5, and 6 do not disclose technical idea and production method and the like for achieving excellent lubrication properties by optimally selecting and adding the dispersant and the emulsifier to the O/W emulsion dispersion system at all.

Non-patent Document 1 partially discloses an improvement in seizure resistance, but is absolutely silent about the configuration and method of producing the lubricant that includes the O/W emulsion including the ultrafine diamond particles, a dispersant that dominates the frictional properties and the importance of selection of the dispersant, and the unconventional excellent lubrication properties achieved by the present invention.

Many reports (Patent Document 4, for example) have been disclosed about particle-containing lubricant compositions that aim at improving abrasion resistance and seizure resistance and achieving a particle rolling lubrication mechanism and the like. Regarding lubricant containing particles having nanometer-sized region, the effect of the addition of ultrafine diamond particles to a mineral oil, a synthetic oil, or a grease thereof aimed at achieving a rolling lubrication mechanism have been disclosed as a conventional technology. However, reports have scarcely been made on the importance and the effect of the dispersant on an improvement of frictional properties due to the addition of ultrafine diamond particles. These reports disclose merely improving dispersibility or adding a friction modifier or the like as a means for achieving a rolling effect using the nanoparticles.

Specifically, a rolling effect using the ultrafine diamond particles may be expected to be achieved by utilizing the shape and the like derived from the nanosize of the ultrafine diamond particles. However, the ultrafine diamond particles have been merely added while not understanding the actual design of the lubricant, an effective practical method, and a production method. For the particular reason that the ultrafine diamond particles are produced in an extreme environment, the ultrafine diamond particles are still expensive as an industrial material. It is necessary to add a certain amount of the ultrafine diamond particles to an oil or the like in order to achieve an expected lubricating effect, but not adding without any aim. No effects are expected when merely adding the ultrafine diamond particles to a lubricating oil without aim, thereby resulting in only occurrence of a seizure phenomenon.

Therefore, in order to promote utilization of the ultrafine diamond particles in industrial applications, it is necessary to determine a configuration that allows only a small amount of ultrafine diamond particles to effectively act on the friction surface, select a dispersant that implements a lubricating effect, achieve a further improvement in performance including friction fatigue properties, and provide a production method that implements these requirements. However, no solution has clearly been proposed.

Moreover, a component configuration that achieves biodegradability and significantly reduces environmental load by eliminating the use of materials including an endocrine disruptor has not been studied at all.

A number of water-soluble polishing agents that aim to use for micropolishing, such as texturing or the like and are prepared by dispersing the ultrafine diamond particles in water or adding the ultrafine diamond particles to an water emulsion have been reported. Related-state of art technology that utilizes the ultrafine diamond particles has focused on the configuration of a surfactant that improves the dispersibility of fine particles as the polishing particles and provides a nanometer-sized minute cutting edge specific for the fine particle size, or the treatment of the polishing waste. Though the ultrafine diamond particles are expected to be added to an water emulsion, the ultrafine diamond particles have been merely added to an water emulsion while not understanding the actual design of the water-soluble polishing agent, an effective practical method, and a production method.

Attempts have been made to improve the lubrication properties of an O/W emulsion used as a plastic working lubricant by adding fine particles, and a concept of adding a conventional solid lubricant, such as molybdenum disulfide, graphite or the like may be attended. However, use of the ultrafine diamond particles which is a polishing agent having the highest hardness among known materials has not attracted attention at all. Therefore, addition to the design of a dispersant that allows the ultrafine diamond particles to exhibit lubrication properties in oil or water, and the selection criterion of optimally selecting the emulsifier, the design of the dispersion state of the ultrafine diamond particles in an O/W emulsion, and a production method that implements these requirements have not been proposed and made clear at all.

A fineblanking process is the highest level of working difficulty, and is a representative example of highly loaded lubrication. The surface of the mold tool is always subjected to seizure conditions so that the processing accuracy is lost. When applying to a bearing, wire drawing, or deep drawing, similarly an improvement in lubrication function that reduces a change in rotation torque and improves the working accuracy is limited. An oiliness improver, an extreme pressure agent (EP agent), or a solid lubricant is used in the conventional oil-soluble lubricant composition as an additive that aims to improve accuracy and efficiency. However, these additives have many problems in that an improvement mechanism in lubrication properties is limited, it lacks the consideration to exhaustible resources, and these additives have poor biodegradability, and contain a component that falls under the substances specified by the PRTR or PoHS, for example.

In particular, a water-soluble lubricant that is safe and exhibits high lubrication properties equal to those of an oil-soluble lubricant that contains an extreme pressure agent (EP agent) with respect to the lubricating performance as the water-soluble lubricant has not been developed yet.

Non-patent Document 3 describes that it is desirable that the final emulsion configuration on the working surface be a W/O emulsion configuration. However, a W/O/W emulsion lacks emulsion stability, and requires a special method that sprays the emulsion while always mandatorily stirring during actual usage.

Moreover, it is difficult to achieve high workability, such as adjustment of the amount of emulsifier or the like and stable operation of maintaining the emulsion particle size.

Patent Documents 1 to 6 disclose that lubrication properties are improved by adding an oiliness improver or a solid lubricant to the base oil of the lubricant composition. In particular, most inorganic solid lubricants have a high specific gravity, and have poor dispersibility (problem) in a low-viscosity nonaqueous or aqueous system.

These problems have been intended to solve by physically improving the dispersion stability by utilizing a high-viscosity grease, a thickening water-soluble polymer, or the like. It is not exemplified that the dispersion stability or the lubrication properties have been effectively achieved by adding the solid lubricant to the oil phase (O phase) and/or the water phase (W phase) of the emulsion.

Patent Documents 7 and 8 disclose a method of forming a strong solid lubricant layer by utilizing fine molybdenum disulfide particles having an average particle size of 1 μm or more as a solid lubricant, an injection material, and a piston including the solid lubricant layer. In this method, the molybdenum disulfide particles are caused to collide with the sliding surface of the slide member by applying shot peening technology so that the particles are injected into the surface by impact energy.

Patent Documents 7 and 8 disclose that the sliding resistance reduction effect can be maintained for a long time. Patent Document 9 discloses a multilayer lubricating film and multilayer lubricant composition that exhibits excellent adhesion, abrasion resistance, and seizure resistance, and has a low friction coefficient by blending fine solid lubricant particles to a binder resin and a solvent to improve the dry film lubricant.

The former technology can improve delamination and the short life in the solid lubricant layer or film (coating layer). Taking into consideration of the forming feature that the particles are injected by impact energy, it is obvious that the specific gravity and the particle size of the particles for ensuring the impact energy necessary for injection are limited in addition to the lubrication properties. Patent Documents 7 and 8 are entirely silent about a coating layer (similar to the solid lubricant layer) according to the present invention that includes the nanometer-sized ultrafine diamond particles having a specific gravity about half of that of the molybdenum disulfide particles, formation of a composite coating layer that includes the ultrafine diamond particles, and provision of a self-repair function upon removal of the particles, and measures against minute and complex shapes (i.e., the problems to be solved by the present invention). In the latter case, although the dry film lubricant achieves an improvement to a certain extent, an excellent lubrication function and durability required for a coating layer or a member having a coating layer (e.g., a reduction in delamination of the film, a reduction in removal and wear of solid lubricant particles, and an increase in life) are not expected to be sufficiently achieved when applied to a lubricating coating member (tribological member).

A first object of the present invention is to provide a lubricant composition that exhibits excellent lubrication properties that cannot be obtained from the above conventional technologies by clarifying the dispersant and the configuration of the dispersion state of the ultrafine diamond particles that gives excellent lubrication properties to the ultrafine diamond particles in an O/W emulsion composition included the ultrafine diamond particles, the lubrication characteristic to be obtained, and a method of producing the O/W emulsion composition.

A second object of the present invention is to provide a lubricant composition that exhibits both improved lubrication properties and high biodegradability.

Means for Solving the Problems

The inventors conducted extensive studies on the lubricating behavior when adding the ultrafine diamond particles to the O/W emulsion composition, and successfully dispersed the ultrafine diamond particles in each phase of the O/W emulsion in controlled various manner after trial and error. The inventors found a configuration of the dispersant and the emulsifier that draws out further excellent frictional properties of the ultrafine diamond particles, and demonstrated unconventional excellent lubrication properties in each dispersion state. The inventors also found a production method that implements excellent lubrication performance, and confirmed that the emulsion composition can be produced by this method with high repeatability. Specifically, various aspects of the present invention are given below.

According to a basic aspect of the present invention, there is provided an O/W emulsion composition comprising ultrafine diamond particles having an average particle size of 100 nm or less, the ultrafine diamond particles being treated with a dispersant. The O/W emulsion composition according to the basic aspect of the present invention may be used as a lubricant or a coating agent as described later. The following first to ninth aspects relate to a lubricant composition as a typical application example of the emulsion composition. Note that the term "lubricant composition" may be replaced with the term "emulsion composition". Specifically, the following aspects as lubricant compositions is common to aspects as emulsion compositions.

According to a first aspect of the present invention, there is provided a lubricant composition (O/W emulsion composition) comprising an emulsifier, and ultrafine diamond particles having an average particle size of 100 nm or less, the ultrafine diamond particles being treated with a dispersant.

It is preferable that the ultrafine diamond particles be dispersed in the water phase (W phase) and/or the oil phase (O phase). It is particularly preferable that the ultrafine diamond particles be dispersed in both the water phase (W phase) and the oil phase (O phase).

It is preferable that the ultrafine diamond particles dispersed in the water phase be ultrafine diamond particles treated with a water dispersion dispersant by adding the water dispersion dispersant after or when dispersing the ultrafine diamond particles in water.

It is more preferable that the water dispersion dispersant comprises one or plurality of an anionic dispersant, an amphoteric dispersant, and a nonionic dispersant. It is still more preferable that the water dispersion dispersant comprises a combination of an anionic dispersant and a nonionic dispersant.

The water dispersion dispersant for the ultrafine diamond particles is referred to herein as "water dispersion ultrafine diamond particle dispersant (WS)". Examples of the water dispersion ultrafine diamond particle dispersant (WS) include anionic dispersants such as a higher fatty acid, a polyoxyethylene (added mole number (n) of ethylene oxide is 3 or more) alkyl (Cn (alkyl chain R=8 to 24; hereinafter the same)) ether carboxylic acid, a dimer in which an alkyl (Cn) fatty acid is added to a hydroxyl group of a castor oil fatty acid, an α-olefin (Cn) sulfate, a higher fatty acid (Cn) methyl ester-α-sulfate, a petroleum (molecular weight: 400 to 1000) sulfonate or sulfate, a higher fatty acid sulfate, and an alkali metal salt, an alkaline earth metal salt, a heavy metal salt, a mono-, di-, or triethanolamine salt thereof, amphoteric dispersants such as a hydroxyalkyl-α (or β)-alanine, an alkali metal salt, a heavy metal salt, and a mono-, di-, or triethanolamine salt thereof, a compound in which 1 mol or more of ethylene oxide (EO)n is bonded to the alkyl group thereof, an alkylcarboxybetaine quaternary ammonium, sulfonium, or phosphonium salt, and lecithin, and nonionic dispersants such as a polyoxyethylene higher fatty acid (Cn) ester, a higher fatty acid (Cn) mono-, di-, or triethanolamide, a polyoxyethylene higher alcohol (Cn) ether, a polyoxyethylene higher amine (Cn) ether, a polyoxyethylene fatty acid (Cn) amide, a polyoxyethylene-polypropylene oxide block copolymer (pluronic), an alkyl (Cn) fatty acid pluronic ether or ester, and a polyoxyethylene higher fatty acid sucrose ester. Note that the above compounds are representative examples of the water dispersion dispersant, but not limited thereto insofar as the dispersant is compatible with the emulsifier for the base emulsion (A) and does not hinder dispersion of the ultrafine diamond particles. Any of such water dispersion dispersants may be within the scope of the present invention unless otherwise indicated herein.

It is preferable that the ultrafine diamond particles dispersed in the oil phase be ultrafine diamond particles treated with a water dispersion dispersant and an oil dispersion dispersant by adding the water dispersion dispersant after or when dispersing the ultrafine diamond particles in water, removing water, and then adding the oil dispersion dispersant.

It is more preferable that the oil dispersion dispersant include either one of a polar surfactant and a nonpolar surfactant or both. It is still more preferable that the surfactant have an HLB value of 8 or less.

The oil dispersion dispersant for the ultrafine diamond particles is referred to herein as "oil dispersion ultrafine diamond particle dispersant (OS)". The oil dispersion ultrafine diamond particle dispersant (OS) causes the ultrafine diamond particles to have a hydrophobic surface so that it plays the role that the ultrafine diamond particles are stably dispersed in the oil phase (O phase). The oil dispersion ultrafine diamond particle dispersant (OS) is preferably a surfactant that has a hydrophilic/hydrophobic balance (HLB) smaller than that of a water-soluble surfactant to the extent that the interfacial activity is not lost, and has weak interfacial activity (e.g., HLB=8 or less). When classifying in the polar surfactant and the non-polar surfactant, examples of the polar surfactant include a polyoxyethylene alkyl (Cn) ether carboxylic acid, a higher (alkyl chain R=8 to 24) fatty acid, a castor oil fatty acid, a fatty acid sulfonate or sulfate, a petroleum (molecular weight: 400 to 1000) sulfonate and an alkaline earth metal salt (excluding a calcium salt) or a heavy metal salt thereof, a hydroxyalkyl (alkyl chain: C12 to C18)-α (or β)-alanine, an alkylcarboxybetaine quaternary ammonium, sulfonium, phosphonium salt, alkaline earth metal salt, or heavy metal salt, an alkylolated sulfate of a higher fatty acid amide, an alkali metal salt and a mono-, di-, or triethanolamine salt thereof, a salt of a higher (Cn) amine and a higher (Cn) fatty acid, and the like. Examples of the nonpolar surfactant include a calcium salt of a polyoxyethylene (n=3 or more) alkyl (Cn) ether carboxylic acid, a calcium salt of a higher (Cn) fatty acid, a calcium salt of a fatty acid sulfonate or sulfate, a calcium salt of a petroleum (molecular weight: 400 to 1000) sulfonate, an alkaline earth metal salt (excluding a calcium salt) or a heavy metal salt thereof, a higher (Cn) fatty acid amide, a calcium salt of a hydroxyalkyl (alkyl chain: C12 to C18)-α (or β)-alanine, an alkylcarboxybetaine alkaline earth metal or heavy metal salt, lecithin, a higher (Cn) fatty acid-higher (Cn) alcohol amide, a higher (Cn) fatty acid-higher (Cn) alcohol ester, a sorbitan-fatty acid (Cn) ester, a pentaerythritol-fatty acid (Cn) ester, a partial ester, a full ester of a higher (Cn) fatty acid, and an ether, and the like. The oil dispersion ultrafine diamond particle dispersant (OS) is preferably at least one surfactant selected from the above surfactants. Further examples of the oil dispersion ultrafine diamond particle dispersant (OS), among P-1: hydrocarbon oil, V: animal or vegetable fats and oils, S: synthetic oil, and WS, include typically surfactants that have a hydrophilic/hydrophobic balance (HLB) smaller than that of a water-soluble surfactant to the an extent that the interfacial activity is not lost, surfactants that is compatible with an emulsifier (EM) for the base emulsion (A) as descried below and the oil dispersion ultrafine diamond particle dispersant (OS), and does not hinder dispersion of the ultrafine diamond particles, but not limited thereto. Any of such oil dispersion ultrafine diamond particle dispersants may be within the scope of the present invention unless otherwise indicated herein.

Examples of the emulsifier forming the basis for producing the emulsion (hereinafter refer to as "emulsifier (EM) for the base emulsion (A)") include anionic dispersants such as a higher fatty acid, a polyoxyethylene (n=3 or more) alkyl (Cn) ether carboxylic acid, a dimer in which an alkyl (Cn) fatty acid is added to a hydroxyl group of a castor oil fatty acid, an α-olefin (Cn) sulfate, a higher fatty acid (Cn) methyl ester-α-sulfate, a petroleum (molecular weight: 400 to 1000) sulfonate or sulfate, a higher fatty acid sulfate, and an alkali metal salt, an alkaline earth metal salt, a heavy metal salt, a mono-, di-, or triethanolamine salt thereof or the like, cationic dispersants such as an alkyl (Cn) quaternary ammonium salt or the like, amphoteric dispersants such as a hydroxyalkyl-α (or β)-alanine, and an alkali metal salt, a heavy metal salt, and a mono-, di-, or triethanolamine salt thereof, and a compound in which 1 mol or more of ethylene oxide (EO)n is bonded to the alkyl chain thereof, an alkylcarboxybetaine quaternary ammonium, sulfonium, or phosphonium salt, and lecithin, or the like, and nonionic dispersants such as a polyoxyethylene higher fatty acid (Cn) ester, a higher fatty acid (Cn) mono-, di-, or triethanolamide, a polyoxyethylene higher alcohol (Cn) ether, a polyoxyethylene higher amine (Cn), a polyoxyethylene fatty acid (Cn) amide, a polyoxyethylene-polypropylene oxide block copolymer (pluronic), an alkyl (Cn) fatty acid pluronic ether or ester, and a polyoxyethylene higher fatty acid sucrose ester, or the like. The above emulsifiers are typical examples of the so-called emulsifier used for an O/W emulsion in which oil droplets are emulsified and dispersed in water. The emulsifier is not limited thereto insofar as the emulsifier does not interfere with the water dispersion dispersant that disperses the ultrafine diamond particles in water and the oil dispersion dispersant that disperses the ultrafine diamond particles in oil, and does not hinder dispersion of the ultrafine diamond particles as described below. Any of such emulsifiers may be within the scope of the present invention unless otherwise indicated herein.

It is preferable that the emulsifier used to produce the base emulsion (A) includes one or plurality of an anionic emulsifier, a cationic emulsifier, an amphoteric emulsifier, and a nonionic emulsifier.

It is preferable that the content of the ultrafine diamond particles be 10 wt % or less in composition ratio. It is preferable that the effective concentration of the base oil component be 1 wt % or more. The term "effective concentration of the base oil component" refers to an oil phase ratio (wt %) obtained by dividing the base oil component (including the emulsifier (EM)) by the whole components of the base emulsion (A) consisting of the base oil component and the water component (i.e. the sum of the base oil component and the water component).

It is preferable to use the base oil being insoluble in water as the base oil composing the emulsion composition. Examples of the base oil include, for example, a hydrocarbon oil (P-1) such as n-paraffins, iso-paraffins, cycloparaffins, and squalene or the like, animal or vegetable fats and oils (hereinafter, refer to as V) such as mono-, di-, or triglyceride, wax, lecithin, cholesterol, steroid oil, tall oil, lanolin or the like, and a synthetic oil (S) such as esters of a lower (alkyl chain R=1 to 8) or higher fatty acid (alkyl chain R=8 to 24 (Cn)) and an alcohol (alkyl chain R=1 to 24), derivatives of a castor oil fatty acid, a copolymer of polyoxyethylene and polypropylene oxide, polybutene (viscosity: 10 to 1000 cSt), α-olefins, α-olefin oligomers (viscosity: 10 to 1000 cSt), higher fatty acids (Cn), higher alcohols (Cn), a silicone oil, polyphenyl ether, a fluorine oil, ricinoleic acid, sorbitan, esters and ethers of a hydroxyl group (alkyl chain R=1 to 24) of pentaerythritol or the like and an alkyl fatty acid (alkyl chain R=1 to 24), a petroleum (molecular weight: 400 to 1000) sulfonate, salts of an alkylamine (Cn) and a higher fatty acid (Cn) or the like. Further examples also include oxides, polymers (polymerized oil), condensates, amides, wax, sulfates, sulfites, sulfides, phosphates, metal salts, organic metal complexes, and the like of compounds composing the hydrocarbon oil (P-1), the animal or vegetable fats and oils (V), and the synthetic oil (S). The base oil is preferably at least one or more oil selected from these compounds. Note that the base oil is not limited thereto. Microcapsules of animal or vegetable fats and oils (manufactured by Miyoshi Oil & Fat Co., Ltd.) may also used. When dispersing such microcapsules in the water phase (W phase), the microcapsules behave in the same manner as solid particles. Any of such base oils may be within the scope of the present invention unless otherwise indicated herein. It is preferable that the O/W emulsion composition mainly consists of the base oil, the emulsifier, the dispersant, and water, and the components thereof do not fall under the substances specified by PoHS (the Norwegian Prohibition on Certain Hazardous Substances in Consumer Products) and PRTR (the Law Concerning Reporting, etc. of Releases to the Environment of Specific Chemical Substances and Promoting Improvements in Their Management).

According to a second aspect of the present invention, there is provided a method of producing an emulsion composition that includes ultrafine diamond particles in an water phase (W phase), specifically the method comprises dispersing an ultrafine diamond particle water dispersion raw material (which is obtained by dispersing ultrafine diamond particles having an average particle size of 100 nm or less in water) in water using a water dispersion dispersant to prepare a dispersant-treated ultrafine diamond particle water dispersion, or treating the ultrafine diamond particles with the water dispersion dispersant while dispersing aggregate particles to prepare a dispersant-treated ultrafine diamond particle water dispersion, adding an emulsifier to a base oil to prepare an emulsion base oil, adding water to the emulsion base oil to subject to phase inversion emulsification to prepare an O/W composition, i.e. a base emulsion (A), mixing the dispersant-treated ultrafine diamond particle water dispersion with the base emulsion (A), and adding water to the mixture.

The expression "ultrafine diamond particle X dispersion" (X: water, oil (base oil), or the like) refers to a dispersion solution prepared by treating ultrafine diamond particles (dispersoid) with a dispersant, and dispersing the ultrafine diamond particles in dispersion medium such as water or oil, normally referred to as "dispersant-treated ultrafine diamond particle X dispersion"). In the emulsion composition according to the present invention, X indicates whether the ultrafine diamond particles are subjected to be dispersion treatment in the water phase (W phase) of the emulsion dispersion medium (continuous phase) or in the oil phase (O phase) of the emulsion dispersoid (dispersed phase). In the present examples, a case where the ultrafine diamond particles are dispersed in the water phase (W phase) is clearly indicated by "DW", and a case where the ultrafine diamond particles are dispersed in the oil phase (O phase) is clearly indicated by "DO".

In the production of compositions as described in each examples in which the ultrafine diamond particles are dispersed in various ways, the "ultrafine diamond particle X dispersion" is distinctly used as follows.

"Ultrafine Diamond Particle Water Dispersion Raw Material":

The term "ultrafine diamond particle water dispersion raw material" refers to a raw material obtained by mechanically dispersing the starting material, in which the particle surface has been already hydrophilized, in water, in a production process of the emulsion composition according to the present invention.

"Dispersant-Treated Ultrafine Diamond Particle Water Dispersion (DW)":

The term "dispersant-treated ultrafine diamond particle water dispersion" refers to a dispersion solution obtained by dispersing the ultrafine diamond particles in water using the water dispersion ultrafine diamond particle dispersant (WS). The dispersant-treated ultrafine diamond particle water dispersion is used to produce an emulsion composition in which the ultrafine diamond particles are dispersed in the water phase (W phase), and the dispersant-treated ultrafine diamond particle water dispersion may be indicated by "DW" in connection with the dispersion state of the ultrafine diamond particles in the emulsion composition.

"Dispersant-treated Ultrafine Diamond Particle Oil Dispersion (DO)":

The term "dispersant-treated ultrafine diamond particle oil dispersion" refers to a dispersion solution obtained by dispersing, while hydrophobizing at the same time, hydrophilic ultrafine diamond particles obtained by dehydrating the dispersant-treated ultrafine diamond particle water dispersion (DW) in the base oil (P-1) in which an oil dispersion ultrafine diamond particle dispersant (OS) is dissolved. The dispersant-treated ultrafine diamond particle oil dispersion may be indicated by "DO" in connection with the dispersion state of the ultrafine diamond particles in the emulsion composition. The dispersant-treated ultrafine diamond particle oil dispersion is used as the base oil component itself (or part of the base oil component) of the emulsion composition in which the ultrafine diamond particles are dispersed in the oil phase (O phase), and the dispersant-treated ultrafine diamond particle oil dispersion may be simplistically referred to as "ultrafine diamond particle oil dispersion: base oil P-2" in the description of the production of the emulsion composition as described below.

A product obtained by dehydrating the dispersant-treated ultrafine diamond particle water dispersion may be referred to as "water dispersion ultrafine diamond particle solid lubricant" (or "water dispersion ultrafine diamond solid lubricant particles"), and a product obtained by hydrophobizing the water dispersion ultrafine diamond particle solid lubricant using the oil dispersion dispersant (OS) in a dispersion medium such as n-hexane or the like, and then evaporating the dispersion medium may be referred to as "oil dispersion ultrafine diamond particle solid lubricant" (or "oil dispersion ultrafine diamond solid lubricant particles").

The term "phase inversion emulsification" refers to an emulsion method that includes mixing the base oil with the emulsifier, stirring the mixture while gradually adding water, and sufficiently kneading the mixture when the maximum viscosity (O:W=about 7:3) of the system has been reached. After completion of the kneading step, water is added to adjust until the desired viscosity (consistency: about 5 to 230) is achieved. In the case of O/W emulsion including the ultrafine diamond particles in the oil phase (O phase), the base oil component includes the ultrafine diamond particles treated with a certain dispersant. In the case of the water phase (W phase) including the ultrafine diamond particles, the ultrafine diamond particles treated with a certain dispersant may be included in water having the desired effective base oil component concentration and/or in water that undergoes phase inversion. Any of such states may be within the scope of the present invention unless otherwise indicated herein.

The method may include mixing the dispersant-treated ultrafine diamond particle water dispersion with the emulsion base oil, and adjusting the ratio of the water phase (W phase) to the oil phase (O phase) by adding water to effect self-emulsification, instead of both steps of adding water to the emulsion base oil to effect phase inversion emulsification to the O/W composition to prepare the base emulsion (A), and mixing the dispersant-treated ultrafine diamond particle water dispersion with the base emulsion (A) and adjusting by adding water to the mixture.

An O/W emulsion in which the base emulsion (A) includes the ultrafine diamond particles may be referred to as "O/(W+ultrafine diamond particle) emulsion composition", for example.

According to a third aspect of the present invention, there is provided a method of producing an O/W emulsion composition (lubricant composition) that includes ultrafine diamond particles in an oil phase (O phase), the method including dispersing ultrafine diamond particles in water to prepare a ultrafine diamond particle water dispersion raw material, dispersing the ultrafine diamond particle water dispersion raw material in water using a water dispersion dispersant to prepare a dispersant-treated ultrafine diamond particle water dispersion, or treating the ultrafine diamond particle water dispersion raw material with the water dispersion dispersant while dispersing aggregate particles at the same time to prepare a dispersant-treated ultrafine diamond particle water dispersion, removing water from the dispersant-treated ultrafine diamond particle water dispersion to prepare hydrophilic ultrafine diamond particles, adding an oil dispersion dispersant to a base oil optionally together with an emulsifier to disperse the hydrophilic ultrafine diamond particles in the base oil to prepare a dispersant-treated ultrafine diamond particle oil dispersion, mixing another base oil with the dispersant-treated ultrafine diamond particle oil dispersion, and adding the emulsifier to the mixture to prepare an emulsion base oil component, stirring the emulsion base oil component while gradually adding water to effect phase inversion emulsification into an O/W composition, and adjusting the ratio of the water phase (W phase) to the oil phase (O phase) by adding water. In either or both of stirring the emulsion base oil component while gradually adding water to effect phase inversion emulsification into an O/W composition, and adjusting the ratio of the water phase (W phase) to the oil phase (O phase) by adding water, it is preferable to add the dispersant-treated ultrafine diamond particle water dispersion instead of water so that the ultrafine diamond particles are also included in the water phase (W phase).

The method may include mixing the dispersant-treated ultrafine diamond particle oil dispersion with another base oil that includes an emulsifier, and adjusting the ratio of the water phase (W phase) to the oil phase (O phase) by adding water to effect self-emulsification and prepare the microemulsion, instead of mixing another base oil with the dispersant-treated ultrafine diamond particle oil dispersion, and adding the emulsifier to the mixture to prepare an emulsion base oil component, stirring the emulsion base oil component while gradually adding water to effect phase inversion emulsification into an O/W composition, and adjusting the ratio of the water phase (W phase) to the oil phase (O phase) by adding water.

According to a fourth aspect of the present invention, there is provided solid particles produced by adding a water dispersion dispersant after or when dispersing ultrafine diamond particles in water, and removing water from the mixture. The solid particles may be ultrafine diamond particles having the water dispersion dispersant or the oil dispersion dispersant on the surface of the particle as a core.

It is preferable that the water dispersion dispersant comprises at least one of an anionic dispersant, an amphoteric dispersant, and a nonionic dispersant. It is more preferable that the water dispersion dispersant comprises a combination of an anionic dispersant and a nonionic dispersant.

The inventors conducted studies to further improve the lubrication properties. As a result, the inventors found that a configuration and a production method that exhibit improved lubrication properties and high biodegradability can be obtained by adding an oiliness improver to the water phase (W phase) of the O/W emulsion that includes the ultrafine diamond particles to form a multiple configuration that includes a multiple emulsion state formed by the O/W emulsion and a new O/W emulsion produced in the system, or similarly, adding at least one solid lubricant other than the ultrafine diamond particles to the water phase (W phase) of the O/W emulsion to form a composite configuration that includes two or more types of solids. Further each aspect of the present invention is described below in detail.

The term "multiple emulsion" refers to a state in which in a same system after completion of emulsification, new emulsion having identical or different emulsion forms, such as oil-in-water (O/W), water-in-oil (W/O), water-in-oil-in-water (W/O/W), oil-in-water-in-oil (O/W/O) or the like is newly formed and coexists in combination.

The term "multi-phase emulsion", which is also called composite emulsion, refers to a water-in-oil-in-water (W/O/W) emulsion or an oil-in-water-in-oil (O/W/O) emulsion that has a plurality of phases. The multiple emulsion configuration used in the present invention includes a multiple O/W emulsion configuration in which two or more O/W emulsions including an O/W emulsion obtained by phase inversion emulsification and another O/W emulsions obtained by adding additives after the emulsification in order to enhance the properties of the respective additives coexist in combination therewith. The multiple emulsion configuration used herein also includes coexistence with a multi-phase emulsion, such as oil-in-water-in-oil (O/W/O) emulsion, water-in-oil-in-water (W/O/W) emulsion and the like.

The term "multiple configuration" refers to a state in which two or more identical configurations (e.g., emulsion) or different configurations are coexistent in combination in a single system, and the term "composite configuration" refers to a state in which two or more different substances are coexistent in combination in a single system. A composition in which the oiliness improver is dispersed is referred to as "multiple dispersion composition", and a composition in which the solid lubricant is dispersed is referred to as "composite dispersion composition", and both are distinguished as being different each other. In order to express the difference of the dispersion condition that the oiliness improver is emulsified and dispersed, and the solid lubricant is merely stably dispersed, it put different names, but not limit the dispersion substances.

According to a fifth aspect of the present invention, there is provided a lubricant composition including at least one oiliness improver in the water phase (W phase) of the lubricant composition according to the first aspect of the present invention.

The lubricant composition is preferably a multiple dispersion composition having a multiple emulsion state obtained by adding at least one oiliness improver to the water phase (W phase) of the O/W emulsion composition that includes the ultrafine diamond particles to produce a new O/W emulsion in the system. The lubricant composition may be a multiple emulsion composition that includes the O/W emulsion composition that includes the ultrafine diamond particles, and at least one of an oil-in-water (O/W) emulsion, a water-in-oil (W/O) emulsion, a water-in-oil-in-water (W/O/W) emulsion, and an oil-in-water-in-oil (O/W/O) emulsion separately prepared and having different features in coexisting state.

The term "oiliness improver (Y)" refers to a substance that forms a film on a friction surface via adsorption or a chemical reaction, and reduces friction. The film thus formed is preferably an organic metal complex, an organometallic compound, or an inorganic substance. These substances are collectively referred to as "oiliness improver (Y)". Examples of the oiliness improver (Y) include alkyl (Cn) fatty acids, alkyl (Cn) alcohols, alkyl (Cn) fatty acid esters, alkyl (Cn) amines, polyhydric alcohol partial esters, polyhydric alcohol full esters, and the like. Further, a composite, a complex reaction product, a polymer, an oxide, a condensate, a metal salt, and the like of one or more of the above compounds are preferable as the oiliness improver (Y). Note that the oiliness improver (Y) is not limited thereto insofar as the oiliness improver (Y) reduces friction in the boundary lubrication region. It is also possible to use even the hydrocarbon oil (P-1), animal or vegetable fats and oils (V), a synthetic oil (S), or the like that is used as the base oil component and does not include a polar group insofar as the above compound is produced under the lubrication conditions. As an extreme pressure agent (EP agent), zinc dialkyldithiophosphates (ZnDTP), molybdenum dithiocarbamate (organomolybdenum), and paraffin wax chlorinated paraffins that do not fall under the substances specified by the PRTR and PoHS are preferable. Note that these are merely exemplified, and the extreme pressure agent is not limited thereto. As a sulfur compound, a partial sulfide of the alkyl chain or the functional group of the base oil (P-1), animal or vegetable fats and oils (V), a synthetic oil (S), an oil dispersion ultrafine diamond particle dispersant (OS), or the like, or the water dispersion ultrafine diamond particle dispersant (WS) that is dissolved in the oil dispersion ultrafine diamond particle dispersant (OS) may be used. As a phosphorus compound, a compound that is bonded to the alkyl chain or the functional group of the base oil (P-1), animal or vegetable fats and oils (V), a synthetic oil (S), or an oil dispersion ultrafine diamond particle dispersant (OS) via a partial ester or ether bond may be typically used, and a composite, a complex reaction product, a polymer, an oxide, a condensate, a metal salt, and the like of one or more of the above compounds may preferably be used. It is not preferable to use a substance that falls under the substances specified by the regulations of the environmental protection (PoHS, PRTR, and the like). However, such a substance may be used as an exception when an alternative substance has not been developed, or when used in a completely closed system. For example, molybdenum dithiocarbamate (organomolybdenum) used as the oiliness improver in the friction test of Example 8 (lubricant composition) corresponds thereto. Since molybdenum dithiocarbamate exhibits excellent frictional properties, molybdenum dithiocarbamate may be used in a completely closed system in conformity with the regulations.

According to a sixth aspect of the present invention, there is provided a lubricant composition including at least one solid lubricant other than the ultrafine diamond particles in the water phase (W phase) of the lubricant composition according to the first aspect of the present invention. The lubricant composition is preferably a composite dispersion composition in which the ultrafine diamond particles and the solid lubricant other than the ultrafine diamond particles coexist in combination in the O/W emulsion composition to form composite state. The lubricant composition may be the lubricant composition according to the first aspect of the present invention in which the ultrafine diamond particles included in the O/W emulsion composition and the solid lubricant other than the ultrafine diamond particles included in the water phase (W phase) of the O/W emulsion composition form at least one composite state. It is preferable that the solid lubricant other than the ultrafine diamond particles included in the water phase (W phase) comprises at least one selected from an organic substance and an inorganic substance, and has an average particle size of 5.0 μm or less, and the total content of the ultrafine diamond particles and the solid lubricant other than the ultrafine diamond particles be 50 wt % or less.

The solid lubricant other than the ultrafine diamond particles is referred to herein as "solid lubricant other than ultrafine diamond particles (Z)". Examples of the solid lubricant other than the ultrafine diamond particles (Z) include organic solid lubricants such as amino acid polyimide resins, polyamideimide resins, epoxy resins, alkyd resins, phenol resins, polyacetal resins, polyethersulfone resins, fluorine resins, monoacyls, aminocarboxylic acids, base amino acids, polyimides, amideimides, polyamides, alkyd resins, hydroxybenzene, urea, polyacetals, polyurethanes, ether sulfones, polyethers, polyethersulfones, polysulfones, melamine cyanulate, polytetrafluoroethylene, polyethylene terephthalate, and organic metal complexes, and inorganic solid lubricants such as metal oxides (e.g., mica, silicon dioxide, zirconia and the like), ceramic inorganic particles (e.g., tungsten disulfide, molybdenum disulfide, graphite, fluorinated graphite, fullerene and the like), and the like.

Note that arbitrary particles having a solid lubrication function may be used, but not limited thereto. Further, a product produced by reacting each other in a friction environment may be used insofar as it exhibits a solid lubrication function. It is preferable to use at least one solid lubricant (Z) having an average particle size of 5.0 μm or less. Any of such solid lubricants may be within the scope of the present invention unless otherwise indicated herein.

The average particle size is limited as described above in order to add and disperse the solid lubricant (Z) in the water phase (W phase) of the O/W emulsion composition. When dispersing the solid lubricant (Z) in the oil phase (O phase), the average particle size is obviously limited by the diameter of oil droplets. The diameter of oil droplets of the emulsion-type composition is 1 to 10 μm, and the diameter of oil droplets of the microemulsion-type composition is 0.1 to 1 μm. Therefore, when adding and dispersing the solid lubricant other than the ultrafine diamond particles (Z) in the oil phase (O phase), it is preferable that the solid lubricant (Z) have an average particle size equal to or less than ½ to 1/100 of the diameters of oil droplets depending upon the corresponding type of emulsion, for example.

It is preferable that the solid lubricant other than the ultrafine diamond particles included in the water phase (W phase) comprises at least one selected from an organic substance and an inorganic substance, has an average particle size of 5.0 μm or less, and the total content of the ultrafine diamond particles and the solid lubricant other than the ultrafine diamond particles be 50 wt % or less.

According to a seventh aspect of the present invention, there is provided a lubricant composition including at least one oiliness improver and at least one solid lubricant other than the ultrafine diamond particles in the water phase (W phase) of the lubricant composition according to the first aspect of the present invention. The lubricant composition is preferably a multiple-composite dispersion composition that is a multiple dispersion composition having a multiple emulsion state in which both an O/W emulsion state including the oiliness improver and an O/W emulsion state including the ultrafine diamond particles are coexistent in a single O/W emulsion composition system, and also is a composite dispersion composition having a composite state in which the ultrafine diamond particles dispersed in the O/W emulsion composition and the solid lubricant other than the ultrafine diamond particles are coexistent in a single O/W emulsion composition. The lubricant composition also may be the lubricant composition according to the first aspect of the present invention that includes in combination with a multiple emulsion state in which the O/W emulsion composition including the ultrafine diamond particles and an O/W emulsion including the oiliness improver added to the water phase (W phase) of the O/W emulsion composition are coexistent in combination, and at least one composite state formed by the solid lubricant other than the ultrafine diamond particles added to the water phase (W phase) of the O/W emulsion composition.

According to an eighth aspect of the present invention, there is provided a lubricant composition that does not include water, and includes the ultrafine diamond particles treated with a dispersant, at least one oiliness improver, and/or at least one solid lubricant other than the ultrafine diamond particles. The lubricant composition also may be the lubricant composition according to the first aspect of the present invention that does not include water, and includes at least one oiliness improver and/or at least one solid lubricant other than the ultrafine diamond particles.

According to a ninth aspect of the present invention, there is provided the method of producing a lubricant composition according to the third aspect of the present invention, comprising post-adding at least one oiliness improver and/or at least one solid lubricant other than the ultrafine diamond particles to the water phase (W phase) of the O/W emulsion composition including the ultrafine diamond particles.

According to a tenth aspect of the present invention, there is provided use of an O/W emulsion composition including ultrafine diamond particles (basic aspect of the present invention) as a coating agent. The coating agent according to the present invention may be the emulsion composition itself according to the present invention, or may appropriately include an additional component normally included in a coating agent depending on the coating conditions to be aimed. The above aspects of the lubricant composition may be applied to the emulsion composition used as the main component.

According to an eleventh aspect of the present invention, there is provided a surface-modified substrate produced by applying the emulsion composition (basic aspect of the present invention), and drying or water washing-drying the emulsion composition. Examples of the substrate include a lubrication member for a power transmission mechanism, a power absorbing mechanism, and the like. Specific examples of the power transmission mechanism include a link, a cam, a gear, a traction drive, a feed screw, and a guide. Specific examples of the power absorbing mechanism include a cutting tool and a plastic working tool.

A surface-modified lubrication member may be basically produced by supplying the emulsion composition (coating agent) according to the present invention to the surface of the substrate, performing a coating treatment by a pre-conditioning interim operation or the like, and drying the coating.

According to a twelfth aspect of the present invention, there is provided an emulsion composition in which wherein a part of an water phase (W phase) of an O/W emulsion composition including ultrafine diamond particles includes a hydrophilic solvent. Examples of the hydrophilic solvent include glycerol, oligosaccharides, polysaccharides, and the like. The emulsion composition can be used at a lower temperature by using the hydrophilic solvent, so that the emulsion composition can be used in a wide range of applications.

Effects of the Invention

The emulsion composition according to the present invention is configured as described above.

The lubricant using the emulsion composition exhibits excellent lubrication properties, and the coating agent using the emulsion composition exhibits an excellent protection function or lubrication function.

The method of producing a lubricant composition according to the present invention can produce a lubricant that exhibits excellent lubrication properties.

The solid particles according to the present invention can produce a lubricant that exhibits excellent lubrication properties.

The lubricant composition according to the present invention has a significantly low friction coefficient and excellent wear resistance properties as compared with the conventional lubricant compositions. Moreover, the following significant effects can be obtained according to the present invention.

1. Since the lubricant composition exhibits a significantly low friction coefficient and excellent wear resistance properties, the application range thereof can be spread to friction application fields in a severe environment in which a friction/wear phenomenon is involved.

2. Since a combination with a dispersant or an emulsifier, and the dispersion configuration of the ultrafine diamond particles can be controlled, the frictional properties can be significantly improved by adding only a small amount of ultrafine diamond particles. Therefore, the product cost can be significantly reduced while using expensive nano ultrafine particles.

3. The lubricant composition includes components that have high biodegradability and do not fall under the substances specified by PoHS (the Norwegian Prohibition on Certain Hazardous Substances in Consumer Products) and PRTR (the Law Concerning Reporting, etc. of Releases to the Environment of Specific Chemical Substances and Promoting Improvements in Their Management). Specifically, the lubricant composition utilizes energy resources that can be recycled without depending on exhaustible resources. Since the lubricant composition is safe and can be washed with water, environmental load and washing load can be reduced at a same time.

4. A low friction coefficient and stable friction fatigue properties are obtained by forming a ultrafine diamond particle concentration layer. Therefore, a highly reliable lubricant composition can be provided.

According to the method of producing a lubricant composition of the present invention, unconventional excellent frictional properties can be exhibited by adding only a very small amount of ultrafine diamond particles as a result of dispersing expensive ultrafine diamond particles in each phase of the O/W emulsion in a controlled manner. This significantly reduces the price of the lubricant composition. Moreover, since the method of producing a lubricant composition according to the present invention utilizes energy resources that can be recycled without depending on exhaustible resources and ensures biodegradability and non-endocrine disrupter properties, the method greatly contributes to the effective utilization of energy resources and significant reduction of environmental load.

The solid particles according to the present invention can produce a lubricant composition that exhibits excellent lubrication properties as described above. Moreover, an arbitrary lubricant composition can be obtained by adding an arbitrary additive at a desired concentration.

BEST MODE FOR CARRYING OUT THE INVENTION

Figure 1:
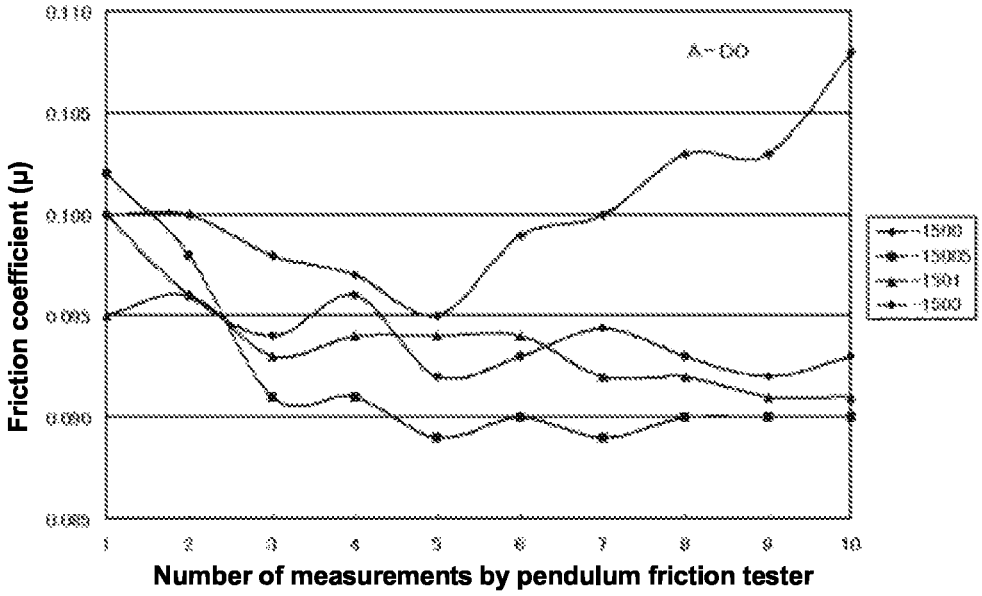
FIG. 1 is a view showing the friction fatigue properties of an emulsion-type lubricant composition of Example 2 in the present invention.

The inventors conducted demonstration experiments on production of an O/W emulsion composition including ultrafine diamond particles, and developed a novel lubricant composition that includes the ultrafine diamond particles in each of the water phase (W phase) and the oil phase (O phase) of the emulsion in an improved dispersion pattern. The inventors developed an effective lubricant composition by conducting experiments on a dispersant that exerts a significant effect on the frictional properties of the ultrafine diamond particles and their composite effects, and developed a production method that disperses the ultrafine diamond particles in various dispersion states.

A diamond lubricant composition according to the best mode of the present invention mainly includes five components broadly of a base oil (one or plurality of P-1: hydrocarbon oil, V: animal or vegetable fats and oils, and S: synthetic oil), an emulsifier, a dispersant, water, and ultrafine diamond particles.

The lubricant composition may further include an anti-foaming agent, a metal ion chelating agent, a rust preventive, an antioxidant, a bactericide, or the like in addition to the five above components as an additive for improving the secondary properties (ensuring that the lubricant composition fully exhibits its effects without any limitation), or an assistant for maintaining the effects of the lubricant composition for a long time. Examples of the anti-foaming agent include lower fatty acids, higher alcohols, dimethylpolysiloxane, an dimethylpolysiloxane emulsion, alkylene oxides, and the like. Examples of the metal ion chelating agent include alkali metal salts and mono-, di-, or triethanolamine salt, phosphates of edetic acid, and the like. Examples of the rust preventive include benzotriazole, salts thereof, higher fatty acid amides, alkylolated sulfate metal salts thereof, and the like. Examples of the antioxidant include dibutylhydroxytoluene. Examples of the bactericide preferably include triazine bactericides, thiazole bactericides, and the like. These additives are added to the lubricant composition in an amount of 1 wt % or less with respect to the total amount of the components of the O/W emulsion, but not limited thereto, insofar as the stability of the emulsified product and dispersion of the ultrafine diamond particles are not impaired. It is preferable to use a substance that does not fall under the substances specified by PoHS (the Norwegian Prohibition on Certain Hazardous Substances in Consumer Products) and PRTR (the Law Concerning Reporting, etc. of Releases to the Environment of Specific Chemical Substances and Promoting Improvements in Their Management).

According to a preferred embodiment of the present invention, the oil phase (O phase) which is dispersion phase includes at least one oil selected from a mineral oil, animal or vegetable fats and oils, a synthetic oil, a polymer, and a higher alcohol that do not act as an endocrine disrupter. The lubricant composition may have a configuration in which the ultrafine diamond particles are stably dispersed in water (continuous phase) (O/(W+ultrafine diamond particle) emulsion), a configuration in which the ultrafine diamond particles are stably dispersed in oil (dispersion phase) ((O+ultrafine diamond particle)/W emulsion), or a configuration in which the ultrafine diamond particles are stably dispersed in both water and oil ((O+ultrafine diamond particle)/(W+ultrafine diamond particle) emulsion). Any configuration can be used. Among them, the configuration in which the ultrafine diamond particles are stably dispersed in both water and oil is the best since the smallest friction coefficient and stable friction fatigue properties can be obtained. Production methods according to embodiments of the present invention described later are unconventional novel methods of producing a lubricant in which the ultrafine diamond particles are dispersed in each phase of the O/W emulsion. Since the resulting lubricant composition has high biodegradability, exhibits a property as a non-endocrine disrupter, and can be washed with water, the environmental load and washing load thereof are significantly low.

Embodiments of the present invention described in detail below relate to unconventional novel lubricant compositions produced by adding ultrafine diamond particles that have the highest hardness and inevitably undergo aggregation due to high activity to an O/W emulsion composition while controlling the dispersion state (dispersion), methods of producing the same, and the like. An unconventional novel lubricant composition having a high industrial value can be provided by dispersing the ultrafine diamond particles in each phase of the base emulsion (A) while controlling the dispersion state.

A W/O/W emulsion that includes only a small amount of surfactant component relative to the total amount of components (i.e., base oil component, surfactant component, and water component) allows the processed surface to be wetted by oil released due to break of the emulsion, so that the lubrication properties and the secondary properties (e.g., rust preventive properties, cleaning properties, antioxidative properties, anti-foaming properties, metal ion chelating properties, antibacterial properties and the like) are improved. Therefore, an emulsion configuration that exhibits excellent plate-out properties is preferable.

The W/O/W emulsion may be typically used as a rolling oil. However, since W/O is dispersed in the water phase (W phase) with stirring at a low stirring speed in the preparation thereof, the resulting emulsion has a particle size of 2 to 20 μm, that is, an unstable emulsion having a coarse emulsification state may be formed. Therefore, it is very difficult to adjust the amount of emulsifier and maintain the particle size of the emulsion, and it may lack in practicality, i.e., spray application while forcedly stirring at every moment or the like. The inventors conducted studies on the emulsion configuration and the production method, and developed a lubricant composition that exhibits plate-out performance, and includes a solid lubricant that is stably dispersed in the water phase (W phase) of the O/W emulsion by post-adding a base oil, an oiliness improver, and a solid lubricant to the water phase (W phase) of the O/W emulsion including the ultrafine diamond particles.

The lubricant compositions, the methods of producing the same, and the solid lubricant particles according to the present invention are described in detail below by way of examples. Note that the present invention should be not limited to the following examples.

EXAMPLES

Example 1

O/(W+Ultrafine Diamond Particle) Emulsion Composition (Ultrafine Diamond Particles)

Ultrafine diamond particles obtained by the detonation technique were used. The primary particle size of the ultrafine diamond particles determined through X-ray analysis by the fourth moment method is 4 to 6 nm. The purity of the ultrafine diamond particles is 99 wt % or more.

(Ultrafine Diamond Particle Water Dispersion Raw Material and Properties Thereof)

A dry powder of the ultrafine diamond particles was dispersed in water by a wet dispersion method to prepare a ultrafine diamond particle water dispersion raw material having an average particle size of 40 nm and a solid concentration of 5 wt %. The zeta potential of the ultrafine diamond particles included in the ultrafine diamond particle water dispersion raw material was measured and found to be about −50 mV. It was thus confirmed that the ultrafine diamond particles achieved dispersion stability in water to a certain extent, and the zeta potential in the dispersion system basically did not depend on the average particle size (within the range from several to 100 nm). Therefore, the ultrafine diamond particle water dispersion raw material was used as a basic raw material for producing an O/W emulsion composition including ultrafine diamond particles in the base emulsion (A).

Table 1 shows the results that the frictional properties of the ultrafine diamond particle water dispersion raw material was evaluated while varying each solid concentration. Table 1 shows the dependence of the solid concentration effecting to the friction coefficient of the ultrafine diamond particle water dispersion including ultrafine diamond particles. In Table 1, "ND" refers to "ultrafine diamond particle".

TABLE 1

Friction coefficient of ultrafine diamond particle water dispersion

| ND content (wt %) | Friction coefficient (μ) |
|---|---|
| 0% | 0.412 |
| 0.1% | 0.355 |
| 1.0% | 0.311 |
| 5.0% | 0.352 |

The friction coefficient was measured using a Soda pendulum type friction tester. The friction coefficient was measured at a temperature of 20° C. and a load of 2.94 N (Hertzian contact pressure: 1090 N/mm$^2$)

The addition of the ultrafine diamond particles had almost no effects on the friction coefficient in comparison with the friction coefficient of water (0.412) even while changing the solid content. Note that a lubricating effect is normally obtained when the friction coefficient is equal to or less than half of the friction coefficient (0.45) in a dry state.

(Dispersant-treated Ultrafine Diamond Particle Water Dispersion and Properties Thereof)

Dispersant-treated ultrafine diamond particle water dispersions including 1.0 wt % of solid concentration of ultrafine diamond particles and 0.5 wt % of a dispersant were prepared by adding various dispersants. A dispersant-treated ultrafine diamond particle water dispersion using a fatty acid ester (nonionic dispersant) as a dispersant is referred to as "sample ND". Similarly, A dispersant-treated ultrafine diamond particle water dispersion using a polyoxyethylene alkyl ether carboxylate (anionic dispersant) as a dispersant is referred to as "sample AD", a dispersant-treated ultrafine diamond particle water dispersion using an alanine-based polyoxyethylene adduct (amphoteric dispersant) as a dispersant is referred to as "sample RD", a dispersant-treated ultrafine diamond particle water dispersion using a higher amine-lower fatty acid salt (cationic dispersant) as a dispersant is referred to as "sample CD", and a dispersant-treated ultrafine diamond particle water dispersion using a polyoxyethylene-polyoxypropylene copolymer (nonionic dispersant) as a dispersant is referred to as "sample BD".

The addition effects of the dispersant on the water dispersion stability and the frictional properties of the ultrafine diamond particles were determined. These properties are important for the emulsion composition in which the ultrafine diamond particles are dispersed in an water phase (W phase). Note that these properties are also important when producing an emulsion composition including ultrafine diamond particles in an oil phase (O phase) (described later).

Table 2 shows the dispersion state of the ultrafine diamond particles in the samples ND, AD, RD, CD, and BD. These dispersants were a certain dispersants group selected as test objects taking account of the interaction between the dispersants, the interaction with an emulsifier when preparing the water dispersion into an oil-in-water emulsion, and the like.

TABLE 2

| No. □ | Evaluation | Type | Separation rate (%) |
|---|---|---|---|
| AD | Good | Anionic | 10 |
| ND | Excellent | Nonionic | 0 |
| RD | Fair | Amphoteric | 40 |
| CD | Bad | Cationic | 90 |
| BD | Good | Nonionic | 20 |

Table 3 shows the evaluation results of the zeta potential and the dispersion stability of the dispersant-treated ultrafine diamond particle water dispersion. Table 3 also shows the zeta potential of an emulsion-type base emulsion (A) and the zeta potential of a microemulsion-type base emulsion (A) as comparison. Specifically, Table 3 shows the effects of the addition of the dispersants having different ion on the water dispersion stability of the ultrafine diamond particles (ultrafine diamond particle solid concentration: 1 wt %, dispersant concentration: 0.5 wt %).

TABLE 3

| Sample name | Dispersant | Dispersant | Zeta potential (mV) | Order of dispersion stability |
|---|---|---|---|---|
| AD | Anionic | Polyoxyethylene alkyl ether carboxylate | −37.2 | 3 |
| ND | Nonionic | Fatty acid ester | −47.2 | 1 |
| RD | Amphoteric | Alanine-based polyoxyethylene adduct | −49.3 | 4 |
| CD | Cationic | Higher amine-lower fatty acid salt | −24.0 | 5 |
| BD | Nonionic | Polyoxyethylene-polyoxypropylene copolymer | −22.5 | 2 |
| E | | Emulsion-type | −83.8* | — |
| ME | | Microemulsion-type | −68.9* | — |

*Emulsion(E) or microemulsion (ME) that did not include ultrafine diamond particles.

The zeta potential when treating the ultrafine diamond particles with the polyoxyethylene alkyl ether carboxylate (anionic dispersant) was −37.2 mV (sample AD), and the zeta potential when treating the ultrafine diamond particles with the fatty acid ester (nonionic dispersant) using ester type as a hydrophilic group raw material, and higher fatty acid as a hydrophobic group raw material was −47.2 mV (sample ND). The zeta potential when using the alanine-based polyoxyethylene adduct (amphoteric dispersant) was −49.3 mV (sample RD). The dispersion stability significantly decreased (−24.0 mV) when using the higher amine-lower fatty acid salt (cationic dispersant) (sample CD). The dispersion stability further decreased (−22.5 mV) when using the polyoxyethylene-polyoxypropylene copolymer (nonionic dispersant) (sample BD). It confirmed that the zeta potential hardly depends on the concentration of the added dispersant.

Table 4 shows the friction coefficient of the dispersant-treated ultrafine diamond particle water dispersion which the water dispersion stability of the ultrafine diamond particles was evaluated in Table 3 measured using a Soda pendulum type friction tester.

Specifically, Table 4 shows the evaluation results for the friction coefficient of the dispersant-treated ultrafine diamond particle water dispersion (solid concentration: 1 wt %) including 0.5 wt % of each dispersant (measured using a Soda pendulum type friction tester).

TABLE 4

Friction coefficient of dispersant-treated ultrafine diamond particle water dispersion

| Sample name | Friction coefficient (μ) |
|---|---|
| AD | 0.116 |
| ND | 0.284 |
| RD | 0.161 |
| CD | 0.333 |
| BD | 0.236 |
| E | 0.110* |
| ME | 0.118* |

*Emulsion(E) alone; Microemulsion (ME) alone

Among the friction coefficients of the five dispersant-treated ultrafine diamond particle water dispersions, the friction coefficient of the dispersion treated using the polyoxyethylene alkyl ether carboxylate (anionic dispersant) (sample AD) was 0.116 and the smallest, in the case of using the alanine-based polyoxyethylene adduct (amphoteric dispersant) (sample RD), the friction coefficient was 0.161, in the case of using the polyoxyethylene-polyoxypropylene copolymer (nonionic dispersant) (sample BD), it was 0.236, in the case of using the fatty acid ester (nonionic dispersant) (sample ND), it was 0.284, and in the case of using the higher amine-lower fatty acid salt (cationic dispersant) (sample CD), it was 0.333. Note that "ND" in Table 1 refers to "ultrafine diamond particle", and "nonionic dispersant-treated ultrafine diamond particle water dispersion" in Tables 2 to 4 refers to as "sample ND" separately. Though the results of the base emulsion (A) described in Tables 3 and 4 (to compare zeta potential and friction coefficient) are respectively given different symbols as symbols E (emulsion-type) and ME (microemulsion-type), these are limited to the basic properties of the base emulsion (A), and the symbols are used only in Tables 3 and 4 to a limited extent.

As shown in Table 2, inferior dispersion stability was obtained when treating with a cationic dispersant containing the higher amine-lower fatty acid salt. Note that the dispersion stability of the ultrafine diamond particles was improved using a quaternary amine salt cationic dispersant which the pH of the aqueous solution was adjusted to the alkali region (pH: 12) (as described later). However, the friction coefficient of the dispersant-treated ultrafine diamond particle water dispersion exhibited further higher value than that of the ultrafine diamond particle water dispersion that did not include the dispersant. Therefore, it was confirmed that it is impossible to simultaneously achieve a decrease in friction coefficient by adding a cationic dispersant and an increase in dispersion stability of the ultrafine diamond particles. The type of dispersant (WS) used for the dispersant-treated ultrafine diamond particle water dispersion is important factor to maintain (obtain) the water dispersion stability and the lubrication properties of the O/(W+ultrafine diamond particle) emulsion composition. Therefore, the anionic dispersant, the amphoteric dispersant, and the nonionic dispersant are suitable as a dispersant for the ultrafine diamond particles in the water phase (W phase) which was a component of the O/(W+ultrafine diamond particle) emulsion composition as compared with the cationic dispersants comprising a higher amine-lower fatty acid salt and other cationic dispersants.

It was thus confirmed that addition of the dispersant is very important and indispensable for improving the dispersion stability of the ultrafine diamond particles and upgrading lubrication properties due to a decrease in friction coefficient when producing the O/(W+ultrafine diamond particle) emulsion composition of Example 1.

Accordingly, as the water dispersion ultrafine diamond particle dispersant (WS) for the ultrafine diamond particles, it is suitable to use the dispersant selected from anionic dispersants such as a higher fatty acid, a polyoxyethylene alkyl (Cn) ether carboxylic acid, a dimer in which an alkyl (Cn) fatty acid is added to a hydroxyl group of a castor oil fatty acid, an α-olefin (Cn) sulfate, a higher fatty acid (Cn) methyl ester-α-sulfate, a petroleum (molecular weight: 400 to 1000) sulfonate or sulfate, a higher fatty acid sulfate, an alkali metal salt, an alkaline earth metal salt, a heavy metal salt, and a mono-, di-, or triethanolamine salt thereof, amphoteric dispersants such as a hydroxyalkyl-α (or β)-alanine, an alkali metal salt, a heavy metal salt, and a mono-, di-, or triethanolamine salt thereof, a compound in which 1 mol or more of ethylene oxide (EO)n is bonded to the alkyl group thereof, an alkylcarboxybetaine quaternary ammonium, sulfonium, or phosphonium salt, and lecithin, and nonionic dispersants such as a polyoxyethylene higher fatty acid (Cn) ester, a higher fatty acid (Cn) mono-, di-, or triethanolamide, a polyoxyethylene higher alcohol (Cn) ether, a polyoxyethylene higher amine (Cn) ether, a polyoxyethylene fatty acid (Cn) amide, a polyoxyethylene-polypropylene oxide block copolymer (pluronic), an alkyl (Cn) fatty acid pluronic ether or ester, and a polyoxyethylene higher fatty acid sucrose ester. Note that of course the water dispersion dispersant is not limited thereto insofar as the dispersant does not interfere with the emulsifier (EM) for the base emulsion (A) (described later) and hinder dispersion of the ultrafine diamond particles.

Table 5 shows an example of the measurement results for the composite effect due to the complicated interaction between the dispersants. The friction fatigue properties of the dispersant-treated ultrafine diamond particle water dispersion treated using a polyoxyethylene alkyl ether carboxylate (anionic dispersant) that provides inferior dispersion stability in terms of the zeta potential, but provides excellent frictional properties, were determined by a pendulum friction fatigue test in which the number of measurements (reciprocating friction count) was increased using a same pendulum type friction tester. The friction coefficient steadily increased approximately after the fifth measurement (reciprocating 5 friction count), and the frictional properties deteriorated.

The friction pin and the ball were investigated in detail after the test.

It was found that agglomerates occurred in the dispersant-treated ultrafine diamond particle water dispersion treated using the anionic dispersant, and adhered to the friction pin and the ball. In order to solve the problem of the friction fatigue test and further lower the friction coefficient, the addition effect of a plurality of dispersants was investigated taking account of the interaction between the dispersants selected as above. Table 5 shows a change in friction coefficient when adding a polyoxyethylene alkyl ether carboxylate (anionic dispersant; corresponding to the sample AD) and a fatty acid ester (nonionic dispersant; corresponding to the sample ND) as the addition effect of a plurality of dispersants on the friction coefficient.

The concentrations of the anionic dispersant and the nonionic dispersant were respectively 0.5 wt %. The ultrafine diamond particle solid concentration was 1 wt %, similarly. Table 5 shows the addition effect of a plurality of dispersants on the friction coefficient of the ultrafine diamond particle water dispersion.

TABLE 5

| Dispersant | Amount of dispersant (wt %) | Ultrafine diamond particle concentration (wt %) | Friction coefficient (μ) |
|---|---|---|---|
| Water (No dispersant) | 0 | 1 | 0.311 |
| Nonionic dispersant (fatty acid ester) | 0.5 | 1 | 0.284 |
| Nonionic dispersant (fatty acid ester) + anionic dispersant (polyoxyethylene alkyl ether carboxylate) | 0.5 | 1 | 0.126 |

When adding the nonionic dispersant and the anionic dispersant in combination, the friction coefficient further decreased as compared with the case of adding only the nonionic dispersant, result in obtaining friction coefficient of 0.126. The friction fatigue properties were determined by a same pendulum friction fatigue test. A deterioration in friction fatigue properties and occurrence of agglomeration which might be the cause of the deterioration were not observed, though such a deterioration and occurrence of agglomeration were observed when using only a polyoxyethylene alkyl ether carboxylate (anionic dispersant; corresponding to the sample AD).

It was thus confirmed that it is effective to add a plurality of dispersants in order to further decrease the friction coefficient and improve the friction fatigue properties of the ultrafine diamond particle water dispersion. After detail investigation of these effects, it was found that addition of at least one dispersant selected from the anionic dispersant, the amphoteric dispersant, and the nonionic dispersant is significantly effective for decreasing the friction coefficient and improving the friction fatigue properties of the ultrafine diamond particle water dispersion used as a component of an O/(W+ultrafine diamond particle) emulsion.

A method of producing an O/(W+ultrafine diamond particle) emulsion composition using the dispersant-treated ultrafine diamond particle water dispersion and the resulting frictional properties are described in detail below.

(Emulsifier for O/(W+Ultrafine Diamond Particle) Emulsion Composition)

When producing the emulsion composition of Example 1, the dispersant-treated ultrafine diamond particle water dispersion (DW: hereinafter, symbolized as a component of the water phase (W phase) of the emulsion composition, though this dispersion is diluted with water) is added to the water phase (W phase) of the base emulsion (A) in which oil droplets are emulsified and dispersed. Therefore, it is preferable to suitably select a combination of the water dispersion ultrafine diamond particle dispersant (WS) and the emulsifier (EM) for the base emulsion (A) so that the dispersion stability and the frictional properties are not adversely affected. In Example 1, the compatibility with the dispersant selected for dispersing the ultrafine diamond particles in water as intensively investigated on the premise that the emulsifier exhibits excellent biodegradability and is a non-endocrine disruptor. The most important factors when selecting the emulsifier include the dispersion stability of the ultrafine diamond particles, the stability of the oil droplets, and the frictional properties of the emulsion composition including the ultrafine diamond particles dispersed in the water phase (W phase).

Accordingly, the emulsifier (EM) suitably used to produce the O/(W+ultrafine diamond particle) emulsion is preferably one or more emulsifiers selected from anionic emulsifiers such as a higher fatty acid (Cn), polyoxyethylene (n=3 or more) alkyl (Cn) ether carboxylic acid, a dimer in which an alkyl (Cn) fatty acid is esterified to a hydroxyl group of a castor oil fatty acid, an α-olefin (Cn) sulfate, a higher fatty acid (Cn) methyl ester-α-sulfate, a petroleum (molecular weight: 400 to 1000) sulfonate or sulfate, a higher fatty acid sulfate, an alkali metal salt, an alkaline earth metal salt, a heavy metal salt, and a mono-, di-, or triethanolamine salt thereof, cationic emulsifiers such as an alkyl (Cn) quaternary ammonium salt, amphoteric emulsifiers such as a hydroxyalkyl-α (or β)-alanine, an alkali metal salt, a heavy metal salt, and a mono-, di-, or triethanolamine salt thereof, a compound in which 1 mol or more of ethylene oxide (EO)n is bonded to the alkyl group thereof, an alkylcarboxybetaine quaternary ammonium, sulfonium, or phosphonium salt, and lecithin, or the like, and nonionic emulsifiers such as a polyoxyethylene higher fatty acid (Cn) ester, a higher fatty acid (Cn) mono-, di-, or triethanolamide, a polyoxyethylene higher alcohol (Cn) ether, a polyoxyethylene higher amine (Cn), a polyoxyethylene fatty acid (Cn) amide, a polyoxyethylene-polypropylene oxide block copolymer (pluronic), an alkyl (Cn) fatty acid pluronic ether or ester, and a polyoxyethylene higher fatty acid sucrose ester, or the like. Note that the emulsifier is not limited thereto, although it is preferable that one or plurality of the emulsifier mentioned above is selected.

(Preparation of Lubricant Composition)

Examples of production of a lubricant composition which is O/(W+ultrafine diamond particle) emulsion composition comprising the emulsifier and the dispersant-treated ultrafine diamond particle water dispersion is described below in each types.

The lubricant composition is classified into an emulsion-type composition and a microemulsion-type composition depending on the particle size of the emulsified product. Further, there is a paste-type (grease-type) lubricant composition that is prepared by adjusting the viscosity of the emulsion-type composition or the microemulsion-type composition. A method of producing each composition is individually described below. As describe above the symbol "A" that is used for the base emulsion may be similarly used also for the above classified composition as in the following description. The emulsion-type composition is referred to as "A", the microemulsion-type composition is referred to as "B", and the paste-type (grease-type) composition is referred to as "C" (corresponding to the schematic view of configuration in FIG. 4). A state in which the dispersant-treated ultrafine diamond particles are dispersed in the water phase (W phase) is indicated by "DW", and a state in which the dispersant-treated ultrafine diamond particles are dispersed in the oil phase (O phase) is indicated by "DO". Notes for these symbols will be appropriately added in the specification.

In an O/(W+ultrafine diamond particle) emulsion composition (A-DW), an (O+ultrafine diamond particle)/(W+ultrafine diamond particle) emulsion composition, a composite dispersion composition, a multiple-composite dispersion composition, an anhydrous lubricant composition, a base oil (solid)/composite dispersion composition, a base oil (oil)/composite oil dispersion composition, or the like, as is obvious, in order to improve the dispersion stability and decrease the friction coefficient, the water dispersion dispersant is excluded from the solid concentration of the ultrafine diamond particles added to (dispersed in) the water phase (W phase) and a solid lubricant other than the ultrafine diamond particles. In the case of the addition as hydrophilic solid lubricant particles (water dispersion ultrafine diamond particle solid lubricant) described later, the water dispersion dispersant is also excluded from the solid concentration of the ultrafine diamond particles and a solid lubricant other than the ultrafine diamond particles and are regarded as other component, such as water, base oil or the like.

Emulsion-type Composition 6 wt % of oleic acid-based oil (rapeseed oil) and 3 wt % of methyl oleate were mixed. After the addition of 2 wt % of polyoxyethylene (n=6 mol) oleate and 4 wt % of potassium oleate (emulsifiers) as emulsifiers, the mixture was stirred to prepare an emulsion base oil component. When the ratio of oil phase to water phase (O phase:W phase) became 7:3 by adding 6 wt % of water thereto, that is, when the viscosity indicated the maximum value, the mixture was sufficiently kneaded to complete phase inversion emulsification from W/O to O/W to prepare a base emulsion (A). A kneader was used to produce the composition. 15 wt % of a dispersant-treated ultrafine diamond particle water dispersion which was obtained by treating the ultrafine diamond particle water dispersion by adding 1 wt % of a polyoxyethylene alkyl ether carboxylate (anionic dispersant) and 1 wt % of a fatty acid ester (nonionic dispersant) in combination so as to become a solid concentration of 2 wt %, was added thereto, and the mixture was stirred. Finally 64 wt % of remaining adjust water was then added to the mixture. The effective base oil component concentration was 15 wt %, and the ultrafine diamond particle content (solid concentration) was 0.3 wt %. A dimethylpolysiloxane emulsion was finally added to the mixture as an anti-foaming agent.

(Solid Lubricant Particles (Solid Lubricant Particles of Water Dispersion Ultrafine Diamond Particles))

For example, solid lubricant particles of ultrafine diamond particles having a hydrophilic surface obtained by removing water from the dispersant-treated ultrafine diamond particle water dispersion produced by the above method, solid lubricant particles including ultrafine diamond particles which comprised at least one water dispersion dispersant selected from the anionic dispersant, the amphoteric dispersant, and the nonionic dispersant as cores, or particularly solid lubricant particles including the anionic dispersant and the nonionic dispersant in combination, are useful as solid lubricant particles of water dispersant ultrafine diamond particles due to excellent dispersibility in water, various water-soluble solvents, and the like including repeatability. Solid lubricant particles comprising the anionic dispersant and the nonionic dispersant in combination are optimum for the usage environment as exemplified in the Example when it is necessary to decrease the friction coefficient by dispersing the particles in an aqueous medium (solvent). These solid lubricant particles has advantages that the particles can also prevent a decrease in storage volume and a change with time during storage (e.g., occurrence of agglomeration or aggregation due to deterioration of the surface of the dispersed particles in medium (including agglomeration due to Brownian motion) and so on). In the following example, the solid lubricant particles were applied to production of an O/W emulsion composition including the ultrafine diamond particles according to the present invention, and the frictional properties were measured.

(Example of Solid Lubricant Particles)

0.15 wt % (solid concentration with respect to whole components) of solid lubricant particles having the water dispersion dispersant on the surface thereof were added to the water phase (W phase) of the base emulsion (A). The mixture was stirred to prepare a composition similar to the (A-DW) composition of Example 1 having an effective base oil component concentration of 15 wt %. The friction coefficient measured using a pendulum type friction tester was 0.110, this was also an excellent value. Specifically, the solid lubricant particles having the water dispersion dispersant on the surface thereof exhibited excellent dispersibility in water equal to the dispersant-treated ultrafine diamond particle water dispersion used in Example 1, might be re-dispersed in water with ease. Therefore, the solid lubricant particles are very useful as a safety unconventional solid lubricant. According to this example, there were provided a water dispersion ultrafine diamond particle solid lubricant exhibiting both unconventional excellent water dispersion stability and safety.

Microemulsion-type Composition 2 wt % of purified n-paraffin (viscosity: 10 cSt) and 4 wt % of methyl oleate were mixed. After the addition of 2 wt % of polyoxyethylene (n=6 mol) oleate, 3 wt % of polyoxyethylene (n=9 mol) oleyl alcohol ether, and 4 wt % of potassium oleate as emulsifiers thereto, the mixture was stirred to prepare a microemulsion base oil component. 15 wt % of the dispersant-treated ultrafine diamond particle water dispersion was added in a same manner as in the case of the emulsion-type composition described above, and then 70 wt % of adjusting water was added to effect self-emulsification, thereby obtaining an effective base oil component concentration of 15 wt %. The average particle size and the solid concentration of the ultrafine diamond particles, and the types and the amounts of polyoxyethylene alkyl ether carboxylate (anionic dispersant) and fatty acid ester (nonionic dispersant) were the same as in the case of the emulsion-type composition. Finally a dimethylpolysiloxane emulsion was added as an anti-foaming agent. A agitator was used to produce the composition.

Paste-type (Grease-type) Composition

A paste-type (grease-type) (paste-emulsion-type) composition having various viscosity characteristics may be produced by appropriately adjusting the ratio of the oil phase (O phase) to the water phase (W phase) of the O/W emulsion-type composition or microemulsion-type composition described above (the emulsion-type composition and the microemulsion-type composition may be collectively referred here to as "emulsion-type composition"). An example of a method of producing a microemulsion-type paste-type composition is described below.

8 wt % of purified n-paraffin (viscosity: 10 cSt) and 12 wt % of methyl oleate were mixed. 8 wt % of polyoxyethylene (n=6 mol) oleate, 10 wt % of polyoxyethylene (n=9 mol) oleyl alcohol ether, and 12 wt % of potassium oleate (emulsifiers) were added thereto and mixed, and the mixture was stirred to prepare an emulsion base oil component. 50 wt % of the dispersant-treated ultrafine diamond particle water dispersion which was a same composition as in the case of the emulsion-type composition described above was then added to the emulsion base oil component. The average particle size and the solid concentration of the ultrafine diamond particles included in the dispersant-treated ultrafine diamond particle water dispersion, and the types and the amounts of polyoxyethylene alkyl ether carboxylate (anionic dispersant) and fatty acid ester (nonionic dispersant) were the same as in the case of the emulsion-type composition described above. Finally a dimethylpolysiloxane emulsion was added to the mixture as an anti-foaming agent. A kneader was used to produce the composition since the composition had high viscosity (consistency: about 230). The effective base oil component concentration was 50 wt %, and the ultrafine diamond particle content (solid concentration) was 1.0 wt %.

(Properties of Lubricant Composition)

The frictional properties of the emulsion-type diamond lubricant composition obtained by the above production method are described below.

The friction coefficient was measured using a Soda pendulum type friction tester. A friction phenomenon in the boundary lubrication region when friction starts to occur between two sliding surfaces can be determined by this method. The friction coefficient is normally evaluated by the average value of three measured values. When plotting ten measured values (reciprocating 10 friction count) continuously without changing the test piece, it was confirmed that the friction coefficient steadily increased, or reached equilibrium, or decreased. Therefore, it was found that the friction coefficient has a correlation with the durability of the lubricating effect. This test method was referred to as "pendulum friction fatigue test method" and it was adopted as a evaluation method of a frictional property long-lasting effect (friction fatigue property).

Known friction coefficient evaluation methods that have been disclosed in prior arts were not unified, and more practical measurement methods such as ball-on-disk type were largely disclosed. Since only a low load can be normally applied by these methods, it is difficult to evaluate the ultimate lubrication capability of the lubricant, that is, to evaluate frictional properties under high load (high Hertzian contact pressure) (boundary lubrication region). A Soda pendulum type friction tester used in the present invention allows the test to be performed under high load, therefore, the friction coefficient was measured in same conditions of a temperature of 20° C. and a load of 2.94 N (Hertzian contact pressure: 1090 $N/mm^2$) as described above.

Table 6 shows the results of measuring the friction coefficient of the O/(W+ultrafine diamond particle) emulsion composition. The effective base oil component concentration was set to 15 wt % (constant). Specifically, Table 6 shows the friction coefficient of the O/(W+ultrafine diamond particle) emulsion composition. Regarding the sample name and the like in the drawings and the tables, D means "ultrafine diamond particle", A means "emulsion-type", the first two digits means "effective base oil component concentration (wt %)", and the remaining number means "ultrafine diamond particle content (solid concentration) (wt %) in the lubricant composition". Specifically, "A-DW-1503" means an emulsion-type lubricant composition, and also O/(W+ultrafine diamond particle) emulsion composition, the effective base oil component concentration of 15 wt % and the ultrafine diamond particle concentration (solid concentration) of 0.3 wt %. "A-DW-15005" means the same type of composition having the ultrafine diamond particle content of 0.05 wt %.

TABLE 6

| Sample name A-DW | Effective base oil component concentration (wt %) | Ultrafine diamond particle concentration (wt %) | Friction coefficient (μ) |
|---|---|---|---|
| -1503 | 15 | 0.3 | 0.102 |
| -15005 | | 0.05 | 0.100 |

The O/(W+ultrafine diamond particle) emulsion produced by substituting the continuous phase (water) of the base emulsion (A) with the dispersant-treated ultrafine diamond particle water dispersion exhibited a friction coefficient of 0.100 that was smaller than that of dispersant-treated ultrafine diamond particle water dispersion. It was also found that the amount of ultrafine diamond particles can be reduced by one digit. An O/(W+ultrafine diamond particle) emulsion composition was also produced using an α-olefin oligomer of synthetic oil as the base oil instead of the oleic acid-based oil (rapeseed oil). This composition had a small friction coefficient similar to that of the oleic acid-based oil.

The frictional properties of the microemulsion-type lubricant composition and the paste-type lubricant composition obtained by the above production method are described below.

The friction coefficients of the diamond containing lubricant compositions comprising the microemulsion-type and paste-type O/(W+ultrafine diamond particle) emulsion (B-DW or C-DW) were evaluated in the same manner as described above. The friction coefficient of the paste-type (C-DW) lubricant composition was smaller than that of a composition obtained by adding the ultrafine diamond particles to a conventional mineral oil-based grease. The effective base oil component concentration of the paste-type lubricant composition was adjusted to 40 wt % by further adding water (ratio of O phase:W phase changed from about 5:5 to 4:6). The ultrafine diamond particle solid concentration was 0.8 wt %. The above adjustment was performed to ensure the flowability necessary for a Soda pendulum type friction tester. A mineral oil grease (Li grease) prepared by the following method was used as a comparison sample. Specifically, 8 wt % of a ultrafine diamond particle oil dispersion (base oil P-2: ultrafine diamond particle solid concentration: 10 wt %) described below was mixed with 42 wt % of a conventional straight oil (machine oil #68), the mixture was mixed with a mineral oil grease (Li grease) to prepare a flowable grease. The emulsion composition and the flowable grease both had a viscosity of 120 cSt (40° C.). The friction coefficient of the paste-type O/(W+ultrafine diamond particle) emulsion composition (C-DW) according to the present invention was 0.116, and the composition (C-DW) thus exhibited better lubrication properties than the flowable grease of a comparison sample having a friction coefficient of 0.143, and prepared using the conventional mineral oil to which the ultrafine diamond particles were added.

Although high-purity ultrafine diamond particles having a purity of 99 wt % or more were used for the test production and evaluation of the diamond lubricant composition, it is possible to use ultrafine diamond particles having a purity of 90 wt % or less and containing a larger amount of residual carbonaceous substance, or also to use the ultrafine diamond particles in which carbonaceous substances were dispersed and coexisted. Excellent lubrication properties were obtained depending on the friction test environment.

A carbonaceous substance (including a graphite) that remains during production and purification of the ultrafine diamond particles, or a broadly classified carbonaceous substance that is dispersed and coexisted together with the ultrafine diamond particles, advantageously exhibits an excellent preservative effect in the water phase of the O/(W+ultrafine diamond particle) emulsion composition even without addition of a preservative, in addition to the excellent lubrication properties. In order to confirm the excellent preservative effect, the above O/(W+ultrafine diamond particle) emulsion composition of Example 1 which was stored in a sealed container at 20° C. for two years was determined the presence or absence of bacteria using an agar medium ("Bio Checker" manufactured by San-Ai Oil Co., Ltd.). Since coloration due to bacteria was not observed, it was confirmed that decay does not occur for a long time.

Example 2

(O+Ultrafine Diamond Particle)/W Emulsion Composition (Dispersant-treated Ultrafine Diamond Particle Water Dispersion)

A lubricant composition of Example 2 according to the present invention was produced using the dispersant-treated ultrafine diamond particle water dispersion described in Example 1 as a staring material.

This is preferable for the following reasons.

1. Since ultrafine diamond particles produced by the detonation technique or a static ultrahigh-pressure method are normally subjected to a wet acid treatment for increasing the purity, the ultrafine diamond particles have a hydrophilic surface.

2. The surface of ultrafine diamond particles having a hydrophilic surface can be modified into a uniform hydrophobic surface by subjecting the ultrafine diamond particles to dispersant treatment for a stable hydrophilization.

(Preparation of Ultrafine Diamond Particle Oil Dispersion)

When producing an emulsion composition in which the ultrafine diamond particles are dispersed in the oil phase (O phase), it is necessary to prepare a stable ultrafine diamond particle oil dispersion. Therefore, water is removed from the dispersant-treated ultrafine diamond particle water dispersion to prepare a composition similar to the water dispersion ultrafine diamond particle solid lubricant having a hydrophilic surface described above. In this example, water was removed by heating the dispersant-treated ultrafine diamond particle water dispersion to 100° C. It is preferable to heat the dispersant-treated ultrafine diamond particle water dispersion to a temperature at which the functions of the dispersant are not impaired. Water may be removed by a method other than heating such as vacuum distillation, freeze drying, or the like.

When using ultrafine diamond particles obtained by a vapor phase synthesis method and having an almost hydrophobic surface instead of ultrafine diamond particles obtained by the detonation technique or a static ultrahigh-pressure method, the water dispersion dispersant is added when dispersing the ultrafine diamond particles in water, and then water was removed to prepare a hydrophilic water dispersion ultrafine diamond particle solid lubricant, or an oil dispersion may also be prepared using the following oil dispersion ultrafine diamond particle dispersant (OS) directly.

(Ultrafine Diamond Particle Oil Dispersion)

An oil dispersion is prepared using the hydrophilic water dispersion ultrafine diamond particle solid lubricant in order to add the water dispersion ultrafine diamond particle solid lubricant to the oil phase (O phase). Specifically, the water dispersion ultrafine diamond particle solid lubricant is dispersed in the base oil component in which the oil dispersion ultrafine diamond particle dispersant (OS) is dissolved to prepare a ultrafine diamond particle oil dispersion. In this example, the oil dispersion (base oil P-2 described later) previously dispersed in the base oil is prepared in order to easily disperse the ultrafine diamond particles in the oil phase (O phase) of the emulsion composition.

The oil dispersion ultrafine diamond particle dispersant (OS), which is the oil dispersion dispersant for the ultrafine diamond particles, has a rule to make the surface of the ultrafine diamond particle to be hydrophobic, and stably disperse the ultrafine diamond particles in the oil phase (O phase). The oil dispersion ultrafine diamond particle dispersant (OS) is preferably a dispersant that has a hydrophilic/hydrophobic balance (HLB) smaller than that of a water-soluble dispersant to such an extent that the interfacial activity is not lost, and has weak interfacial activity. If a dispersant has, for example, an HLB value of 8 or less, the ultrafine diamond particles have a hydrophobic surface, and are stably dispersed in the oil phase (O phase). Therefore, such a dispersant is suitably used as the oil dispersion ultrafine diamond particle dispersant (OS).

Examples of the oil dispersion ultrafine diamond particle dispersant (OS) include a polar dispersant such as a polyoxyethylene alkyl (Cn) ether carboxylic acid, a higher (alkyl chain R=8 to 24) fatty acid, a castor oil fatty acid, a fatty acid sulfonate or sulfate, a petroleum (molecular weight: 400 to 1000) sulfonate and an alkaline earth metal salt (excluding a calcium salt) or a heavy metal salt thereof, a hydroxyalkyl (C12 to C18)-α (or β)-alanine, an alkylcarboxybetaine quaternary ammonium, sulfonium, phosphonium salt, alkaline earth metal, or heavy metal salt, an alkylolated sulfate of a higher fatty acid amide, an alkali metal salt and a mono-, di-, or triethanolamine salt thereof, and a salt of a higher (Cn) amine and a higher (Cn) fatty acid, a nonpolar surfactant such as a calcium salt of a polyoxyethylene (n=3 or more) alkyl (Cn) ether carboxylic acid, a calcium salt of a higher (Cn) fatty acid, a calcium salt of a fatty acid sulfonate or sulfate, a calcium salt of a petroleum (molecular weight: 400 to 1000) sulfonate, an alkaline earth metal salt (excluding a calcium salt) or a heavy metal salt thereof, a higher (Cn) fatty acid amide, a calcium salt of a hydroxyalkyl (C12 to C18)-α (or β)-alanine, an alkylcarboxybetaine alkaline earth metal or heavy metal salt, lecithin, a higher (Cn) fatty acid-higher (Cn) alcohol amide, a higher (Cn) fatty acid-higher (Cn) alcohol ester, a sorbitan-fatty acid (Cn) ester, a pentaerythritol-fatty acid (Cn) ester, a partial ester, a full ester, and an ether of a higher (Cn) fatty acid, and surfactants that have a hydrophilic/hydrophobic balance (HLB) smaller than that of a water-soluble surfactant to such an extent that the interfacial activity is not lost among P-1: hydrocarbon oil, V: animal or vegetable fats and oils, S: synthetic oil, and WS. The oil dispersion ultrafine diamond particle dispersant (OS) is not limited thereto insofar as the oil dispersion ultrafine diamond particle dispersant (OS) is compatible with the emulsifier (EM) for the base emulsion (A), and the other oil dispersion ultrafine diamond particle dispersant (OS) does not hinder dispersion of the ultrafine diamond particles. The oil dispersion ultrafine diamond particle dispersant (OS) is appropriately selected from the oil-soluble dispersants so that the frictional properties are not impaired, in the same manner as in the case of the water dispersion ultrafine diamond particle dispersant. The oil dispersion ultrafine diamond particle dispersant (OS) is indispensable for the (O+ultrafine diamond particle)/W emulsion composition.

A specific example of production of the ultrafine diamond particle oil dispersion is described below.

(Ultrafine Diamond Particle Oil Dispersion: Production of Base Oil P-2)

When producing the (O+ultrafine diamond particle)/W emulsion composition, an oil dispersion ultrafine diamond particle solid lubricant described later may be directly added to the oil phase (O phase) (base oil). However, since the amount of oil dispersion ultrafine diamond particle solid lubricant addition is small, it is preferable to produce a dispersant-treated ultrafine diamond particle oil dispersion by previously dispersing a predetermined amount of ultrafine diamond particles in the base oil, and blend the dispersant-treated ultrafine diamond particle oil dispersion as part of the base oil component.

The ultrafine diamond particles added and dispersed in the oil (used for the DO configuration) are basically obtained by hydrophobizing the surface of the water dispersion ultrafine diamond particle solid lubricant using the oil dispersion ultrafine diamond particle dispersant (OS). A predetermined amount of the water dispersion ultrafine diamond particle solid lubricant is added to and dispersed in the base oil component (P-1) or the like that affects the viscosity and the lubrication properties of the desired composition together with the oil dispersion ultrafine diamond particle dispersant (OS) to prepare a base oil P-2 that includes the oil dispersion ultrafine diamond particles. The water dispersion ultrafine diamond particle dispersant (WS) is added to the water dispersion ultrafine diamond particle solid lubricant at the same time. The dispersant (WS) is regarded as part of the base oil component, i.e., the dispersant (WS) is included in n-paraffin. This also applies to the following description unless otherwise indicated, the dispersant (WS) is not clearly expressed as a blending component. In this example, the water dispersion ultrafine diamond particle dispersant (WS) is used in a weight ratio of 0.6 with respect to the ultrafine diamond particles. (When adding the ultrafine diamond particles to the base oil (P-1) or the like at a solid content of 10 wt %, it means that the WS dispersant is accordingly added in an amount of 6 wt % as described later.)

The water dispersion ultrafine diamond particle dispersant (WS) was a composite dispersant including 50 wt % of a polyoxyethylene alkyl ether carboxylate (anionic dispersant) and 50 wt % of a fatty acid ester (nonionic dispersant).

In this example, a water dispersion ultrafine diamond particle solid lubricant treated with this composite dispersant was used.

6 wt % of an alkylolated sulfate salt of a higher fatty acid amide as the oil dispersion ultrafine diamond particle dispersant (OS) was diluted with 20 wt % of an n-paraffin, and sufficiently dissolved. After adding the water dispersion ultrafine diamond particle solid lubricant at an ultrafine diamond particle solid content of 10 wt %, the mixture was diluted with 64 wt % of an n-paraffin to prepare a ultrafine diamond particle oil dispersion having a solid concentration of 10 wt %. The resulting ultrafine diamond particle oil dispersion was supplied in the following examples as the base oil P-2.

Note that the combination of the dispersants when producing the ultrafine diamond particle oil dispersion in this example is merely an example. It is obvious that the combination of the dispersants is not limited to that of this example insofar as the dispersants do not interfere with the emulsifier in the combination that the ultrafine diamond particles can be dispersed in the base oil.

(Solid Lubricant Particles (Solid Lubricant Particles of Oil Dispersion Ultrafine Diamond Particles))

The solid lubricant particles of the oil dispersion ultrafine diamond particles that include the ultrafine diamond particle as a core, and include the oil dispersion dispersant on the surface thereof may be produced as follows. For example, 6 wt % of an alkylolated sulfate salt of a higher fatty acid amide instead of 84 wt % of an n-paraffin described above is diluted and dissolved in n-hexane. After the addition of the water dispersion ultrafine diamond particle solid lubricant (so as to have 10 wt % of solid concentration) from which water has been removed, the mixture is subjected to ultrasonic oil (hydrophobic) dispersion sufficiently, and n-hexane is then evaporated. It is further preferable to check the dispersion state of the dispersion that is subjected to dispersion treatment in n-hexane using a particle size distribution measurement apparatus. The resulting solid lubricant particles that include the ultrafine diamond particle obtained by the present method as a core, and include the oil dispersion dispersant on the surface thereof, can be re-dispersed in various kind of oil or hydrophobic solvent, and the like with high repeatability, and are useful as the solid lubricant particles of the oil dispersion ultrafine diamond particles. Moreover, these solid lubricant particles can advantageously decrease in storage volume and minimize a change of the dispersion with time during storage (e.g., an increase in particle size due to Brownian agglomeration and the like) similar to the solid lubricant particles of the water dispersion ultrafine diamond particles. It is obvious that this example is merely one of embodiment and the oil dispersion dispersant (OS) is not limited to this example. In the following example, the solid lubricant particles were applied to production of an O/W emulsion composition including the ultrafine diamond particles according to the present invention, and the frictional properties were confirmed.

(Frictional Properties of Solid Lubricant Particles (Solid Lubricant Particles of Oil Dispersion Ultrafine Diamond Particles))

The solid lubricant particles having the oil dispersion dispersant on the surface thereof were added to the oil phase (O phase) (base oil) of the base emulsion (A) at the solid concentration of 0.3 wt % with respect to whole components to prepare a composition similar to the (A-DO) composition having an effective base oil component concentration of 15 wt %. The frictional properties of the composition were determined using a pendulum type friction tester. The friction coefficient was 0.103 (very excellent value). Since the solid lubricant particles having the oil dispersion dispersant (OS) on the surface thereof exhibit a dispersion behavior similar to that of the base oil (P-2) including the oil dispersant-treated ultrafine diamond particles used in Example 2, and are easily re-dispersed in a nonpolar solvent or oil, the solid lubricant particles are thus demonstrated to be useful, in particular, be significantly useful as a safe unconventional oil-soluble solid lubricant. According to this example, an oil dispersion ultrafine diamond particle solid lubricant exhibiting both unconventional oil dispersion stability and safety can be provided.

(Production of Lubricant Composition)

An example of production of a lubricant composition which is ((O+ultrafine diamond particle)/W emulsion composition) using the above emulsifier and the ultrafine diamond particle oil dispersion is described below according to the type.

Emulsion-type Composition

As described in detail on the emulsifier forming the O/(W+ultrafine diamond particle) emulsion relating to the emulsifier used in this example, the most important criteria for selecting the emulsifier include the dispersion stability of the oil droplets and the frictional properties of the emulsion composition including the ultrafine diamond particles treated with the above oil dispersant in the oil phase (O phase) in the same manner as in the O/(W+ultrafine diamond particle) emulsion. After intensively conducting studies according to the criteria, it was found that the emulsifier can be selected from the same group as the emulsifier for forming the O/(W+ultrafine diamond particle) emulsion. A specific production example is described below. Note that the ultrafine diamond particles included in the base oil as the ultrafine diamond particle oil dispersion may be referred to as "oil dispersant-treated ultrafine diamond particles", when wanting to distinguish specifically below.

The ultrafine diamond particle oil dispersion (base oil P-2) described above was mixed with another base oil in the same manner as in the case of producing the O/W base emulsion (A). Specifically, 4 wt % of oleic acid-based oil (rapeseed oil), 4 wt % of methyl oleate, 3 wt % of the above ultrafine diamond particle oil dispersion (base oil P-2; ultrafine diamond particle solid concentration: 10 wt %), 2 wt % of an alkyl fatty acid potassium salt (emulsifier) and 2 wt % of polyoxyethylene (n=9 mol) oleate (emulsifier) as the emulsifiers were mixed and stirred to prepare an emulsion base oil component in which the ultrafine diamond particles were dispersed. Phase inversion emulsification from a W/O composition into a O/W composition occurred by adding 6 wt % of adjusting water (i.e., when the viscosity became a maximum (the ratio of the oil phase (O phase) to the water phase (W phase) was 7:3)). A kneader was used to produce the lubricant composition. 79 wt % of adjusting water was then added to the mixture to obtain an emulsion composition in which the ultrafine diamond particles were dispersed and included in the emulsion base oil component. The effective base oil component concentration was set to 15 wt %. A dimethylpolysiloxane emulsion was finally added to the mixture as an anti-foaming agent. The solid concentration of the ultrafine diamond particle was 0.3 wt %.

Microemulsion-type (Solubilisation) Composition

A microemulsion-type composition described in Example 1 was also produced as follows. Specifically, 2 wt % of an n-paraffin and 2 wt % of methyl oleate as base oil, and 2 wt % of polyoxyethylene (n=6 mol) oleate, 3 wt % of polyoxyethylene (n=9 mol) oleyl alcohol ether and 3 wt % of potassium oleate as emulsifier were mixed and stirred. 3 wt % of the ultrafine diamond particle oil dispersion (base oil P-2; ultrafine diamond particle solid concentration: 10 wt %) was added to the mixture to prepare a microemulsion base oil component. 85 wt % of adjusting water was added to the microemulsion base oil component to effect self-emulsification. The effective base oil component concentration of the lubricant composition in which the ultrafine diamond particles are dispersed and included in the microemulsion base oil component was 15 wt %, and the solid concentration of the ultrafine diamond particle was 0.3 wt %. A dimethylpolysiloxane emulsion was finally added to the mixture as an anti-foaming agent. A agitator was used to produce the composition.

(Properties of Lubricant Composition)

The frictional properties of the emulsion-type diamond lubricant composition and the microemulsion-type diamond lubricant composition obtained by the production method according to the present invention are described below.

In order to determine the effects of the additive concentration of the ultrafine diamond particles (solid concentration range of the ultrafine diamond particles with respect to the total amount of the lubricant composition: 0.05 to 0.5 wt %), and the ratio of the emulsion base oil component or the microemulsion base oil component including the ultrafine diamond particles, the emulsifier, and the like (effective base oil component concentration) with respect to the whole components including water on the friction coefficient, each evaluation sample was prepared by changing the mixing ratio of the components. When dispersing the ultrafine diamond particles in the oil phase (O phase) (e.g., above base oil P-2), the ultrafine diamond particles are included within the effective base oil component concentration.

The frictional properties of the emulsion-type (O+ultrafine diamond particle)/W emulsion composition and the microemulsion-type (O+ultrafine diamond particle)/W emulsion composition produced in this example are described below.

Table 7 shows the results that were measured the friction coefficient of the emulsion-type composition depending on the change in the ultrafine diamond particle concentration (solid concentration) and the effective base oil component concentration thereof. Table 8 shows the results related to the microemulsion-type composition similarly to the case of the above emulsion-type composition. Although the effects of the emulsion/microemulsion effective base oil component concentration and the ultrafine diamond particle concentration on the friction coefficient are not necessarily clear, the smallest friction coefficient of 0.091 or 0.105 was characteristically obtained when adding a extremely small amount of ultrafine diamond particles. As a result of comparison between the friction coefficient of the emulsion-type composition and the friction coefficient of the microemulsion-type composition, it was found that the frictional properties of the emulsion-type composition are superior to the frictional properties of the microemulsion-type composition. Specifically, Table 7 shows the effects of the effective base oil component concentration and the ultrafine diamond particle solid concentration on the friction coefficient of the emulsion-type of the (O+ultrafine diamond particle)/W emulsion composition. Note that "DO" means that the composition has an (O+ultrafine diamond particle) phase. The ultrafine diamond particles were not added to the sample of which sample name has "00" on the end.

TABLE 7

| Sample name A-DO | Effective base oil component concentration (wt %) | Ultrafine diamond particle concentration (wt %) | Friction coefficient (μ) |
|---|---|---|---|
| -2505 | 25 | 0.5 | 0.091 |
| -1503 | 15 | 0.3 | 0.095 |
| -1501 | 15 | 0.1 | 0.093 |
| -15005 | 15 | 0.05 | 0.092 |
| -1500 | 15 | 0 | 0.100 |
| -0501 | 5 | 0.1 | 0.095 |

Table 8 shows the effects of the effective base oil component concentration and the ultrafine diamond particle solid concentration on the friction coefficient of the microemulsion-type (O+ultrafine diamond particle)/W emulsion composition. Note that "B" refers to "microemulsion-type composition".

TABLE 8

| Sample name B-DO | Effective base oil component concentration (wt %) | Ultrafine diamond particle concentration (wt %) | Friction coefficient (μ) |
|---|---|---|---|
| -2505 | 25 | 0.5 | 0.112 |
| -1503 | 15 | 0.3 | 0.111 |
| -1501 | 15 | 0.1 | 0.108 |
| -15005 | 15 | 0.05 | 0.105 |
| -1500 | 15 | 0 | 0.115 |
| -0501 | 5 | 0.1 | 0.105 |

Note that the friction coefficient (μ) shown in Tables 1, 4, 5, 6, 7, 8, and 9 is the average value of three values obtained by a standard measurement method, and is not a friction coefficient (μ) obtained by a pendulum friction fatigue test described later.

As described above, if using the Soda pendulum type friction tester, the durability of the lubricating effect can be evaluated by continuously measuring (reciprocating friction) the lubricating effect without changing the test piece. The (O+ultrafine diamond particle)/W emulsion composition produced as described above was subjected to the pendulum friction fatigue test. The results are shown in FIGS. 1 and 2.

Figure 2:
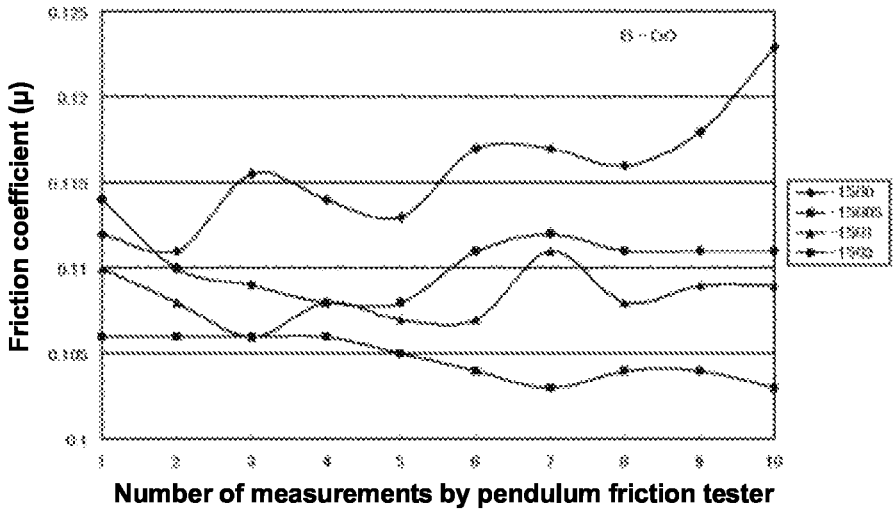
FIG. 2 is a view showing the friction fatigue properties of a microemulsion-type lubricant composition of Example 2 in the present invention.

FIG. 1 is a view showing the friction fatigue properties of the emulsion-type lubricant composition of Example 2 according to the present invention. FIG. 2 is a view showing the friction fatigue properties of the microemulsion-type lubricant composition of Example 2 according to the present invention.

The ultrafine diamond particle concentration was 0.05 to 0.3 wt %, and the effective base oil component concentration including the emulsifier was 15 wt %. The friction coefficient of both the emulsion-type lubricant composition and the microemulsion-type lubricant composition increased along with an increase in the repeating (reciprocating) number of measurements when the ultrafine diamond particles were not added. On the other hand, the friction coefficient of the ultrafine diamond particle-containing emulsion composition asymptotically decreased along with an increase in the repeating (reciprocating) number of measurements. The friction coefficient was as small as 0.09 (emulsion-type) (i.e., excellent friction fatigue properties were obtained) even when the ultrafine diamond particle concentration was 0.1 wt % or less.

The excellent friction fatigue properties can be achieved by adding only a very small amount of ultrafine diamond particles. This is the greatest feature that the diamond lubricant composition with the above configuration is particularly useful in industrial applications. It was found that such excellent friction fatigue properties are excellent characteristics which cannot be achieved by lubricants having various known configurations disclosed as prior arts (described later in detail).

Example 3

(O+Ultrafine Diamond Particle)/(W+Ultrafine Diamond Particle) Emulsion Composition (Production of Lubricant Composition)

An example of production of an (O+ultrafine diamond particle)/(W+ultrafine diamond particle) emulsion composition obtained by mixing both the ultrafine diamond particle water dispersion treated by dispersing using the water dispersion dispersant (WS)(the nonionic dispersant and the anionic dispersant in combination) and the emulsion composition (emulsion-type) produced in Example 2 is described below.

Emulsion-type (Milky Colloid) Composition

As previously classified, the (O+ultrafine diamond particle)/(W+ultrafine diamond particle) emulsion composition is classified into an emulsion-type composition and a microemulsion-type composition depending on the particle size of oil droplets. The emulsion composition may be classified as a paste-type (grease-type) composition depending on the consistency. A method of producing the emulsion-type composition here is described below.

First a base oil component was produced in the same manner as in the case of producing the (O+ultrafine diamond particle)/W emulsion composition. Specifically, 5.5 wt % of oleic acid-based oil (rapeseed oil), 3 wt % of methyl oleate, and 1.5 wt % of the ultrafine diamond particle oil dispersion (base oil P-2; ultrafine diamond particle solid concentration: 10 wt %) were mixed. After the addition of 2 wt % of polyoxyethylene (n=6 mol) oleate and 3 wt % of potassium oleate as emulsifiers, the mixture was stirred to prepare an emulsion base oil component. Phase inversion emulsification from a W/O composition into an O/W composition occurred when adding 6 wt % of water (i.e., the ratio of the oil phase (O phase) to the water phase (W phase) was 7:3 (the viscosity was a maximum)), that is, the phase inversion emulsification is completed. A kneader was used to produce the lubricant composition.

Next, After adding 79 wt % of a dispersant-treated ultrafine diamond particle water dispersion having an ultrafine diamond particle solid concentration of 0.19 wt % and including 0.075 wt % of a polyoxyethylene alkyl ether carboxylate (anionic dispersant) and 0.075 wt % of a fatty acid ester (nonionic dispersant) thereto, the mixture was stirred. The whole ultrafine diamond particle solid concentration was 0.3 wt %, and the effective base oil component concentration was 15 wt %. Similarly, a dimethylpolysiloxane emulsion was finally added to the mixture as an anti-foaming agent.

Table 9 shows the friction coefficient of the emulsion-type lubricant composition of Example 3 depending on the change in the ultrafine diamond particle concentration and the effective base oil component concentration.

Although the effects of the effective base oil component concentration and the ultrafine diamond particle concentration on the frictional properties are not necessarily clear, a very small friction coefficient was obtained by adding a small amount of ultrafine diamond particles similar to the case of the (O+ultrafine diamond particle)/W emulsion composition. Specifically, Table 9 shows the effects of the effective base oil component concentration and the ultrafine diamond particle solid concentration on the frictional properties of the emulsion-type (O+ultrafine diamond particle)/(W+ultrafine diamond particle) emulsion composition. Note that "A-DW-DO" refers to the lubricant composition of the "emulsion-type (O+ultrafine diamond particle)/(W+ultrafine diamond particle) emulsion composition" in the following Tables and FIGS.

TABLE 9

| Sample name A-DW-DO | Effective base oil component concentration (wt %) | Ultrafine diamond particle concentration (wt %) | Friction coefficient (μ) |
|---|---|---|---|
| -2503 | 25 | 0.3 | 0.094 |
| -15005 | 15 | 0.05 | 0.099 |

Property Evaluation of Examples 1 to 3

Friction Fatigue Properties

Figures 3, 4:
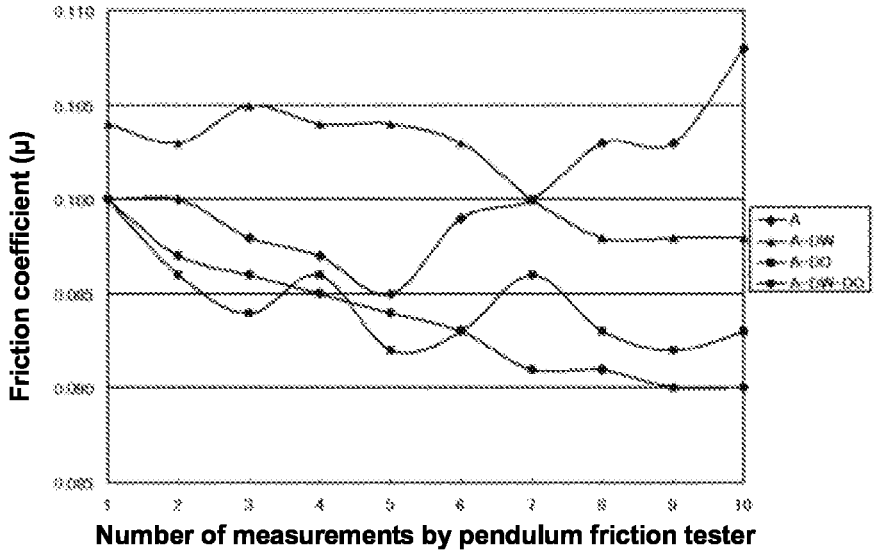
FIG. 3 is a view showing the friction fatigue properties of emulsion-type lubricant compositions of Comparative example 1 and Examples 1 to 3 in the present invention.
FIG. 4 is a schematic view showing the various dispersion state of ultrafine diamond particles.

FIG. 3 is a view showing the friction fatigue properties of the emulsion-type lubricant compositions of Examples 1 to 3 and Comparative example 1. Note that "A" refers to the base emulsion (A) sample that did not include the ultrafine diamond particles in both the oil phase (O phase) and the water phase (W phase) (i.e., sample A-DO-1500 shown in Table 7, and this corresponds Comparative example 1.

In Examples 1, 2, and 3, lubrication properties obtained when the ultrafine diamond particles were dispersed in each phase (water phase (W phase) and/or oil phase (O phase)) of the O/W emulsion composition while controlling the dispersion configuration were shown. FIG. 3 shows the friction fatigue properties of these lubricant compositions in comparison with them each other.

The lubricant compositions were emulsion-type compositions. The effective base oil component concentration was 15 wt %, and the ultrafine diamond particle concentration (solid concentration) was 0.3 wt %. The friction coefficient of the base emulsion (A) that did not include the ultrafine diamond particles increased along with an increase in the repeating (reciprocating) number of measurements as described above. On the other hand, the friction coefficient of the lubricant composition according to the present invention including the ultrafine diamond particles added and dispersed in the W phase (A-DW), the O phase (A-DO), or the W phase and the O phase (A-DW-DO) gradually lowered and stabilized by repeating the friction. In particular, the lubricant composition including the ultrafine diamond particles in the W phase and the O phase (A-DW-DO) characteristically converged to the smallest friction coefficient. Note that the base oil, the emulsifier, the dispersant, and the like used in this example are merely examples of the components of the diamond lubricant composition. These components are obviously not limited to those used in this example.

Property Evaluation of Examples 1 to 3

Friction Surface Lubricating Behavior Determined by Falex Test

In order to clarify the excellent friction fatigue behavior obtained in Examples 1 to 3, a Falex test (ASTM D 2670) was performed to observe the features of the friction surface depending on the lubricant composition. The Falex test was performed at 20° C., 290 rpm, and 1334 N (load) for 45 minutes.

Figures 5, 7:
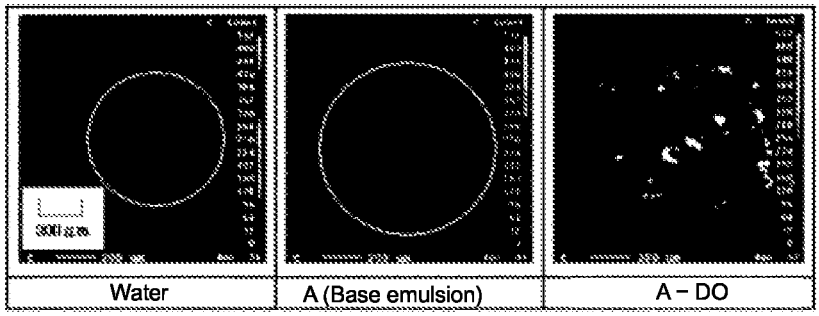
FIG. 5 shows micrographs of the friction surface in the Falex test of lubricant compositions of Examples 1 to 3, Modification example 1, and Comparative example 1.
FIG. 7 shows an electron microscope-backscattering electron image of a friction surface (wear scar) of the ball in Shell high-speed four-ball friction test of samples in various aspects confirmed the derivation of a carbonaceous substance concentration layer.

FIG. 4 is a schematic view showing the dispersion state of the ultrafine diamond particles. Example 1 corresponds to "A-DW", Example 2 corresponds to "A-DO", and Example 3 corresponds to "A-DW-DO". Comparative example 1 corresponds to "A". Modification example 1 (modification of Example 1) is the dispersant-treated ultrafine diamond particle water dispersion obtained when producing the composition of Example 1, and corresponds to "DW" in FIG. 4. The schematic view indicated by "A" also applies to the microemulsion-type "B" and the grease-type "C". FIG. 5 shows the micrographs of the friction surface after the Falex test of each of the lubricant compositions of Examples 1 to 3, Modification example 1, and Comparative example 1. The relationship between the name of the state and Examples 1 to 3, Modification example 1, and Comparative example 1 is the same as that shown in FIG. 4. In FIGS. 4 and 5, "ND" refers to "ultrafine diamond particle".

FIG. 5 shows the optical micrographs of the sliding Falex block friction surface. The friction surface of the O/W base emulsion (A) that did not include the ultrafine diamond particles was scooped out, and the sliding width thereof (pin contact area) increased due to friction wear. In the case of the O/(W+ultrafine diamond particle) emulsion produced by adding and dispersing the ultrafine diamond particles in the W phase of the O/W base emulsion (A), it is confirmed that friction wear was significantly decreased and the width of the wear scar was also small. Furthermore, in the case of the (O+ultrafine diamond particle)/W emulsion produced by adding and dispersing the ultrafine diamond particles in the O phase of the O/W base emulsion (A), the width of wear scar was also small, and significantly decreased.

Figure 6:
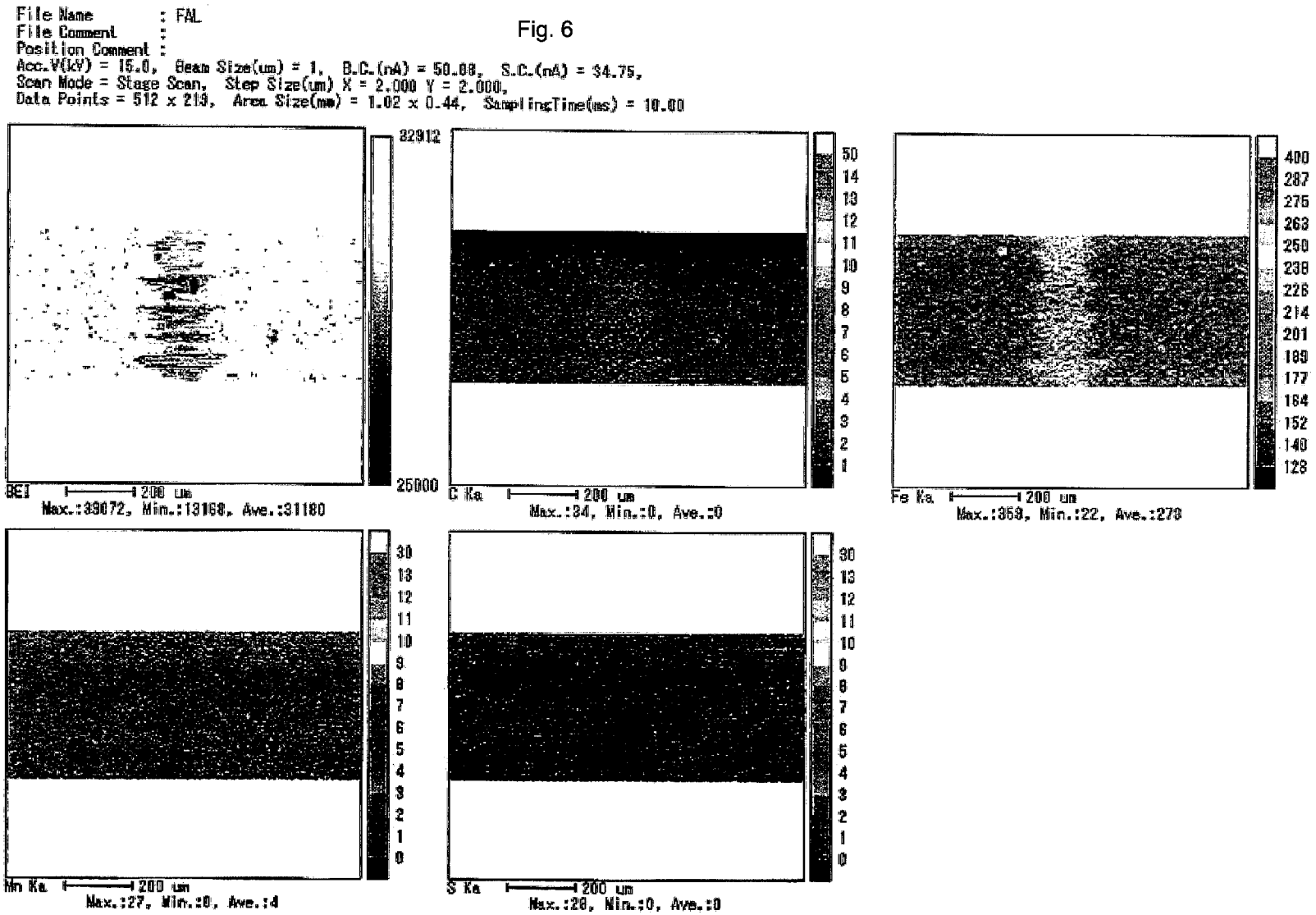
FIG. 6 shows the EPMA analysis results of a friction surface of the block in the Falex test of a lubricant composition of Example 2.

FIG. 6 shows the EPMA analysis results for the Falex test block friction surface of the lubricant composition of Example 2. FIG. 6 shows the results obtained by investigating the Falex test block friction surface of the (O+ultrafine diamond particle)/W emulsion composition described above in more detail by EPMA analysis.

a) indicates an backscattering electron image around the friction surface. The element having a small atomic number is concentrated in the friction area.

b) to e) indicate the mapping results based on the characteristic X-ray intensity of each of carbon, iron, manganese and sulfur ((b) corresponds to carbon, (c) corresponds to iron, (d) corresponds to manganese, and (e) corresponds to sulfur) in order to identify the elements concentrated in the friction area in consideration of the materials (free-cutting steel) of sliding member.

b) indicates that carbonaceous substance is concentrated in the wear scar area. An micro-X-ray diffractometry was performed to determine the crystal structure thereof. The diffraction peaks of diamond (111), (220), and the like were detected. It was thus found that the carbonaceous substance concentrated in the wear scar area was the ultrafine diamond particles added and dispersed in the O phase. The same results were obtained for other emulsions including the ultrafine diamond particles.

It was thus confirmed that the formed concentration layer of the ultrafine diamond particle is closely related to the width of the wear scar obtained by the Falex test and the friction coefficient obtained by the pendulum friction fatigue test.

Table 10 shows the pin wear rate obtained for each of the lubricant compositions by the Falex test in comparison with them each other. Specifically, Table 10 shows the pin wear rate obtained for the lubricant composition according to the present invention by the Falex test (ASTM D 2670) (type: emulsion-type, ultrafine diamond particle solid concentration: 0.3 wt %, effective base oil component concentration: 15 wt %, testing conditions: 20° C., 290 rpm, 1334 N (load), 45 min).

TABLE 10

| Name | Ultrafine diamond particle concentration (wt %) | Pin wear rate (mg) | Feature in form |
|---|---|---|---|
| A | 0 | 3.5 | Emulsion (base emulsion) |
| A-DW | 0.3 | 0.5 | Water (W phase) dispersion |
| A-DO | 0.3 | 0.8 | Oil (O phase) dispersion |
| A-DW-DO | 0.3 | 2.9 | Water/Oil dispersion |

Effective base oil component concentration: 15 wt %

The above results were obtained using ultrafine diamond particles having an average particle size of 40 nm. As described later regarding the effects of the average particle size on frictional properties, the pin wear rate significantly decreased along with a decrease in average particle size. This further demonstrates the unconventional excellent lubrication properties of the lubricant composition according to the present invention.

(Confirmation of Forming Ultrafine Diamond Particle Concentration Layer by Shell High-speed Four-ball Friction Test and Confirmation Thereof)

It was explained by the above Falex test that the excellent lubrication properties of the lubricant compositions of Examples 1 to 3 were brought from the ultrafine diamond particle concentration layer formed on the friction surface. However, according to the carbon concentration information obtained by the EPMA analysis, the concentration of carbon derived from the carbon included in the sliding test piece or the organic component of the emulsion by any mechanism may occur at the same time. Therefore, the presence or absence of concentration of carbon other than the ultrafine diamond particles was determined using a Shell high-speed four-ball friction test (described later). The objective carbon to be confirmed and having the possibility to have been concentrated is the following two kinds of carbons:

1) carbon derived from small amount of carbon included in a friction test ball, and
2) carbon derived from the organic substance of the base oil component.

The Shell high-speed four-ball friction test was performed under the following conditions: a 0.5-inch SUJ2 ball, at a load of 490 N and a rotational speed of 1000 rpm for 1800 seconds (described in detail later). The EPMA analysis method was used for means of confirmation.

FIG. 7 shows the carbon characteristic X-ray intensity distribution on the friction surface of the ball (fixed ball, hereinafter the same unless otherwise indicated) in a water test (Water) used for the confirmation, a test conducted on the base emulsion (A) that did not include the ultrafine diamond particles, and a test conducted on the (O+ultrafine diamond particle)/W emulsion composition (A-DO).

Regarding the confirmation above item 1) (carbon derived from small amount of carbon included in friction test ball), the ball was rubbed with distilled water that did not include an organic substance, and the concentration of carbon on the friction surface of the ball from which the surface layer was forcibly removed was determined The carbon characteristic X-ray intensity was a same background level as that of the friction test ball other than the friction surface, that is, concentration of carbon was not observed. Specifically, it is confirmed that carbon concentration derived from a small amount of carbon included in the ball was not observed (correspond to "water" in FIG. 7).

Regarding the confirmation of above item 2) (carbon derived from organic substance of base oil component), the organic substance may be introduced into the ball during friction, or carbon may be derived from a friction polymer (polymer or carbide) produced by an organic reactant due to frictional heat.

To confirm these possibilities the concentration of carbon on the friction surface of the ball was determined using the base emulsion (A) (effective base oil component concentration: 15 wt %, see Table 13) that did not include the ultrafine diamond particles. Concentration of any carbon was not observed (only a background level was detected) similar to the in water test (correspond to "A (base emulsion)" in FIG. 7).

When performing the test using the (O+ultrafine diamond particle)/W emulsion composition including the ultrafine diamond particles in the oil phase (O phase) (A-DO, effective base oil component concentration: 15 wt %, ND content: 0.3 wt %, see Table 13), it is confirmed that the carbon concentration was clearly occurred similar to the Falex test (correspond to "A-DO" in FIG. 7).

The structure of the carbon concentration layer was further identified using micro-Raman spectroscopy in order to confirm the derivation of carbon in the layer. A Raman shift attributed to a diamond bond was obtained at about 1332 $cm^{-1}$. It was thus confirmed that the concentrated carbon was confirmed to be the ultrafine diamond particles added and dispersed in the oil phase (O phase). A white circle shown in the results for "Water" and "A (base emulsion)" indicates the wear diameter. The wear scar of "Water" was smaller than that of "A" and "A-DO" since the friction test conditions for "Water" were reduced by ½ (load: 245 N, rotational speed: 600 rpm) (because, a seizure phenomenon immediately occurred under the same friction test conditions as those of "A" and "A-DO").

Figure 8:
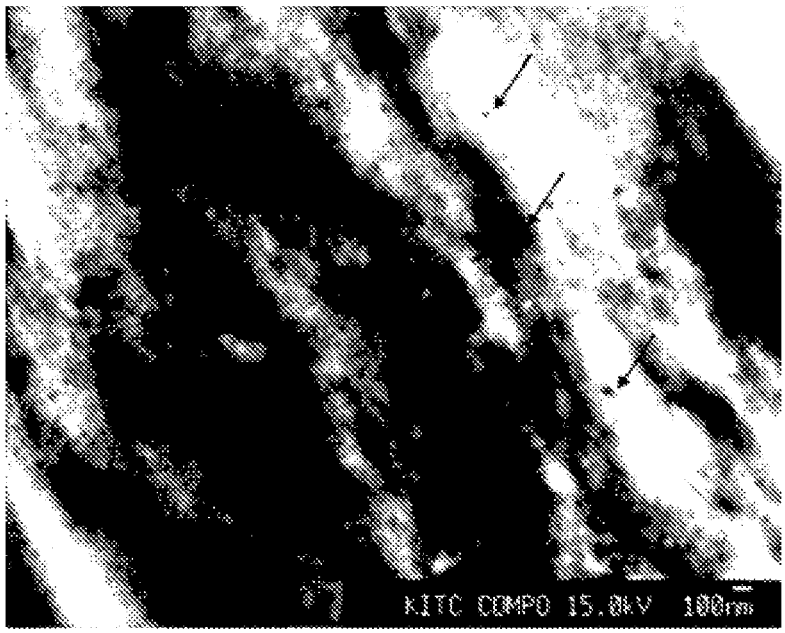
FIG. 8 shows a high-magnification electron microscope-backscattering electron image of the friction surface (wear scar) of the ball in Shell high-speed four-ball friction test of an (O+ultrafine diamond particle)/W emulsion composition.

FIG. 8 shows a high-magnification (×30,000) backscattering electron image of the carbon concentration area of the friction surface of the ball of the (O+ultrafine diamond particle)/W emulsion composition (A-DO) shown in FIG. 7. The ultrafine diamond particles having a particle size of 100 nm or less are scattered and embedded (indicated by arrows, FIG. 8).

It was thus confirmed that the ultrafine diamond particles added and dispersed in the base emulsion (A) are concentrated in the friction surface to form a ultrafine diamond particle coating layer irrespective of the friction test method, such as Falex test (line contact), Shell high-speed four-ball test (point contact) or the like) through the confirmation. The contact state transitions to planar contact along with the progress of the friction test (point contact to line contact) (transitions to a steady state friction region). It is difficult to eliminate partial contact and the like even in a test environment of planar contact from the viewpoint of design, and the contact state is known to change to a stable planar contact through a point contact frictional environment to a line contact frictional environment. It was also confirmed in a same manner even in a planar contact friction environment.

In this case, it was admitted that a ultrafine diamond particle coating concentration layer could be also formed. The ultrafine diamond particle coating concentration layer effectively reduces the specific wear rate, the friction coefficient (both static friction coefficient and dynamic friction coefficient), and the friction torque (described later). Therefore, the emulsion composition including the ultrafine diamond particles (A-DW, A-DO, and A-DW-DO) is very useful for industrial application as a coating agent for ultrafine diamond particles. Simultaneously, since the ultrafine diamond particle coating concentration layer (ultrafine diamond particle coating layer), the method of forming the same, and various sliding members including the ultrafine diamond particle coating concentration layer (ultrafine diamond particle coating layer) can be implemented inexpensively and relatively easily, the coating layer having high lubrication properties, and the method of forming the same were known to be extremely useful Free carbon and the like other than the ultrafine diamond particles were not detected in the ultrafine diamond particle concentration layer in the confirmation. Note that it is obvious that a composite concentration composition with a carbonaceous substance other than the diamond structure (for example, sp, sp2, or sp3 bond, of graphite, fullerene, and the like, or a combination thereof) may not be eliminated in the nanodiamond particle concentration layer according to the present invention. For example, a composite concentration with a carbon having various configuration, such as graphite or fullerene that contributes to improve the lubrication properties can be achieved by adding and dispersing a oiliness improver and a solid lubricant other than the ultrafine diamond particles in the O/W emulsion composition including the ultrafine diamond particles. The details are described later.

Property Evaluation of Examples 1 to 3

Lubrication Reliability

Of course, As lubrication properties that are required for a lubricant composition, excellent lubrication properties, such as a small friction coefficient, friction fatigue properties that are stable for a long time, a small friction wear rate and the like can be given. However, a capability of being able to significantly reducing the risk of seizure and the like, even if trouble of an unlubricated state (depletion of lubricant) has occurred due to leakage of the lubricant composition from the friction/sliding area during operation of a device, a machine, or these system, definitely provides high reliability of lubrication properties. Since the lubricant composition according to the present invention is an emulsion composition that includes an water phase (W phase) and an oil phase (O phase), assumed lubricant depletion test, in which a friction fatigue behavior when removing the lubricant composition from the friction/sliding area by washing with water during the pendulum friction fatigue test was determined as a friction fatigue behavior under the severest friction conditions, was performed. The test was performed under the same conditions as in the friction fatigue test described above. Specifically, the pendulum friction fatigue test was performed 10 times (reciprocating) in the lubricant according to the present invention. After removing the lubricant composition from the friction/sliding area with water while applying ultrasonic waves, and drying, and the pendulum friction fatigue test was then performed 10 times (reciprocating) under the same conditions again.

Figure 9:
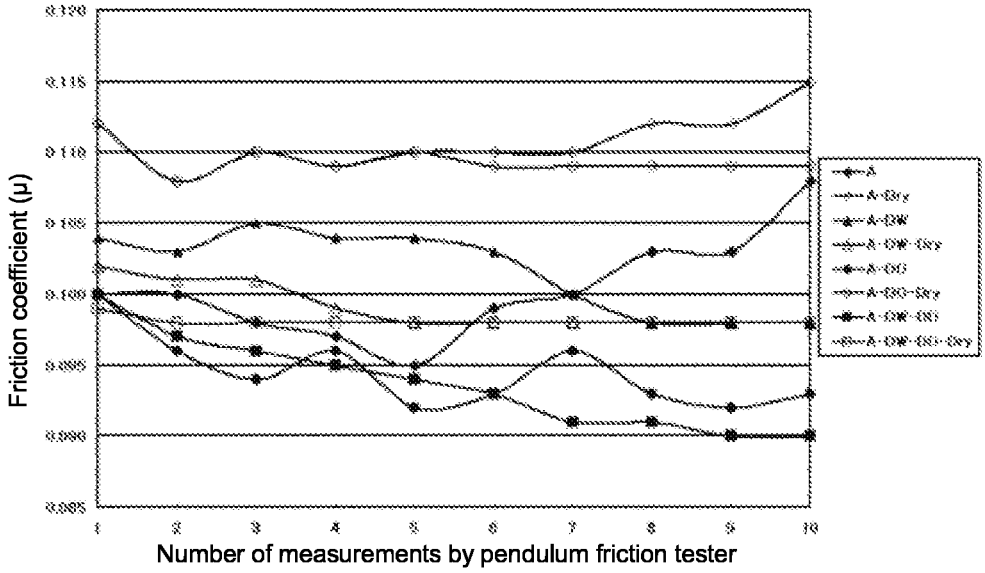
FIG. 9 is a view showing the friction fatigue properties of lubricant compositions of Examples 1 to 3 and Comparative example 1, and the friction fatigue properties of lubricant compositions of Examples 1 to 3 and Comparative example 1 according to a lubricant depletion test.

FIG. 9 is a view showing the friction fatigue properties and the friction fatigue properties of the lubricant compositions of Examples 1 to 3 and Comparative example 1 by the lubricant depletion test.

FIG. 9 shows the friction fatigue properties of the lubricant composition of each example by the lubricant depletion test together with the friction fatigue properties in various dispersion states of ultrafine diamond particles. The friction fatigue properties determined was shown in FIG. 9, and samples used for the lubricant depletion test are indicated by appending "—Dry" in explanatory note thereof indicating the various dispersion states of ultrafine diamond particles. For example, the depleted test result for the emulsion-type (O+ultrafine diamond particle)/(W+ultrafine diamond particle) composition (A-DW-DO) (Example 3) is indicated by "A-DW-DO-Dry". It was confirmed from each results according to the dispersion state that frictional properties significantly lower than those of a conventional straight-type lubricant (described later) were maintained, even after removing the lubricant composition by washing with water, and the same friction surface lubricating behavior as that in the Falex test is maintained even in the lubricant depleted state. It was thus confirmed that the lubricant composition according to the present invention has unconventional high reliability. The effective base oil component concentration and the ultrafine diamond particle solid concentration of each lubricant composition were the same as in FIG. 3. The lubrication reliability confirmed in the lubricant depletion test is characterized in that a stable lubrication function is achieved, even if the lubricant composition is removed by washing with water, by forming a ultrafine diamond particle coating concentration layer in an area which needs lubrication during a pre-conditioning interim operation or the like. Therefore, a useful novel lubrication means that can eliminate oil contamination can be provided by applying the lubricant composition to a processing/production step for paper products or the like (for example, punching process to Japanese paper or a polymer-treated paper product (e.g., new material for flat-screen television) and production process for paper-wrapped cigarette) for which adhesion of a lubricant (oil) may impair the quality of the product.

Examples 4 to 7

In Examples 1 to 3, the ultrafine diamond particles dispersed in the lubricant composition had an average particle size of 40 nm. In Examples 4 to 7, the effects of the average particle size on the frictional properties were described. The conditions employed in Example 2 other than the average particle size were employed as same conditions as in Examples 4 and 5, and the conditions employed in Example 3 other than the average particle size were employed as same conditions as in Examples 6 and 7 unless otherwise indicated.

The ultrafine diamond particles used in the example were ultrafine particles that were produced by the detonation technique, had a primary particle size of several nanometers, and were relatively round shape but did not express a euhedral crystal shape. The primary particles had strong aggregation properties. The above average particle size (40 nm) refers to an average aggregate diameter. The average particle size of the ultrafine diamond particles that may be used in the present invention is not limited to the average aggregate diameter used in the examples. Ultrafine diamond particles that have been dispersed and had at least the primary particle size (e.g., 4 nm) may be used.

An (O+ultrafine diamond particle)/W emulsion composition (Example 4: 10 nm, Example 5: 4 nm), and an (O+ultrafine diamond particle)/(W+ultrafine diamond particle) emulsion composition (Example 6: 10 nm, Example 7: 4 nm) were produced using ultrafine diamond particles having an average particle size of 10 nm and 4 nm, and the friction coefficients of the above emulsion compositions were compared with the friction coefficient obtained when using ultrafine diamond particles having an average particle size of 40 nm.

The resulting friction coefficients were significantly smaller than 0.1 respectively. More excellent frictional properties exhibited as compared with Examples 1 to 3 in which the ultrafine diamond particles having an average particle size of 40 nm were used. It was found that the ultrafine diamond particle addition concentration can be further reduced according to the reduction of the average particle size of the ultrafine diamond particles. The above friction properties could be sufficiently achieved by adding 0.02 wt % of the ultrafine diamond particles in the example. The effective base oil component concentration was 20 wt %. When the average particle size (as an aggregate particle size) increases, the irregular shape of the aggregates forms a native and processing particle cutting edge for grinding, so that the friction surface is polished (ground) when a shear force is applied to the friction sliding surfaces. When the average particle size of the ultrafine diamond particles exceeds 100 nm, it was confirmed that friction wear occur to a large extent due to the polishing effect, and the friction coefficient increases.

Therefore, it is indispensable that the average particle size of the ultrafine diamond particles is 100 nm or less. The above phenomenon was also confirmed for ultrafine diamond particles produced by a static ultrahigh-pressure method, a shock wave synthesis method, or a vapor deposition synthesis method. When using single-crystal or poly-crystalline particles produced by such a method, it is preferable to reduce the size of a sharp and minute cutting edge thereof by a wet dispersion treatment, a heat treatment, or the like and to modify in addition.

Concentration of Solid to be Added

In Examples 1 to 3, the ultrafine diamond particle concentration to be added was set up to about 1 wt % with respect to all components concentration. In particular, the particles interact and are easily clustered in the water phase (W phase), as described in connection with the zeta potential in Example 1. This phenomenon significantly occurs as the ultrafine diamond particle concentration increases. Therefore, it is difficult to stably disperse the individual ultrafine diamond particles by utilizing electrical interaction, the dispersant, and the like (e.g., Brownian agglomeration) even if the specification of the ultrafine diamond particles is determined by the average particle size of the primary particles or minute aggregate particles, for example. Specifically, the dispersion state of the ultrafine diamond particles in which the electrical restriction (such as Van der Waals force in clustering) between particles is relatively small degenerate to the state of agglomeration. The above behavior clearly occurs when the ultrafine diamond particle concentration exceeds 10 wt %. The friction coefficient considerably increased when evaluating the frictional properties of the lubricants of Examples 1 to 3 in this concentration range.

Therefore, it is preferable that the upper limit of the concentration (by weight) of the ultrafine diamond particles added and dispersed in both the oil phase (O phase) and the water phase (W phase) be 10 wt %. Though there was not necessarily the lower limit in addition concentration of the ultrafine diamond particles, it was confirmed that the ultrafine diamond particle concentration achieving a small friction coefficient and excellent friction fatigue properties can be reduced to 0.01 wt % or less, if reducing the average particle size to the primary particle size.

Effective Base Oil Component Concentration

In Examples 1 to 3, the effective base oil component concentration of the emulsion-type composition or the microemulsion-type composition was the range of 5 to 25 wt %, and that of the paste-type composition was 50 wt %. If the effective base oil component concentration exceeds 90 wt % as the upper limit, it may be difficult to maintaining the state thereof as a O/W emulsion. If the effective base oil component concentration is lower than 1 wt % as the lower limit, the effects of the base oil component may not be expected. Therefore, the effective base oil component concentration of the oil phase (O phase) is preferably 1 to 90 wt %.

Biodegradability

The biodegradability of the lubricant compositions of the above examples were evaluated using the measurement method defined by the Organization for Economic Cooperation and Development (OECD) provided in connection with the Globally Harmonized System of Classification and Labelling of Chemicals (GHS) of the United Nations as a simplified method. According to this method, only when the chemical structure has been known, or otherwise biodegradability data cannot be obtained, the ratio (BOD/COD) obtained by dividing the biochemical oxygen demand (BOD) by the chemical oxygen demand (COD) is taken as the "biodegradability" (see Journal of Oleo Science, Vol. 5, No. 10, 2005).

As evaluation samples, the O/(W+ultrafine diamond particle) emulsion composition of Example 1 and the (O+ultrafine diamond particle)/W emulsion composition of Example 2 were used. The effective base oil component concentrations were all 15 wt % according to Table 13. The biodegradabilities (=biochemical oxygen demand (BOD)/chemical oxygen demand (COD)) of both compositions were same 72.7% (=16,000/22,000). According to the above results, the lubricant compositions of Examples 1 and 2 had a biodegradability defined by the OECD of 60% or more, thus could be determined to be readily biodegradable and are promptly decomposed in an actual aerobic aqueous environment. The same results were also obtained for the O/W emulsion composition including the base oil, the emulsifier, the dispersant, and the ultrafine diamond particles.

Modification Example 2

As Modification example 2 (modification of Example 1), a conventional (straight-type) lubricant including the ultrafine diamond particles was prepared. A machine oil #68 (straight oil) was used as a base oil. A comparative lubricant was prepared according to the composition shown in Table 11.

When adding additives, such as solid particles, extreme pressure agent or the like, an n-paraffin (as a base oil), a higher amide alkylolated sulfonate salt (as a dispersant), ultrafine diamond particles, and the like were mixed and stirred therewith (dispersion treatment) in the same manner as in the preparation of the ultrafine diamond particle oil dispersion. A machine oil #68 was then added to the mixture to prepare a conventional straight-type lubricant having the desired solid particle concentration (Modification example 2). The ultrafine diamond particles having an average particle size of 40 nm used in Examples 1 to 3, silicon dioxide ($SiO_2$) particles having an average particle size of 40 nm, and molybdenum disulfide ($MoS_2$) particles having an average particle size of 500 nm were used as the solid particles, and a chlorinated paraffin (CL bond ratio: 40%) was used as an EP additive. The concentration of these components was all 1 wt %. Table 11 shows the composition of the conventional lubricating oil (composition) adding various solid lubricants. In the following Tables and Figures, compositions having a sample name "BOM", "$MOS_2$", "MOSI", or "MOCl (MOCL)" were prepared as a comparative example. These compositions are collectively referred to as Comparative example 2. A composition having a sample name "MOND (NDMO-1)" is Modification example 2.

TABLE 11

| Sample | | Solid lubricant | | Dispersant |
|---|---|---|---|---|
| name | Base lubricant | Type | Amount (wt %) | (wt %)*2 |
| BOM | Machine oil#68 | — | — | 0.5 |
| MOS2 | | $MoS_2$ | 1.0 | 0.5 |
| MOSI | | $SiO_2$ | 1.0 | 0.5 |
| MOC1 | | CL-40*1 | 1.0 | 0.5 |
| MOND | | ND | 1.0 | 0.5 |

Figure 10:
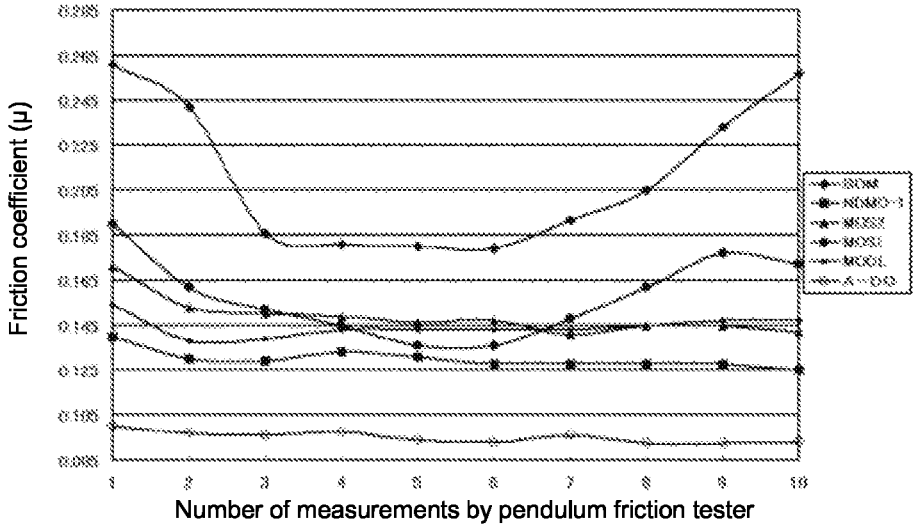
FIG. 10 is a view showing the friction fatigue properties of lubricant compositions of Example 2, Modification example 2, and Comparative example 2.

*1Chlorinated paraffin (chlorine concentration: 40%)
*2Higher amide alkylolated sulfonate salt
ND: Ultrafine diamond particle FIG. 10 is a view showing the friction fatigue properties of the lubricant compositions of Example 2 of the present invention, Modification example 2, and Comparative example 2. FIG. 10 also shows the friction coefficients and the friction fatigue properties of the conventional straight-type lubricant produced by the above method and the diamond lubricant composition of Example 2 in comparison with them each other. Note that "A-DO" refers to the emulsion-type (O+ultrafine diamond particle)/W emulsion composition (ultrafine diamond particle solid concentration: 0.05 wt %) of Example 2. The friction coefficient of the conventional straight-type lubricant (NDMO-1) was about 0.13 even if the ultrafine diamond particles used in the present invention were added. Specifically, the friction coefficient of the conventional straight-type lubricant (NDMO-1) was significantly higher than that of the emulsion-type composition (friction coefficient: 0.09) including a small amount of oil-soluble dispersant (OS)-treated ultrafine diamond particles in the oil phase (O phase).

Figure 11:
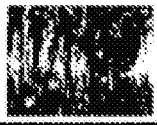
FIG. 11 shows micrographs of the friction surfaces in the Falex test for the lubricant compositions of Modification example 2 and Comparative example 2.
Figure 11:
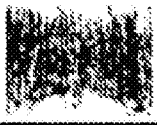
Figure 11:
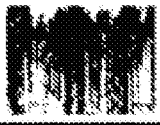
Figure 11:
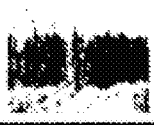
Figure 11:
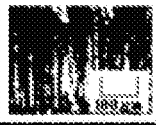

FIG. 11 shows a micrograph of the friction surface of each of the lubricant compositions of Modification example 2 and Comparative example 2 in the Falex test. The optical micrograph of the block friction surface of the conventional straight-type lubricant subjected to the Falex test indicates that the friction surface of the conventional straight-type lubricant prepared by adding $SiO_2$, $MoS_2$, or a chlorinated paraffin to the conventional straight oil (Comparative example 2) had a significantly large width of the wear scar due to friction wear. FIG. 11 also shows the friction coefficient determined using the Soda pendulum type friction tester. When comparing the results shown in FIG. 11 with the results shown in FIG. 5, it is obvious that the lubricant composition of each example according to the present invention had excellent lubrication properties.

Figure 12:
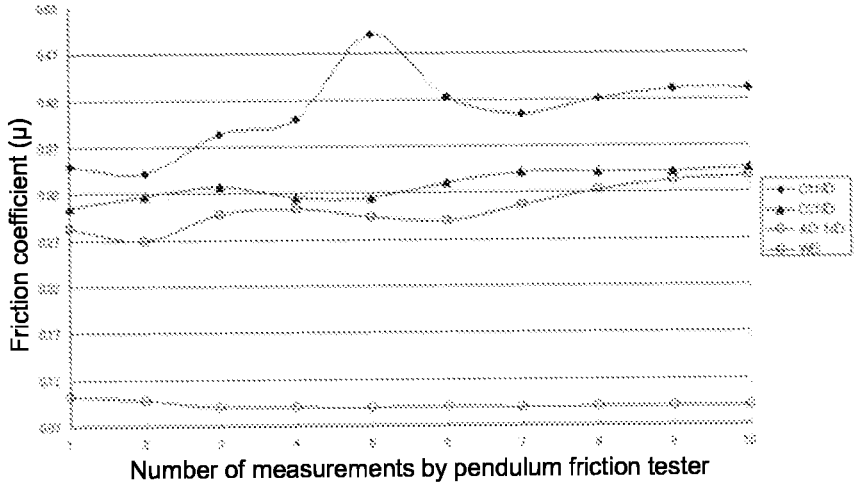
FIG. 12 shows the friction fatigue properties of a lubricant composition depending on the presence or absence and the type of dispersant.

Dispersion Behavior and Frictional Properties of Ultrafine Diamond Particles Due to Addition of Cationic Dispersant The effects of the dispersant on the dispersibility of the ultrafine diamond particles in the water phase (W phase) of the O/(W+ultrafine diamond particle) emulsion according to the present invention, and the friction fatigue behavior thereof were determined by adding various cationic dispersants. FIG. 12 shows the friction fatigue properties of the lubricant composition depending on the presence or absence and the type of dispersant. FIG. 12 shows the friction fatigue properties when adding a higher amine-lower fatty acid salt cationic dispersant (C2ND) used in Example 1 or a quaternary amine salt-$RN(CH_2)_3 \cdot X^-$ (halogen) cationic dispersant (C1ND) including an electrolyte to the ultrafine diamond particle water dispersion raw material to subject to dispersant treatment. The ultrafine diamond particle concentration was 1.0 wt %, and the dispersant concentration was 0.5 wt %.

FIG. 12 also shows the friction fatigue properties of the ultrafine diamond particle water dispersion raw material that did not include the dispersant (WD: ultrafine diamond particle concentration (solid concentration): 1.0 wt %) as a comparison standard. FIG. 12 also shows the effects of a composite treatment (AD-ND) using a polyoxyethylene alkyl ether carboxylate (anionic dispersant) (corresponding to the sample AD) and a fatty acid ester (nonionic dispersant) (corresponding to the sample ND) used in Example 1 at the same time. The friction coefficient of the cationic dispersant-treated ultrafine diamond particle water dispersion was equal to or rather larger than that of the ultrafine diamond particle water dispersion that was not treated with the cationic dispersant. The fatigue properties of the ultrafine diamond particle water dispersion were not confirmed the tendency to stabilize by the (cationic) dispersant treatment at all. These results are contrary to the results for the effects of the anionic dispersant, the amphoteric dispersant, and the nonionic dispersant.

Regarding the dispersion stability by the cationic dispersant treatment, the dispersion stability was not necessarily excellent in the viewpoint of an zeta potential when using a higher amine-lower fatty acid salt. On the other hand, the dispersion stability was very excellent when using a quaternary amine salt-$RN(CH_2)_3 \cdot X^-$ (halogen) dispersant. Various other cationic dispersants were also evaluated. However, a decrease in friction coefficient and stabilization effect of the friction fatigue properties were not observed.

The effect of by adding a dispersant other than the cationic dispersant in the O/W emulsion composition including the ultrafine diamond particles were observed in improvement of the frictional properties.

Effects of Lubricant Compositions of Examples 1 to 3

An improvement in lubrication properties (significantly excellent friction coefficient) was achieved as compared with the conventional straight-type lubricant or grease including the ultrafine diamond particles by controlling the dispersion state of the ultrafine diamond particles in each phase of the O/W emulsion. The effects of the dispersant that effectively utilizes the addition effect of the ultrafine diamond particles on the friction coefficient were clarified for the first time, and it was found that the composite addition of the dispersant is more effective. The O/W emulsion according to the present invention utilizes the ultrafine diamond particles that do not impose a biohazard problem, includes a base oil, an emulsifier, a dispersant, and the like that do not fall under the substances specified by the PoHS and the PRTR, and exhibits excellent biodegradability, an environmentally friendly unconventional lubricant composition that exhibits excellent lubrication properties, and has a minimum environmental load can be provided. As a result, the following remarkable effects can be obtained.

1. Although the ultrafine diamond particles are more expensive than conventional solid lubricants, the lubricating effect can be improved by adding only a small amount of ultrafine diamond particles. Therefore, an increase in cost can be prevented in industrial applications.

2. Since the lubricant composition can be washed out with water, and exhibits biodegradability, $CO_2$ emissions by washing, disposal, and the like can effectively be reduced.

3. The friction coefficient can be significantly lowered, so that the friction fatigue properties can be improved.

4. The lubricant composition according to the present invention forms a particle concentration layer. Therefore, a wear-resistant coating for preventing wear can be easily formed by a pre-conditioning interim operation instead of conventional CVD coating or a ceramic coating treatment. This makes it unnecessary to perform a complicated and expensive coating operation (treatment), reduces the risk of seizure and the like, and ensures high lubrication reliability. Therefore, excellent economical effects can be achieved.

Since the production method according to the present invention can disperse the ultrafine diamond particles in oil, cost can be reduced.

Examples 8 to 10

Advanced Emulsion Composition

According to Examples 1 to 7, an optimum dispersant that draws out the frictional properties of the lubricant composition (O/W emulsion composition) including the ultrafine diamond particles, and important elements, such as emulsifier or the like when producing the composition were discovered. As an advanced prototype of the O/W emulsion lubricant composition including the ultrafine diamond particles, a multiple state lubricant composition and/or a composite state lubricant composition obtained by post-adding an oiliness improver, a solid lubricant other than the ultrafine diamond particles, or the like to the water phase (W phase) of the O/W emulsion composition including the ultrafine diamond particles were prepared, and the inventors found that the multiple state lubricant composition and/or the composite state lubricant composition exhibits more excellent lubrication properties as compared with the O/W emulsion composition (A-DO, A-DW, or A-DW-DO) including the ultrafine diamond particles. This finding has also led to the completion of the present invention. The embodiment details thereof are described below.

Note that the expression "post-adding" refers to a preparation method of adding a desired amount of an oiliness improver (Y), a solid lubricant other than the ultrafine diamond particles (Z) or a both thereof (Y-Z) to the water phase (W phase) of the O/W emulsion composition including the ultrafine diamond particles that has been produced by the Emulsification by the PIT-method (referred to as first production step), and dispersing into the system at a low stirring speed (referred to as second production step) to obtain a lubricant composition.

This method is hereinafter referred to as "post-addition method". A multiple state and/or a composite state obtained by the second production step in which the oiliness improver (Y) and/or the solid lubricant (Z) are dispersed in the water phase (W phase) of the O/W emulsion composition including the ultrafine diamond particles is collectively referred to as "T". A composition obtained by post-adding the oiliness improver (Y) to the O/W emulsion composition including the ultrafine diamond particles is referred to as "multiple dispersion composition (TY)", a composition obtained by post-adding the solid lubricant other than the ultrafine diamond particles (Z) is referred to as "composite dispersion composition (TZ)", and a composition obtained by post-adding both the oiliness improver (Y) and the solid lubricant (Z) is referred to as "multiple-composite dispersion composition (TY-TZ)".

For example, a desired amount of oiliness improver is added when a phase transition from a water-in-oil (W/O) phase to an oil-in-water (O/W) phase occurs by the Emulsification by the PIT-method, and the mixture is stirred so that the oiliness improver is dispersed as oil droplets in the water phase (W phase) of the O/W emulsion including the ultrafine diamond particles. Finally water is added to the mixture so that the desired effective base oil component concentration is achieved to be completed. The post-addition substances described above may be gradually added with stirring at a low speed after an O/W emulsion has been formed. The oiliness improver may be added at an arbitrary timing unless otherwise indicated.

In order to enhance the features which the additives posses, it may be effective to add an essence, an astringent agent, a preservative, and the like after the O/W emulsion has been emulsified.

(Symbol of Various Dispersion Composition)

A composition obtained by adding the oiliness improver (Y) to the water phase (W phase) of the O/W emulsion composition (A-DO) including the ultrafine diamond particles in the oil phase (O phase) thereof, with being multiple state, is referred to as "A-DO-TY", a composition obtained by adding the solid lubricant other than the ultrafine diamond particles (Z), with being composite state, is referred to as "A-DO-TZ", and a composition obtained by adding both the oiliness improver (Y) and the solid lubricant (Z), with being mixture state (multiple-composite mixture state), is referred to as "A-DO-TY-TZ" to make an explanation concise.

A composition obtained by adding the oiliness improver (Y) to the water (W phase) of the O/W emulsion composition (A-DW) including the ultrafine diamond particles in the water phase (W phase) in the water (W phase) thereof is referred to as "A-DW-TY", a composition obtained by adding the solid lubricant other than the ultrafine diamond particles (Z) is referred to as "A-DW-TZ", and a composition obtained by adding both in a mixture state is referred to as "A-DW-TY-TZ". A composition (TY) obtained by adding the oiliness improver (Y) to the O/W emulsion composition (A-DW-DO) including both (A DO) and (A-DW) is referred to as "A-DW-DO-TY", a composition (TZ) obtained by adding the solid lubricant (Z) is referred to as "A-DW-DO-TZ", and a composition (TY-TZ) obtained by mixing and dispersing the both compositions is referred to as "A-DW-DO-TY-TZ". This also applies to other combinations and may be called in the same way symbolized as described above.

The lubricant compositions of Examples 8 to 12 are a multiple dispersion composition (TY) obtained by post-adding the oiliness improver (Y) to the water phase (W phase) of the O/W emulsion composition including the ultrafine diamond particles, a composite dispersion composition (TZ)

obtained by post-adding the solid lubricant other than the nanodiamond particles (Z), or a multiple-composite dispersion composition (TY-TZ) obtained by post-adding the both oiliness improver (Y) and solid lubricant (Z). Each of them makes it possible to provide a lubricant composition that implements stabilization of the rotation torque and minimization of the tolerances for machining & other processing that cannot conventionally be achieved by a water-soluble lubricant, and exhibits excellent wear resistance under a friction environment of the high-load condition.

Example 8

Multiple Dispersion Composition (A-DO-TY)

The inventors found that the lubrication properties are significantly improved by dispersing the oiliness improver (Y) and the solid lubricant other than the ultrafine diamond particles (Z) in the water phase (W phase) of the (O+ultrafine diamond particle)/W emulsion composition (A-DO; emulsion-type). An improvement in lubrication properties of the multiple dispersion composition (TY), the composite dispersion composition (TZ), and the multiple-composite dispersion composition (TY-TZ) obtained by dispersing the oiliness improver (Y) and/or the solid lubricant other than the ultrafine diamond particles (Z) in the water phase (W phase) of the (O+ultrafine diamond particle)/W emulsion composition as an advanced prototype of the (O+ultrafine diamond particle)/W emulsion composition (A-DO), and a method of producing the same, are discussed below.

(Selection Criteria of Friction Tester)

When evaluating the frictional properties, a different friction tester is used depending on the friction conditions, the appearance of the lubricant composition, and the like. A Soda pendulum type friction tester is used to evaluate a low-viscosity oiliness agent, and a high-speed four-ball tester is used to evaluate a lubricant that has a relatively low viscosity and includes an extreme pressure (EP) agent. The Soda pendulum type friction tester and the high-speed four-ball tester both are point-contact testers. Since a Falex tester is a line contact tester, the Falex tester is suitable for evaluating a lubricant including an extreme pressure agent (EP agent) and a high-viscosity grease. Therefore, it is important to select the most suitable friction tester for evaluation. A wide range of friction behavior in the actual application can be estimated from information obtained by combining the results determined by friction testers that differ in sliding contact surface. Table 12 shows the frictional properties to be evaluated in each example and comparative example, the type of testers and the operating conditions.

TABLE 12

| item | Tester | | |
|---|---|---|---|
| | Falex tester | Soda pendulum type friction tester | Shell high-speed four-ball friction tester |
| Evaluation method | Wear resistance/depletion test | Friction coefficient/friction fatigue | Surface state/specific wear rate |
| Example | Wear resistance: 1-3, 11, and 12<br>Depletion test: 9 | 1-7, 14, and 15 | 8-10, 15, and 16 |
| Comparative example | 1-4 | 1, 2, and 6-8 | 5 and 9 |
| Appearance | Wear resistance: liquid<br>Depletion test: paste-type | Liquid | Liquid |
| Practical concentration (effective base oil component concentration) | Wear resistance: 15 wt %<br>Depletion test: 50 wt % | 15 wt % | Example 8-10, 13, 15, and 16: 15 wt %<br>Example 13: anhydrous lubricant composition |
| Speed | 290 rpm | — | 1000 rpm |
| Load | 1334N | 2.94N | 490N |
| Friction time | 2700 sec | — | 1800 sec |

In Table 12, the lubrication properties of the lubricant composition evaluated using the high-speed four-ball tester is a specific wear rate calculated from the wear rate under certain conditions. In Table 12, the practical concentration is the effective base oil component concentration when measuring the lubrication properties using each friction tester. When the ultrafine diamond particles are included in the oil phase (O phase), the practical concentration is the effective base oil component concentration including the ultrafine diamond particles concentration together with the oil dispersion ultrafine diamond particle dispersant (OS) concentration. The concentration (wt %) of each additive is shown in Table 13.

After careful consideration of the nature of the above testers, when using the high-speed four-ball tester, the effective base oil component concentration when evaluating the lubrication properties was set to 15 wt % in the same manner as in the case of using the Soda pendulum type friction tester. When performing the Falex test (depletion test), the object feature (composition) of comparison of the friction test concerning the friction torque stability is a paste-type grease that adheres to the rotating pin. In this case, if the effective base oil component concentration is 15 wt %, the composition may flow down without adhering to the rotating pin. Therefore, when the object sample was provided to the depletion test using the Falex tester, the effective base oil component concentration was set to 50 wt % in the case of paste-type.

Table 13 shows the concentrations (wt %) of each additive such as the ultrafine diamond particles (ND), the oiliness improver (Y), and the solid lubricant other than the ultrafine diamond particles (Z) added and dispersed (included) in the lubricant composition to be used in the friction test by the state of the sample composition. The effective base oil component concentration (wt %) of each sample is indicated by the symbol "AI". Regarding "A-DW-DO-TY-TZ", the ultrafine diamond particle (ND) contents in the water phase (DW) and the oil phase (DO) of the lubricant composition are separately shown. The content of the water dispersion dispersant is not included in the solid content (wt %) of the ultrafine diamond particles and the solid lubricant other than the ultrafine diamond particles, as described in Example 1 and Example 2 ("Ultrafine diamond particle oil dispersion: production of base oil P-2").

TABLE 13

| Sample name | AI | ND (wt %) | Y (wt %) | Z (wt %) |
|---|---|---|---|---|
| A (base emulsion) | 15 | 0 | 0 | 0 |
| A-DW | 15 | 0.3 | 0 | 0 |
| A-DO | 15 | 0.3 | 0 | 0 |
| A-DW-DO | 15 | DW = 0.15<br>DO = 0.15 | 0 | 0 |
| A-DO-TY | 15 | 0.3 | 3.0 | 0 |
| A-DO-TZ | 15 | 0.15 | 0 | 0.15 |
| A-DO-TY-TZ | 15 | 0.15 | 3.0 | 0.15 |
| A-DW-DO-TY-TZ | 50 | DW = 0.075<br>DO = 0.075 | 3.0 | 0.15 |
| A-DW-TY | 50 | 0.3 | 3.0 | 0 |
| (Y, D, Z)O | — | 1.0 | 3.0 | 1.0 |

AI: Effective base oil component concentration (wt %)

ND: Ultrafine diamond particle

Y: Oiliness improver

Z: Solid lubricant other than ultrafine diamond particle

The "effective base oil component concentration" in the O/W emulsion does not include a component added and dispersed in the water phase (W phase). However, in Examples 8, 10, 11, 12, and 13 (anhydrous compositions, but there may be post-addition of water), the oiliness improver (Y) of the same type as the oil-soluble base oil component is added, and another O/W emulsion (TY) is formed in the water phase (W phase) to form a multiple emulsion. In this case, the concentration of the oiliness improver (Y) may be included in the effective base oil component concentration. On the other hand, since the dispersant-treated ultrafine diamond particles and the solid lubricant other than the ultrafine diamond particles (Z) dispersed in the water phase (W phase) do not form an O/W emulsion, these components are not included in the effective base oil component concentration. For example, the ultrafine diamond particle oil dispersion (base oil P-2: ultrafine diamond particle concentration: 10 wt %) used in the production of the (O+ultrafine diamond particle)/W emulsion composition (A-DO) of Example 2 is used as a part of the base oil component and thus is included in the effective base oil component concentration as the base oil component. As a matter of course, in Example 15 (base oil (solid)/dispersion composition (A-DW-(D,Z)O)) and Example 16 (base oil (oil)/composite oil dispersion composition (AY-DO-TZ)) described later, the solid lubricant other than the ultrafine diamond particles (Z) and the oiliness improver (Y) added to the oil phase (O phase) are similarly included in the effective base oil component concentration.

Figure 13:
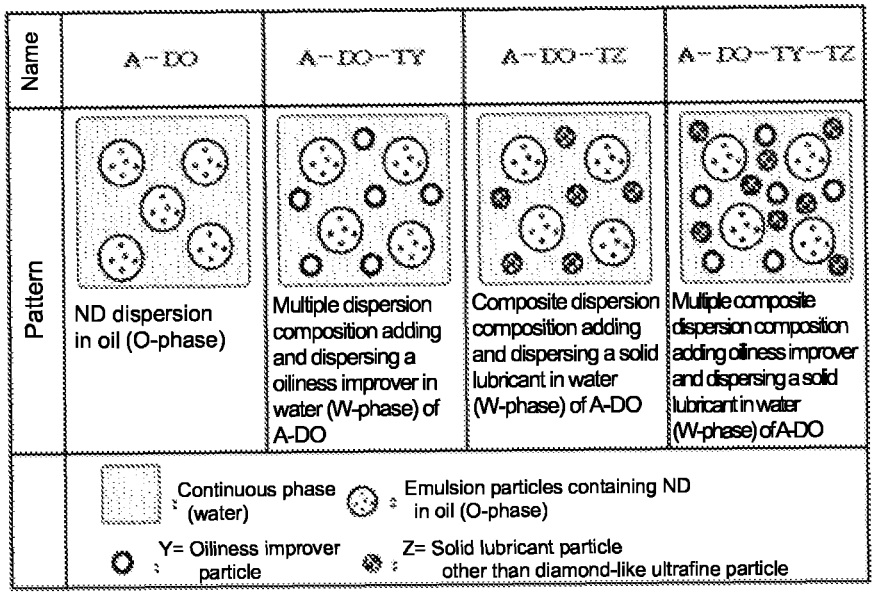
FIG. 13 is a schematic view showing various dispersion states of ultrafine diamond particles, an oiliness improver, and a solid lubricant other than the ultrafine diamond particles.

FIG. 13 is a schematic view showing various dispersion states of the ultrafine diamond particles, the oiliness improver, and the solid lubricant other than the ultrafine diamond particles. FIG. 13 schematically shows the locations of the oiliness improver (Y) and the solid lubricant other than the ultrafine diamond particles (Z) when adding and dispersing the oiliness improver (Y) and the solid lubricant other than the ultrafine diamond particles (Z) in the water phase (W phase) of the (O+ultrafine diamond particle)/W emulsion composition (A-DO) by a way of example. When adding the oiliness improver (Y) and the solid lubricant other than the ultrafine diamond particles (Z) to the O/(W+ultrafine diamond particle) emulsion composition (A-DW) or the (O+ultrafine diamond particle)/(W+ultrafine diamond particle) emulsion composition (A-DW-DO), the ultrafine diamond particles always co-exist with the added dispersion components in the water phase (W phase) of each emulsion state.

(Post-addition Method of Producing Multiple Dispersion Composition (A-DO-TY), Composite Dispersion Composition (A-DO-TZ), and the Like)

The composition is mainly produced by the following two steps. A first step includes a step of mixing the base oil components such as the base oil, the emulsifier, the surfactant (oil dispersion ultrafine diamond particle dispersant (OS)), and the ultrafine diamond particles dispersed in the oil phase (O phase), a step of subjecting to phase inversion emulsification, and a step of gradually adding water to prepare the emulsion having the desired effective base oil component concentration. A second step includes post-adding and dispersing the oiliness improver (Y) and/or the solid lubricant other than the ultrafine diamond particles (Z), in addition the dispersant-treated ultrafine diamond particle water dispersion used in the production of the O/(W+ultrafine diamond particle) emulsion composition (A-DW) described in Example 1 or the base oil P-2 used in the production of the (O+ultrafine diamond particle)/W emulsion composition (A-DO) described in Example 2 to the composition obtained by the first step, for example, to the (O+ultrafine diamond particle)/W emulsion composition (A-DO). The second step may be referred to as "post-addition method". The first step is the same as the production of the emulsion-type (opaque) composition of Example 2 with regard to the components, the composition, and the phase inversion emulsification step. The second step includes a method of obtaining the predetermined effective base oil component concentration by adding the oiliness improver (Y) and the solid lubricant other than the ultrafine diamond particles (Z) at the stage of the high-viscosity that the ratio of oil to water is 7:3 and the phase inversion emulsification has completed on the way to prepare the (O+ultrafine diamond particle)/W emulsion composition (A-DO) obtained by the first step and finally adding water, or a method of obtaining a multiple dispersion composition (TY) or a composite dispersion composition (TZ) by gradually post-adding the oiliness improver (Y) and the solid lubricant other than the ultrafine diamond particles (Z) at a low rotational speed to the (O+ultrafine diamond particle)/W emulsion composition (A-DO) obtained by adding water, that was the residual water subtracted the oiliness improver (Y) and the solid lubricant other than the ultrafine diamond particles (Z) to be post-added, and stirring the mixture. The second step has above two post-addition method, and it may implements the method appropriately selected from these methods unless otherwise indicated.

(Preparation of Multiple Dispersion Composition (A-DO-TY))

The multiple dispersion composition (A-DO-TY) was prepared as follows.

First step: 12.0 wt % of oleic acid-based oil, 8.0 wt % of methyl oleate, 10.0 wt % of the ultrafine diamond particle oil dispersion described in Example 2 (base oil P-2; ultrafine diamond particle content: 10 wt %), 3.0 wt % of polyoxyethylene (n=6 mol) oleate, and 7.0 wt % of potassium oleate were mixed. The mixture was stirred to prepare a base oil-emulsifier mixed composition. 17.0 wt % of water was added to the composition to complete phase inversion emulsification. 33.0 wt % of residual water was gradually added and stirred to obtain an opaque liquid of (O+ultrafine diamond particle)/W emulsion composition (A-DO).

Second step: 10.0 wt % of the oiliness improver (Y1) (higher amide alkylolated sulfonate calcium salt) was gradually added and stirred to the composition. 0.01 wt % of a dimethylpolysiloxane emulsion as an anti-foaming agent was finally added to the mixture to obtain a paste-type multiple dispersion composition (A-DO-TY) having an effective base oil component concentration of 50 wt %.

The addition amount of the anti-foaming agent is for the total amount of the multiple dispersion composition, and is not included in the mixing composition of the multiple dispersion composition themselves. This also applies to other examples. The amount of each additive in the effective base oil component concentration (15 wt %) used for the friction test is shown in Table 13.

In this example, a kneader as a emulsification apparatus was used to produce this type of the lubricant composition. The emulsification temperature was 50° C., the emulsification time was 20 minutes, and the stirring speed was 200 rpm. The composition was left as it was until the temperature of the lubricant composition reached at room temperature (25° C.).

(Plate-out Properties)

The "plate-out properties" obtained by adding the base oil and the oiliness improver to the (O+ultrafine diamond particle)/W emulsion composition (A-DO) were determined by a method similar to the test method disclosed in Non-patent Document 3 described above. Specifically, the lubricant compositions to be compared was applied to a platinum plate of 50 $mm^2$ put up vertically, and the amount of oil film remained attached on the platinum plate after drying was measured. The result for the composition (A-DO) without oiliness improver by post-addition was 0.24 $g/m^2$, and the result for the multiple dispersion composition (A-DO-TY) post-added oiliness improver was 1.72 $g/m^2$, it's amount by post-additon increased by about 7.2 times. These results suggest that it is preferable to post-add the oiliness improver to the water phase (W phase) of the (O+ultrafine diamond particle)/W emulsion composition (A-DO) in order to obtain the excellent plate-out properties and lubrication properties are thus improved.

Figure 14:
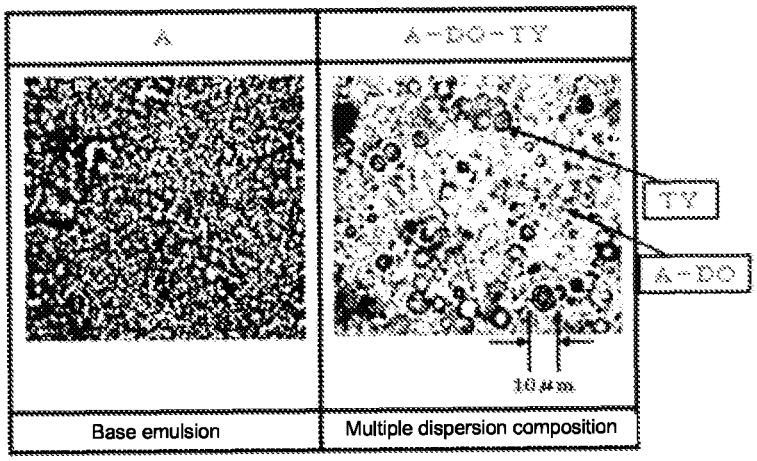
FIG. 14 shows micrographs of emulsion particles of a base emulsion (A) and a multiple dispersion composition (A-DO-TY).

FIG. 14 shows micrographs of the emulsion particles of the base emulsion (A) and the multiple dispersion composition (A-DO-TY). These micrographs show the emulsion states of oil droplets produced by the Emulsification by the PIT-method and in addition newly produced by the post-addition method in comparison. The base emulsion (A) shown in FIG. 14 was produced by the Emulsification by the PIT-method. The multiple dispersion composition (A-DO-TY) shown in FIG. 14 was produced by post-adding the oiliness improver (Y) to the (O+ultrafine diamond particle)/W emulsion composition (A-DO) produced by the Emulsification by the PIT-method in the same manner as the base emulsion (A). The emulsion particles (TY) of the oiliness improver which were post-added were apparently larger than the (A-DO) emulsion particles produced by the Emulsification by the PIT-method.

(Evaluation of Lubrication Properties Using Shell High-speed Four-ball Friction Tester)

As a test method for evaluating the friction properties, the Soda pendulum type friction tester was used to evaluate the friction coefficient, and the Falex tester was used to evaluate the wear scar behavior and the wear rate. However, the Soda pendulum type friction tester has disadvantages in that the reliability of the absolute value of the friction coefficient decreases when the friction coefficient is 0.1 or less, and high viscous lubricant cannot be evaluated. On the other hand, the Falex tester also has disadvantages in that the testing conditions such as applied load and speed are limited. It is found that since the multiple, the composite, and the multiple-composite dispersion composition obtained by post-adding the oiliness improver and/or the solid lubricant other than the ultrafine diamond particles has remarkably excellent frictional properties, it is difficult to evaluate the properties using these methods.

The inventors have found that the Shell high-speed four-ball friction tester that evaluates a lubricant used under severe conditions, such as oil-soluble additive, grease, and extreme-pressure agent (EP agent) or the like can be used to evaluate the lubrication properties of an O/W water-soluble lubricant consisting of fat and oil, and soap (see Non-patent Document 2). Therefore, the Shell high-speed four-ball friction tester was used to evaluate the lubrication properties of the multiple dispersion composition, the composite dispersion composition, and the multiple-composite dispersion composition.

In the Shell high-speed four-ball friction test the higher the seizure load (seizure resistance) is, the better lubricant it is. The peaks equivalent to the load-carrying capacity brought about by the seizure may appear in the initial or middle stage of the process of increasing pressurization until the final seizure occur. This phenomenon is also observed in the Falex test similarly, and the wear scar has the characteristic feature of adhesive wear or abrasive wear. This means only that the test ball fortunately endure till the final severe seizure may occur even if once it has seized. Therefore, it would not be appropriate to evaluate and compare the final seizure load itself as a reliable lubrication property.

Therefore, as a result of earnest studies, the inventors concluded that it is appropriate to evaluate the lubrication properties based on the wear rate, and determined to evaluate the lubrication properties based on the specific wear rate for which the evaluation accuracy can be achieved even if the evaluation time (corresponding to friction distance) necessary for evaluating the friction properties is short. The specific wear rate ($mm^2/N$) is a value (wear volume ($mm^3$)/load (N)× friction distance (mm)) obtained by dividing the wear volume ($mm^3$), which is obtained by geometrically calculating using the measured width of the wear scar, by "load (N)×friction distance (mm)" The specific wear rate allows relative evaluation even when the friction conditions which the load and the friction distance are the parameters differ each other. The above evaluation method also has an advantage in that the friction surface of adhesive wear and abrasive wear that occurs under high-load conditions can be visually observed in addition to the wear rate. Therefore, the above evaluation method is optimum for characteristic evaluation in the micromachining and ultraprecision machining fields where partial destruction of the surface directly affects the lubrication function and the lubrication properties.

The width of the wear scar was measured in the direction perpendicular to the friction direction of the fixed ball at a constant magnification. The average value of two balls with a small difference in measured value was taken as the width of the wear scar. The distance between reference lines of a glass micrometer (0.1 mm) image was measured with calipers at the same scale size, and the width of the wear scar was calculated by proportional calculations.

The testing conditions of the Shell high-speed four-ball friction tester were as follows.

Hard ball diameter: 0.5 inches
Material: SUJ2 (Japanese industrial standard)
Hardness: HRC 62 to 63
Surface roughness: 0.02 to 0.04 μm (Rmax)
Load: 490 N (constant)
Rotational speed: 1000 rpm (constant)
Time: 1800 seconds (constant)

(Lubrication Properties of Multiple Dispersion Composition (A-DO-TY) Determined Using Shell High-speed Four-ball Friction Tester)

The effective base oil component concentration of the dispersion composition subjected to the friction test was 15 wt %, as explained in Table 13. The dispersion composition having an effective base oil component concentration of 50 wt % was diluted with distilled water, and used for evaluating the lubrication properties. Table 14 shows the lubrication property evaluation results for the multiple dispersion composition (A-DO-TY) using the Shell high-speed four-ball friction tester in comparison with the (O+ultrafine diamond particle)/W emulsion composition (A-DO). The specific wear rate was significantly decreased by adding the oiliness improver to the water phase (W phase) of (A-DO). A decrease in specific wear rate was also confirmed to occur when adding the oil dispersion ultrafine diamond particle dispersant (OS) (not shown in the table). The oil dispersion ultrafine diamond particle dispersant (OS) and the base oil may be added to the oiliness improver (Y) at the same time.

When adding molybdenum dithiocarbamate (Y2) as the oiliness improver (Y) to the water phase (W phase) of the (O+ultrafine diamond particle)/W emulsion composition (A-DO), the specific wear rate was equal to or less than half of that of the (O+ultrafine diamond particle)/W emulsion composition (A-DO). Table 14 shows the specific wear rate of the multiple dispersion composition (A-DO-TY) in comparison with the (O+ultrafine diamond particle)/W emulsion composition (A-DO).

TABLE 14

| Sample name | Specific wear rate ($\times 10^{-9}$) |
|---|---|
| A-DO | 3.19 |
| A-DO-TY2 | 1.48 |

A-DO: (O + ultrafine diamond particle)/W emulsion composition
Y2: Molybdenum dithiocarbamate Table 15 shows the addition effects of the oiliness improver to the base emulsion (A) that did not include the ultrafine diamond particles in the oil phase (O phase) for comparison with this example. Table 15 also shows the addition effects of the solid lubricant other than the ultrafine diamond particles (described later). The specific wear rate significantly decreased by adding the oiliness improver to the water phase (W phase) of the base emulsion (A). However, the multiple dispersion composition (A-DO-TY) was much more excellent in the absolute value thereof. Table 15 shows the effects of addition of the oiliness improver and the solid lubricant other than the ultrafine diamond particles to the water phase (W phase) of the base emulsion (A) on the specific wear rate.

TABLE 15

| Sample name | Specific wear rate ($\times 10^{-9}$) |
|---|---|
| A | 56.12 |
| A-SY1 | 27.38 |
| A-SY-2 | 6.57 |
| A-SZ1 | 7.42 |
| A-SZ2 | 9.36 |

A: Base emulsion
Y1: Higher amide alkylolated sulfonate calcium salt
Y2: Molybdenum dithiocarbamate
Z1: Melamine cyanulate (average particle size: 5.0 μm)
Z2: Polytetrafluoroethylene (average particle size: 5.0 μm)

Examples of the oiliness improver (Y) post-added to the multiple dispersion composition (A-DO-TY) include alkyl (Cn) fatty acids, alkyl (Cn) alcohols, alkyl (Cn) fatty acid esters, alkyl (Cn) amines, polyhydric alcohol partial esters, polyhydric alcohol full esters, and the like. Further, a composite, a complex reaction product, a polymer, an oxide, a condensate, a metal salt, and the like of one or more of the above compounds are preferable. Note that the oiliness improver (Y) is not limited thereto insofar as the oiliness improver (Y) reduces friction in the boundary lubrication region. It is also possible to use the hydrocarbon oil (P-1), animal or vegetable fats and oils (V), a synthetic oil (S), or the like that is the base oil component having no polar group described above insofar as the above compound may be formed under any lubrication condition. As an extreme pressure agent (EP agent), zinc dialkyldithiophosphates (ZnDTP), molybdenum dithiocarbamate (organomolybdenum), and paraffin wax chlorinated paraffins that do not fall under the substances specified by the PRTR or PoHS are preferable.

Note that the above compounds and composition are merely exemplified, and the extreme pressure agent is thus not limited thereto.

As a sulfur compound, a partial sulfide of the alkyl chain or the functional group of the base oil (P-1), animal or vegetable fats and oils (V), a synthetic oil (S), an oil dispersion ultrafine diamond particle dispersant (OS), or the like, or the water dispersion ultrafine diamond particle dispersant (WS) that is dissolved in the oil dispersion ultrafine diamond particle dispersant (OS), may be used. Similarly as a phosphorus compound, a compound that is partially ester- or ether-bonded to the alkyl chain or the functional group of the base oil (P-1), animal or vegetable fats and oils (V), a synthetic oil (S), an oil dispersion ultrafine diamond particle dispersant (OS), or the like may be used. Further, a composite, a complex reaction product, a polymer, an oxide, a condensate, a metal salt, and the like of one or more of the above compounds are preferable. It is not preferable to use a substance that falls under the substances specified by any regulation on environmental conservation (PoHS, PRTR, and the like). However, such a substance may be used as an exception when an alternative substance has not been developed, or when used in a completely closed system. For example, molybdenum dithiocarbamate (organomolybdenum) used as the oiliness improver in the friction test of Example 8 (lubricant composition) corresponds to the exception. However, molybdenum dithiocarbamate exhibits excellent frictional properties, and thus molybdenum dithiocarbamate may be used in a completely closed system in conformity with regulations. It is still more preferable that the oiliness improver (Y) have an HLB value of 8 or less. Note that the oiliness improver (Y) is not limited thereto. If the total of the addition concentrations (by weight) of the base oil components P-1 and P-2 included in the O/W emulsion, the oil dispersion ultrafine diamond particle dispersant (OS), the emulsifier (EM) for the base emulsion (A), and the like and the oiliness improver (Y) to be newly post-added (the water dispersion ultrafine diamond particle dispersant (WS) is included in the base oil components to be added as described in Example 2 "Ultrafine diamond particle oil dispersion: production of base oil P-2") exceeds 75 wt %, an O/W/O composition may be obtained, that is, a water-soluble composition may not be obtained. Therefore, it is preferable that the sum of the concentration by weight of the oiliness improver (Y) and the effective base oil component concentration of the O/W emulsion composition be 75 wt % or less.

Note that the sum of the concentration of the oiliness improver (Y) and the effective base oil component concentration may be 75 wt % or more according to the application (e.g., an application in which it is desired to improve the lubrication properties and the secondary properties unduly), although the dispersibility to water is insufficient.

Example 9

Composite Dispersion Composition (A-DO-TZ)

(Preparation of Composite Dispersion Composition (A-DO-TZ))

When preparing the composite dispersion composition (A-DO-TZ), water is gradually added after phase inversion emulsification in the same manner as in the case of preparing the multiple dispersion composition to achieve the desired effective base oil component concentration. The amount of water used to achieve the desired effective base oil component concentration is the amount subtracted the amount (wt %) of the solid lubricant (Z) post-added.

Hydrophilic solid lubricant particles and the like (e.g., hydrophilic solid lubricant particles prepared by hydrophilizing the solid lubricant (Z) using a dispersant in water in advance, and removing water from the resulting product, or non-treated particles when the particle surface is hydrophilic) may be used as the solid lubricant other than the ultrafine diamond particles (Z) in the same manner as in the preparation of the hydrophilic ultrafine diamond particles (water dispersion ultrafine diamond particle solid lubricant) of Example 2. The water dispersion dispersant is not included in the solid concentration of the solid lubricant other than the ultrafine diamond particles (Z) added and dispersed in the water phase (W phase). The hydrophilic solid lubricant particles are added to the water phase (W phase) of the O/W emulsion (A-DO) including the ultrafine diamond particles in the oil phase (O phase) by post-addition according to the similar preparation process as in the preparation of the multiple dispersion composition of Example 8 to prepare the composite dispersion composition (A-DO-TZ). According to the circumstances, an aqueous dispersion of obtained by adding and dispersing the hydrophilic solid lubricant particles to water may be post-added to the (O+ultrafine diamond particle)/W emulsion composition (A-DO) produced by phase inversion emulsification in the same manner as in the preparation of the (O+ultrafine diamond particle)/(W+ultrafine diamond particle) emulsion composition (A-DW-DO) of Example 3, and stirred to prepare the composite dispersion composition (A-DO-TZ). Note that the steps of the method of this example are merely examples for obtaining the composition according to the present invention. Specifically, the steps of the method according to the present invention are not limited thereto.

First step: 20.0 wt % of oleic acid-based oil, 15.5 wt % of methyl oleate, 5.0 wt % of the ultrafine diamond particle oil dispersion of Example 2 (base oil P-2; ultrafine diamond particle concentration: 10 wt %), 3.5 wt % of polyoxyethylene (n=6 mol) oleate, and 6.0 wt % of potassium oleate salt were mixed. The mixture was stirred to prepare an emulsion composition. 21.0 wt % of water was added to the composition to complete phase inversion emulsification.

Second step: After the addition of 28.5 wt % of residual part of water, 0.5 wt % of melamine cyanulate (Z1) was gradually added to the mixture to obtain a paste-type composite dispersion composition (A-DO-TZ) having an effective base oil component concentration of 50 wt %. 0.01 wt % of a dimethylpolysiloxane emulsion was finally added to the mixture as an anti-foaming agent. The amount of each additive in the effective base oil component concentration (15 wt %) used for the friction test is shown in Table 13.

(Lubrication Properties of Composite Dispersion Composition (A-DO-TZ) Determined using Shell High-speed Four-ball Friction Tester)

Frictional properties when composing the ultrafine diamond particles in the oil phase (O phase) and the solid lubricant other than ultrafine diamond particles in the water phase (W phase)

Table 16 shows the lubrication property evaluation results for the composite dispersion composition (A-DO-TZ) in the same manner as in the case of the multiple dispersion composition using the Shell high-speed four-ball friction tester in comparison with the lubrication property evaluation results for the (O+ultrafine diamond particle)/W emulsion composition (A-DO). The specific wear rate was significantly decreased by adding the solid lubricant other than the ultrafine diamond particles to the water phase (W phase) of the (O+ultrafine diamond particle)/W emulsion composition (A-DO). When adding one solid lubricant (Z) (for example, polytetrafluoroethylene), the specific wear rate was equal to or less than half that of the (O+ultrafine diamond particle)/W emulsion composition (A-DO). Table 16 shows the specific wear rates of the composite dispersion compositions (A-DO-TZ) in comparison with the specific wear rate of the (O+ultrafine diamond particle)/W emulsion composition (A-DO).

TABLE 16

| Sample name | Specific wear rate ($\times 10^{-9}$) |
|---|---|
| A-DO | 3.19 |
| A-DO-TZ1 | 1.92 |
| A-DO-TZ2 | 1.40 |

A-DO: (O + ultrafine diamond particle)/W emulsion composition
Z1: Melamine cyanulate (Average particle size: 0.5 μm)
Z2: Polytetrafluoroethylene (Average particle size: 0.5 μm)

The specific wear rate was significantly decreased by adding the solid lubricant other than the ultrafine diamond particles to the water phase (W phase) of the base emulsion (A) as shown in Table 15 of Example 8. However, the composite dispersion composition (A-DO-TZ) was much more excellent in the absolute value thereof Examples of the solid lubricant other than the ultrafine diamond particles (Z) used for the composite dispersion composition (A-DO-TZ) include organic solid lubricants such as amino acid polyimide resins, polyamideimide resins, epoxy resins, alkyd resins, phenol resins, polyacetal resins, polyethersulfone resins, fluororesins, monoacyls, aminocarboxylic acids, basic amino acids, polyimides, amideimides, polyamides, alkyd resins, hydroxybenzene, urea, polyacetals, polyurethanes, ether sulfones, polyethers, polyethersulfones, polysulfones, melamine cyanulate, polytetrafluoroethylene, polyethylene terephthalate, organic metal complexes or the like, or inorganic solid lubricants such as metal oxides such as mica, silicon dioxide, zirconia or the like, or ceramic inorganic particles such as tungsten disulfide, molybdenum disulfide, graphite, graphite fluoride, fullerene or the like, or the like. Note that any particles having a solid lubrication function may be used, but not limited thereto. A product which is produced by a reaction in a friction environment and exhibits a solid lubrication function may also be used. It is preferable to use at least one solid lubricant (Z) having an average particle size of 5.0 μm or less.

Any of such solid lubricants may be within the scope of the present invention unless otherwise indicated. The average particle size is limited as described above so that the solid lubricant (Z) is added and dispersed in the water phase (W phase) of the O/W emulsion composition. When dispersing the solid lubricant (Z) in the oil phase (O phase), the average particle size is apparently limited by the diameter of oil droplets. The diameter of oil droplets of the emulsion-type composition is 1 to 10 nm, and the diameter of oil droplets of the microemulsion-type composition is 0.1 to 1 nm. Therefore, when dispersing the solid lubricant other than the ultrafine diamond particles (Z) in the oil phase (O phase), it is preferable that the solid lubricant (Z) have an average particle size equal to or less than ½ to 1/100 of the diameter of each emulsion type of oil droplet, for example.

When dispersing the solid lubricant other than the ultrafine diamond particles, the average particle size is an important factor for improving the lubrication properties. The addition of the ultrafine diamond particles to the oil phase (O phase) and the addition of the solid lubricant other than the ultrafine diamond particles to the water phase (W phase) synergistically affect the lubrication properties. If the solid lubricant other than the ultrafine diamond particles added to the water phase (W phase) has an average particle size of more than 5.0 μm, the effects of the ultrafine diamond particles (100 nm or less) added to the oil phase (O phase) may be locally screened and impaired. For example, the lubrication properties may decrease due to a transition to the lubrication region that corresponds to the composition (A-TZ) obtained by adding the solid lubricant other than the ultrafine diamond particles to the water phase (W phase) of the base emulsion (A). Therefore, the average particle size of the solid lubricant other than the ultrafine diamond particles added to the water phase (W phase) is preferably 5.0 μm or less, and more preferably 0.5 to 1.0 μm or less.

Note that this example merely illustrates an example of the composite dispersion composition (A-DO-TZ). The solid lubricant may be added together with the ultrafine diamond particles described in Example 1 or 3, or a plurality of types of solid lubricants may be added in combination, the state of addition is not limited to this example.

(Appearance and Color Tone Concerning Usable Viscosity Upper Limit)

The appearance and the color give a favorable impression of cleanliness, safety, and the like. In particular, it is desirable that a lubricant be white and can exert excellent lubrication properties at the same time. The lubricant composition is preferably a liquid emulsion and white in appearance. However, when being a paste-type in appearance or the like, the lubricant composition is impeditive to the lubrication system of a bearing or the like for which a light load operation region and torque stability are desired. Therefore, a lubricating behavior related to the viscosity upper limit was determined.

For one example, a composite dispersion composition of both the O/(W+ultrafine diamond particle) emulsion composition (A-DW) and the (O+ultrafine diamond particle)/W emulsion composition (A-DO) was produced in a amount that the total content of the ultrafine diamond particles and the solid lubricant other than the ultrafine diamond particles was a maximum. The concentration of each additive used in this example is not shown in Table 13.

(Summary of Preparation of A-DW-TZ(50) ("50" Indicates the Total Solid Content (wt %))

A base emulsion (A) having an effective base oil component concentration of 50 wt % was produced in the same blend ratio as the O/(W+ultrafine diamond particle) emulsion composition (A-DW) of Example 1. The ultrafine diamond particles (solid concentration: 10 wt %) were gradually added in the water phase (W phase) of 50 wt % of the base emulsion (A) in the form of a water dispersion ultrafine diamond particle solid lubricant, and the mixture was sufficiently kneaded. 40 wt % (solid concentration) of a solid lubricant other than the ultrafine diamond particles (polytetrafluoroethylene: Z2) was gradually added in the water phase (W phase), and the mixture was sufficiently kneaded to obtain a paste-type composite dispersion composition (C-DW-TZ (50)) in which the total solid concentration of the two components added in the water phase (W phase) was 50 wt %, and the total concentration of the components other than water was 75 wt %. The appearance of the composition was light gray close to white, and the consistency was 4 or more (in conformity with JIS).

(Specific Preparation Method of A-DO-TZ(50))

A composition (A-DO-TZ(50)) was prepared in the same manner as the emulsion-type (O+ultrafine diamond particle)/W emulsion composition (A-DO) of Example 2, using the same base oil components as the emulsion composition (A-DO) of Example 2, except for using an oil dispersion ultrafine diamond particle solid lubricant instead of the base oil P-2 used in Example 2. The solid lubricant other than the ultrafine diamond particles was added and dispersed in the water phase (W phase) of the resultant composition by using post-addition method. The details of the preparation process are described below.

First Step:

The blending amount of the base oil component described above (the ratio of the emulsifier with respect to the base oil components is preferably 2 or more) was adjusted so that the solid concentration of the ultrafine diamond particles was 10 wt % to produce an emulsion base oil component in which the ultrafine diamond particles were dispersed in the form of the oil dispersion ultrafine diamond particle solid lubricant. 21 wt % of adjusting water was added to 50 wt % of the emulsion base oil component including the ultrafine diamond particles to effect phase inversion emulsification into an O/W composition. Finally 29 wt % of adjusting water was gradually added to obtain an (A-DO) composition. The effective base oil component concentration was 50 wt.

Second Step:

47.5 wt % of the solid lubricant other than the ultrafine diamond particles (polytetrafluoroethylene: Z2) was gradually added in 50 wt % of the (A-DO) composition obtained by the first step. Finally, 2.5 wt % of distilled water was gradually added thereto while stirring to obtain a composite dispersion composition (A-DO-TZ(50)) in which the total concentration of the components other than water was 72.5 wt %, and the total of two solid concentration was 50 wt %. The composition was a paste-type composition having a consistency of 4 or more. Though the composition did not easily spread over the friction surface and had restrictions on its use, the color tone of the composition was light gray close to white and the composition was confirmed to give a very favorable impression.

The friction test was performed using the Shell high-speed four-ball friction tester in a state in which the sample was sufficiently applied to the four balls. The specific wear rates of the composite dispersion composition (A-DW-TZ(50)) and the composite dispersion composition (A-DO-TZ(50)) were $16.82\times10^{-9}$ and $11.20\times10^{-9}$, respectively, (i.e., excellent lubrication properties were confirmed). Therefore, these compositions can be sufficiently used in terms of color tone under conditions where the viscous resistance is not limited in a usage environment. It was confirmed that these compositions undergo self-emulsification upon addition of water, therefore, it is possible to wash out them with water. Blackening significantly occurs when the total content of the ultrafine diamond particles and the solid lubricant other than the ultrafine diamond particles exceeds 50 wt %. It is preferable that the total content of the solid lubricant other than the ultrafine diamond particles added and dispersed in the water phase (W phase) of the composite dispersion composition or the multiple-composite dispersion composition and the ultrafine diamond particles included in the O/W emulsion composition including the ultrafine diamond particles be 50 wt % or less from the viewpoint of the favorable impression of the color of the lubricant composition.

(Lubrication Properties of Composite Dispersion Composition (A-DO-TZ) Determined Using Falex Tester)

Figure 15:
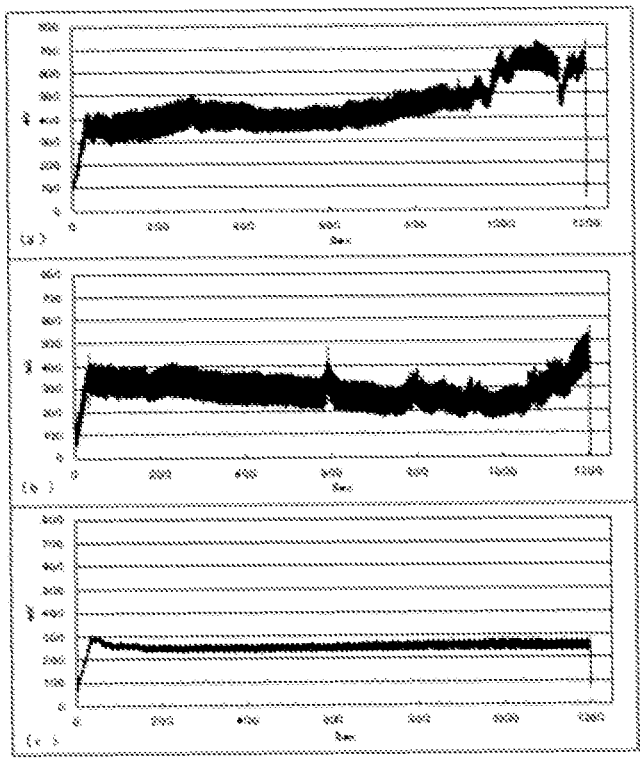
FIG. 15 is a view showing the lubrication stability of lubricant compositions of Example 9 and Comparative examples 3 and 4.

FIG. 15 is a view showing the lubrication stability of the lubricant compositions of Example 9 and Comparative examples 3 and 4. FIG. 15 shows the lubrication stability test results based on the friction torque for a commercially available Li grease (Comparative example 3), a commercially available Li grease in which the ultrafine diamond particles were dispersed (Comparative example 4), and the composite dispersion composition (A-DO-TZ) (Example 9) in which tungsten disulfide was added to the water phase (W phase) as the solid lubricant other than the ultrafine diamond particles.

The Falex test is normally performed by introducing the lubricant sample into the oil cup attached to the tester, and performing a wear test in a state in which the test piece is immersed in the lubricant sample. The inventors repeatedly measured the friction coefficient ten times (reciprocating) using the Soda pendulum type friction tester in a state in which the test piece is immersed in the oil cup at first, after that repeatedly performed again the pendulum test ten times (reciprocating) in an almost dry state that the lubricant sample was completely removed from the cup to determine the friction behavior under depletion conditions as the severe conditions more. In the depletion test of the Falex test, the lubricant sample was not introduced into the oil cup. 1 ml of the lubricant sample was directly applied to the test piece, and the wear test was performed in the state assuming a depletion state. FIG. 15 is a friction torque graph showing the friction torque stability of the lubricant composition according to the present invention determined by the Falex test in comparison with that of a commercially available grease and the like. The vertical axis of the graph indicates the output (mv) (raw data) of the Falex test that corresponds to the friction torque (N·m) obtained from the expression. FIGS. 15(*a*), 15(*b*), and 15(*c*) show the results for the commercially available Li grease, the commercially available Li grease in which the ultrafine diamond particles were dispersed, and the composite dispersion composition (A-DO-TZ), and the friction torque widths (described later) were 0.41 N·m, 0.46 N·m, and 0.07 N·m, respectively.

The test was performed under the conditions of a temperature of 20° C., a rotational speed of 290 rpm, and a load of 1334 N for 20 minutes. For example, the friction torque became unstable with the lapse of the test time (horizontal axis) when using the commercially available Li grease (a). A number of peaks indicating seizure occurred. When using the commercially available Li grease in which the ultrafine diamond particles were dispersed, the friction torque was also unstable with time.

On the other hand, the friction torque of the composite dispersion composition (c) (A-DO-TZ: effective base oil component concentration: 50 wt %) prepared by adding 0.5 wt % of tungsten disulfide ($WS_2$; average particle size: 0.5 μm) to the water phase (W phase) of the (O+ultrafine diamond particle (solid concentration: 0.5 wt %)/W emulsion composition (A-DO) was significantly lower than those of the commercially available Li grease and the like. A peak corresponding to the load-carrying capacity did not occur (i.e., excellent stability with time was obtained). As is clear from the results for the maximum/minimum output width (my; raw data) obtained by the Falex test per each time, a change in friction torque (friction torque width) of the composite dispersion composition (A-DO-TZ) per unit time was significantly small. The friction torque width of each sample was calculated from the maximum/minimum output width (mV) when 5 minutes had elapsed after starting the Falex test. The friction torque width (0.07 N·m: extremely low value) of the composite dispersion composition (A-DO-TZ) was about one-sixth of that of the commercially available product.

Therefore, the composite dispersion composition is a lubricant composition that exhibits extremely high lubrication stability, and can minimize a change in rotation torque and the tolerances for machining & other processing.

A water-soluble lubricant normally undergoes seizure when water undergoes nuclear boiling due to frictional heat. The present water-soluble lubricant composition was stable and did not undergo seizure due to the behavior similar to oil, even if water was immediately evaporated by frictional heat. It was thus confirmed that the composite dispersion composition (A-DO-TZ) exhibits excellent lubrication properties even in an environment in which water is evaporated.

Example 10

Multiple-composite Dispersion Composition (A-DO-TY-TZ)

(Preparation of Multiple-composite Dispersion Composition (A-DO-TY-TZ))

The multiple-composite dispersion composition (A-DO-TY-TZ) was prepared by preparing the (O+ultrafine diamond particle)/W emulsion composition (A-DO) in the same manner as in Example 2, preparing the composite dispersion composition (A-DO-TZ) of Example 9, and adding the oiliness improver (Y) to the composite dispersion composition (A-DO-TZ). The details are described below.

First Step:

15.0 wt % of oleic acid-based oil, 6.0 wt % of methyl oleate, 5.0 wt % of the ultrafine diamond particle oil dispersion described in Example 2 (base oil P-2; ultrafine diamond particle concentration: 10 wt %), 6.0 wt % of polyoxyethylene (n=6 mol) oleate, and 8.0 wt % of potassium oleate were mixed. The mixture was stirred to prepare an emulsion composition. 17.0 wt % of phase inversion water was added to the composition to complete phase inversion emulsification to obtain an (O+ultrafine diamond particle)/W emulsion composition (A-DO).

Second Step:

1. After the addition of 32.5 wt % of residual part of water, 0.5 wt % of melamine cyanulate (Z1) was gradually added to the mixture, and the mixture was stirred to obtain a paste-type (A-DO-TZ) intermediate composition similar to that of Example 9.

2. 10.0 wt % of the oiliness improver (Y1) (higher amide alkylolated sulfonate calcium salt) was added to the (A-DO-TZ) intermediate composition, and the mixture was stirred to obtain a multiple-composite dispersion composition (A-DO-TY-TZ). 0.01 wt % of a dimethylpolysiloxane emulsion was finally added to the mixture as an anti-foaming agent. The effective base oil component concentration was 50 wt %.

The amount of each additive in the effective base oil component concentration (15 wt %) used for the friction test is shown in Table 13.

(Lubrication Properties of Multiple-composite Dispersion Composition (A-DO-TY-TZ) Determined Using Shell High-speed Four-ball Friction Tester)

In order to evaluate the lubricating effects of the multiple-composite dispersion composition (A-DO-TY-TZ) including the multiple dispersion composition (A-DO-TY) and the composite dispersion composition (A-DO-TZ), a higher amide alkylolated sulfonate calcium salt was used as the oiliness improver (Y), and melamine cyanulate or polytetrafluoroethylene was used as the solid lubricant other than the ultrafine diamond particles (Z), and a comparison test was conducted. The results are shown in Table 17. The specific wear rate of a multiple-composite dispersion composition (A-DO-TY1-TZ2) prepared using a higher amide alkylolated sulfonate calcium salt as the oiliness improver (Y1) and polytetrafluoroethylene as the solid lubricant (Z2) was $0.42\times10^{-9}$ ($mm^2/N$), The specific wear rate is lowered by equal to or less than about one-third of that of the multiple dispersion composition or the composite dispersion composition, therefore, further excellent properties were exhibited.

TABLE 17

| Sample name | Specific wear rate ($\times10^{-9}$) |
|---|---|
| A-DO | 3.19 |
| A-DO-TY1-TZ1 | 1.16 |
| A-DO-TY1-TZ2 | 0.42 |

Y1: Higher amide alkylolated sulfonate calcium salt
Z1: Melamine cyanulate (average particle size: 0.5 μm)
Z2: Polytetrafluoroethylene (average particle size: 0.5 μm)

Table 17 shows the specific wear rate of the multiple-composite dispersion composition (A-DO-TY-TZ) in comparison with the specific wear rate of the (O+ultrafine diamond particle)/W emulsion composition.

This merely illustrates an example of the multiple-composite dispersion composition (A-DO-TY-TZ). Note that the solid lubricant may be simultaneously added to the O/(W+ultrafine diamond particle) emulsion composition (A-DW) and the (O+ultrafine diamond article)/(W+ultrafine diamond particle) emulsion composition (A-DW-DO) described in Examples 1 and 3, or a plurality of types of solid lubricants may be added in combination, and thus obviously not limited to the this example. The details are described later.

Evaluation of Properties of Examples 8 to 10

Figure 16:
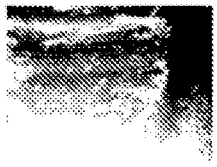
FIG. 16 is a view showing a comparison of the wear scar and the specific wear rate determined by the Shell high-speed four-ball friction test when adding an oiliness improver (Y) and a solid lubricant other than ultrafine diamond particles (Z) to the water phase (W phase) of a base emulsion (A) (Comparative example 5).
Figure 16:
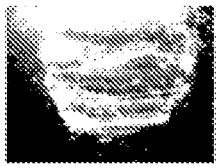
Figure 16:
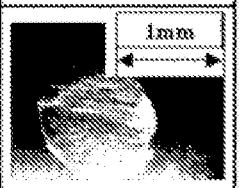

Comparison of Wear Scar and Specific Wear Rate Using Shell High-speed Four-ball Friction Tester FIG. 16 is a view showing a comparison of the wear scar and the specific wear rate determined by the Shell high-speed four-ball friction test when adding the oiliness improver (Y) and the solid lubricant other than the ultrafine diamond particles (Z) to the water phase (W phase) of the base emulsion (A) (Comparative example 5). Specifically, FIG. 16 shows a comparison of the wear scar and the specific wear rate determined by the Shell high-speed four-ball friction test when adding the oiliness improver and the solid lubricant other than the ultrafine diamond particles to the water phase (W phase) of the base emulsion (A). Comparative example 5 is the same as Examples 8 and 9, except for using the base emulsion (A) that did not include the ultrafine diamond particles in the oil phase (O phase). A higher amide alkylolated sulfonate calcium salt was used as the oiliness improver (Y1), and polytetrafluoroethylene having an average particle size of 0.5 μm was used as the solid lubricant other than the ultrafine diamond particles (Z). More specifically, FIG. 16 shows the addition effects of the oiliness improver and the solid lubricant other than the ultrafine diamond particles (Z) to the water phase (W phase) which affects to the specific wear rate of the base emulsion (A) that did not include the ultrafine diamond particles in the oil phase (O phase) for comparison with Examples 8 and 9.

Figure 17:
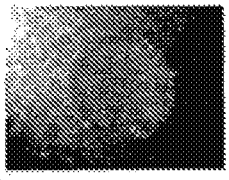
FIG. 17 is a view showing the wear scar and the specific wear rate determined by the Shell high-speed four-ball friction test for lubricant compositions of Examples 8 and 9.
Figure 17:
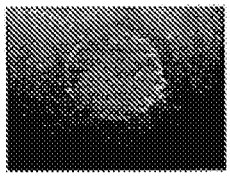
Figure 17:
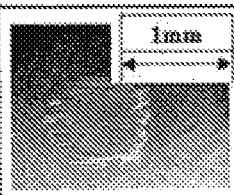

FIG. 17 is a view showing the wear scar and the specific wear rate of the lubricant compositions of Examples 8 and 9 determined by the Shell high-speed four-ball friction test. FIG. 17 shows the wear scar and the specific wear rate of the multiple dispersion composition and the composite dispersion composition of Examples 8 and 9 determined by the Shell high-speed four-ball friction test in comparison with them each other. FIG. 17 also shows the wear scar and the specific wear rate of the (O+ultrafine diamond particle)/W emulsion composition (A-DO) for comparison with the addition effects (synergistic effects) of the oiliness improver (Y) and the solid lubricant other than the ultrafine diamond particles (Z) to the water phase (W phase).

The wear scar diameter was confirmed to be significantly decreased by adding the oiliness improver (Y) and the solid lubricant other than the ultrafine diamond particles (Z) to the water phase (W phase) of the (O+ultrafine diamond particle)/W emulsion composition.

Figure 18:
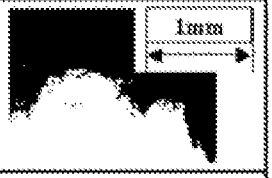
FIG. 18 is a view showing the wear scar and the specific wear rate determined by the Shell high-speed four-ball friction test for a lubricant composition of Example 10.

FIG. 18 is a view showing the wear scar and the specific wear rate of the lubricant composition of Example 10 of the present invention determined by the Shell high-speed four-ball friction test. FIG. 18 is a view showing the wear scar and the specific wear rate of the multiple-composite dispersion composition of Example 10 determined by the Shell high-speed four-ball friction test. Example 10 illustrates an example of the optimal configuration. The size of the wear scar was most minimized among the examples by adding the oiliness improver (Y) and the solid lubricant other than the ultrafine diamond particles (Z) to the water phase (W phase) of the (O+ultrafine diamond particle)/W emulsion composition simultaneously.

(Analysis of Friction Surface of the Lubricant Compositions of Examples 8 and 9 Using Shell High-speed Four-ball Friction Test)

In order to clarify the excellent lubrication properties of Examples 8 and 9, the lubrication mechanism was determined by observing the friction surface in the Shell high-speed four-ball friction test similar to the Falex test.

Figure 19:
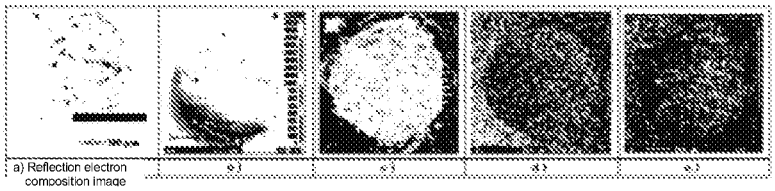
FIG. 19 shows the EPMA analysis results of the friction surface (wear scar) of the ball in Shell high-speed four-ball friction test for a lubricant composition of Example 8.

FIG. 19 shows the EPMA analysis results of the ball friction surface for the multiple dispersion composition (A-DO-TY2) of Example 8 of the present invention in the Shell high-speed four-ball friction test. a) indicates a backscattering electron image of the ball friction surface. Elements having a small atomic number are concentrated in the contact surface of the balls (black area). b) to e) show the results for the characteristic X-ray intensity distribution of iron (corresponds to b)), carbon (corresponds to c)), molybdenum (corresponds to d)), and sulfur (corresponds to e)) in order to determine the elements concentrated in the wear scar among the constituent elements of the ball material (SUJ2) and the multiple dispersion composition. c) indicates that carbon was clearly concentrated in the wear scar. It was also found that molybdenum (d)) and sulfur (e)) were concentrated in the wear scar although their uniformity of distribution was inferior to that of carbon. The detected molybdenum and sulfur were derived from molybdenum dithiocarbamate (organomolybdenum) which was the oiliness improver (Y2) in the multiple dispersion composition.

Figure 20:
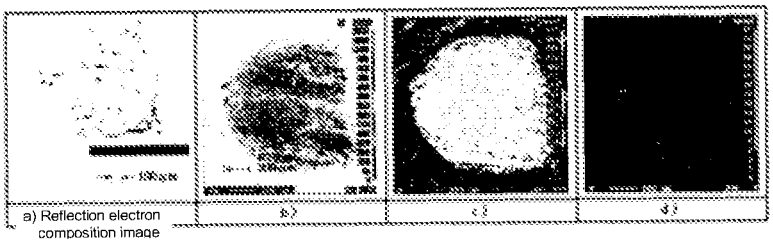
FIG. 20 shows the EPMA analysis results of the friction surface (wear scar) of the ball in Shell high-speed four-ball friction test for a lubricant composition of Example 9.

FIG. 20 shows the EPMA analysis results of the ball friction surface for the composite dispersion composition (A-DO-TZ2) of Example 9 by the Shell high-speed four-ball friction test. It was confirmed that carbon was concentrated on the friction surface similar to the multiple dispersion composition in FIG. 19 (the backscattering electron image a) and characteristic X-ray image (carbon) c) are well correspond with each other). A small amount of fluorine (corresponds to d)) which derived from polytetrafluoroethylene was further detected in the carbon concentration area (the contact surface of the balls) concentrated degrees of carbon in the character X-rays image When comparing the degree of carbon concentration with the characteristic X-ray image, though being qualitative, the degree of carbon concentration appropriately corresponds to the amount of ultrafine diamond particles added and dispersed in the oil phase (O phase) of each of the multiple dispersion composition (c) in FIG. 19) and the composite dispersion composition (c) in FIG. 20) (see Table 13). What is interesting is a relative comparison of the characteristic X-ray intensities (corresponds to b) in FIGS. 19 and 20) of iron which is main element of the friction test ball, it is found that the carbon concentration layer (coating layer) of the multiple dispersion composition of Example 8 is consisted of the ultrafine diamond particles, iron, a small amount of Mo, and a small amount of S, and the carbon concentration layer of Example 9 is mainly consisted of the ultrafine diamond particles and the elements derived from polytetrafluoroethylene. It was thus confirmed that the configuration of the carbon concentration layer (coating layer) can be arbitrarily changed by variously changing the configuration and the blending composition of the lubricant composition according to the present invention.

These results suggest that the lubrication properties (for example, specific wear rate) of the lubricant composition according to the present invention can be arbitrarily and easily controlled by designing the configuration of the carbon concentration layer (coating layer) based on the configuration and the blending composition of the lubricant composition. Therefore, there is provided a guideline in which the lubricant composition can be effectively used in every tribological fields.

Figure 21:
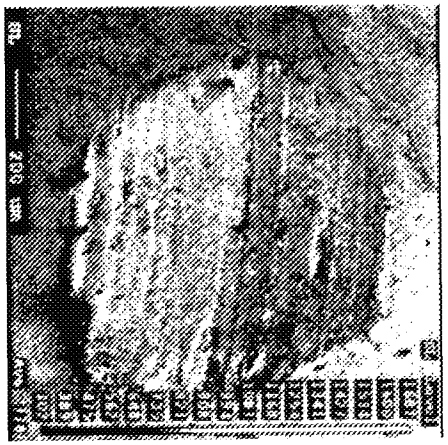
FIG. 21 shows a electron microscope secondary electron image of the friction surface (wear scar) of the ball in Shell high-speed four-ball friction test for a lubricant composition of Example 9.

FIG. 21 shows a secondary electron image of the carbon concentration layer (coating layer) of the composite dispersion composition (A-DO-TZ2) of Example 9.

The carbon concentration layer is confirmed to have very smooth surface properties corresponding to the low specific wear rate ($1.40\times10^{-9}$) determined by the Shell high-speed four-ball friction test. The above feature completely differs from the conventional lubricant composition that forms an abrasive friction surface (specific wear rate: $1\times10^{-7}$ or more) described later as comparative example in FIG. 24. It was confirmed that the specific wear rate is correlated with the surface properties (smoothness) of the friction area.

The structure of the carbon concentration layer was identified by micro-Raman spectroscopy similar to determining the structure of the carbon concentration layer formed by the Falex test for the (O+ultrafine diamond particle)/W emulsion composition (A-DO). A Raman shift attributed to the diamond bond at around 1332 $cm^{-1}$ was observed.

The above results suggest that the improvement in lubrication properties (decrease in specific wear rate) of the multiple dispersion composition and the composite dispersion composition occurs due to composite concentration of the ultrafine diamond particles added to the oil phase (O phase) and the oiliness improver and the solid lubricant other than the ultrafine diamond particles added to the water phase (W phase) in the wear track.

It was found that according to FIG. 6, the ultrafine diamond particles form a concentration layer on the block friction surface in the Falex test for the (O+ultrafine diamond particle)/W emulsion composition (similar effect is also observed in the pin-side), and furthermore according to FIG. 19 (multiple dispersion composition) and FIG. 20 (composite dispersion composition), products arising from the oiliness improver and the solid lubricant other than the ultrafine diamond particles added and dispersed in the water phase (W phase) in addition to the ultrafine diamond particles are also compositely concentrated in the friction area, and a composite coating layer is formed under the friction conditions including a pre-conditioning interim operation or the like or with the lapse of friction time to improve lubrication properties. The concentration layer is not removed by a washing treatment or even strong ultrasonic irradiation as a pretreatment of EPMA analysis, and remains in the friction area as a strong coating layer. The ultrafine diamond particles are nanoparticles having an average particle size of 100 nm or less, and exhibiting improved frictional properties by a dispersant treatment. Therefore, even if the ultrafine diamond particles are removed from the friction area during friction or sliding, another new friction area is not damaged, and rather the removed ultrafine diamond particles form a new coating concentration layer. This feature may be referred to as "self-repair function". The coating layer formed by the ultrafine diamond particles completely differs in properties (in the viewpoint of a lubrication coating forming method as a new concept) from a coating layer formed by known surface treatment technology, such as CVD, PVD, plating, and any other coating methods (for example, if cracks or a microfracture has occurred in a part of the hard coating layer, the fragment thereof may bring about deadly destruction on the friction surface). As a result, it is possible to eliminate the issue of substrate (coated friction surface material) selectivity (substrate selectivity has been normally dealt with by inserting an intermediate layer) that results in a decrease in adhesion of the conventional hard coating layer or an increase in breakage susceptibility (microfracture due to tensile strain). Therefore, it is possible to deal with most substrates, such as metal, ceramic, glass, polymer, rubber. Moreover, a coating layer can be easily and inexpensively formed in a friction area having a complex shape.

It was thus confirmed that the lubricant composition according to the present invention is very useful for forming a coating layer in various applications for which wear resistance, lubrication properties, cooling properties, chemical stability of the lubrication component, and the like are desired, for example, cutting tool and the like can be given (frictional heat generated between the cutting face and chip is reduced by utilizing the lubricant composition as a cutting oil, and the life of the tool is improved by suppressing crater wear. Moreover, the residual strain of the affected layer is reduced. When performing low-speed cutting, formation of a built-up edge is suppressed, and the dimensional accuracy of the cutting face of the workpiece is improved. Moreover, effect of preventing the destruction of the tool may be obtained). Although an example of forming a composite coating layer using the multiple dispersion composition and the composite dispersion composition has been described, this is merely an example. Similar effects of forming a coating layer can be obtained using an arbitrary lubricant composition according to the present invention. Therefore, the present invention is not limited to this example.

Effects of Lubricant Compositions of Examples 8 to 10

The lubricant compositions of Examples 8 to 10 are a multiple dispersion composition (TY) or a composite dispersion composition (TZ) obtained by post-adding the oiliness improver (Y) or the solid lubricant other than the ultrafine diamond particles (Z) to the water phase (W phase) of the O/W emulsion composition including the ultrafine diamond particles, or a multiple-composite dispersion composition (TY-TZ) including together both the multiple dispersion composition (TY) and the composite dispersion composition (TZ). This makes it possible to provide a lubricant composition that implements stabilization of the rotation torque and minimization of the tolerances for machining & other processing that cannot be achieved by a conventional water-soluble lubricant, and exhibits excellent wear resistance in a high-load friction environment.

Example 11

Another Multiple-composite Dispersion Composition (A-DW-DO-TY-TZ)

The friction behavior of the (O+ultrafine diamond particle)/(W+ultrafine diamond particle) emulsion composition (A-DW-DO) of Example 3 was evaluated based on the pin wear rate determined by the Falex test as shown in Table 10 as Examples 1 to 3. When the average particle size of the ultrafine diamond particles is 40 nm, the (O+ultrafine diamond particle)/(W+ultrafine diamond particle) emulsion composition (A-DW-DO) has a problem that its pin wear rate is higher than that of the O/(W+ultrafine diamond particle) emulsion composition (A-DW) and the (O+ultrafine diamond particle)/W emulsion composition (A-DO). However, the friction coefficient lowers with advance of fatigue when evaluating the friction fatigue behavior using the pendulum test. The friction coefficient was a minimum as a result in the friction fatigue test (depletion test) (A-DW-DO-Dry), that is, the emulsion composition (A-DW-DO) was a lubricant with high reliability. If the frictional properties are balanced or inversely correlated due to the average particle size, the wear rate clearly decreases by reducing the average particle size of the ultrafine diamond particles to 40 nm or less. However, this renders the lubricant composition more expensive. In order to clarify the possibility that even the ultrafine diamond particles having an average particle size of 40 nm exhibit friction properties equal to those of the ultrafine diamond particles having a smaller average particle size, synergistic effects due to post-addition and a combination of various post-addition configuration and additional components were investigated. Specifically, a multiple-composite dispersion composition (A-DW-DO-TY-TZ: paste-type) was prepared by further adding the oiliness improver and the solid lubricant other than the ultrafine diamond particles to the water phase (W phase) of the (O+ultrafine diamond particle)/(W+ultrafine diamond particle) emulsion composition (A-DW-DO) in which the ultrafine diamond particles having an average particle size of 40 nm were dispersed in the oil phase (O phase) and the water phase (W phase), and a reduction effect in pin wear rate was investigated using the Falex test.

The concrete production process of the multiple-composite dispersion composition (A-DW-DO-TY-TZ) of the present example is as follows.

The (O+ultrafine diamond particle)/W emulsion composition was first prepared according to Example 2. It is necessary to prepare a paste-type composition in order to perform the depletion test of the Falex test. Therefore, the effective base oil component concentration was set to 50 wt %. The details of the production process are described below.

First Step:

18.0 wt % of oleic acid-based oil (rapeseed oil), 15.0 wt % of methyl oleate, 0.75 wt % of the ultrafine diamond particle oil dispersion of Example 2 (base oil P-2; ultrafine diamond particle concentration: 10 wt %), 5.25 wt % of polyoxyethylene (n=6 mol) oleate, and 8.0 wt % of potassium oleate were mixed. The mixture was stirred to prepare an emulsion composition. 20.0 wt % of phase inversion water was added to the composition to complete phase inversion emulsification to obtain a composition (A-DO). A kneader was used to produce the composition.

Second Step:

1. Next, 0.15 wt % of polytetrafluoroethylene (Z2) as the solid lubricant other than the ultrafine diamond particles was gradually added to the (A-DO) composition described above. The mixture was stirred to obtain a composite dispersion composition (A-DO-TZ).

2. Moreover, 3.0 wt % of higher amide alkylolated sulfonate calcium salt (Y1) as the oiliness improver was gradually post-added to the above composite dispersion composition (A-DO-TZ), and the mixture was stirred to obtain a multiple-composite dispersion composition (A-DO-TY-TZ).

3. A dispersant-treated ultrafine diamond particle water dispersion (ultrafine diamond particle concentration: 5 wt %) was prepared in the same manner as in Example 1, specifically, by mixing 5 wt % of the ultrafine diamond particles with the composition concentration of 2.5 times, 2.5 wt % of a polyoxyethylene alkyl ether carboxylate (anionic dispersant), 2.5 wt % of a fatty acid ester (nonionic dispersant), and 90 wt % of water.

4. 1.5 wt % of the dispersant-treated ultrafine diamond particle water dispersion having a solid concentration of 5 wt % (second step, (3)) was added to the multiple-composite dispersion composition (A-DO-TY-TZ) that did not include the ultrafine diamond particles in the water phase (W phase) (second step, (2)) to obtain a multiple-composite dispersion composition (A-DW-DO-TY-TZ) including the ultrafine diamond particles and polytetrafluoroethylene in the water phase (W phase) thereof 5. Finally, 28.35 wt % of water was added to the multiple-composite dispersion composition (A-DW-DO-TY-TZ) (obtained by the above second step (4)), and the mixture was stirred to obtain another multiple-composite dispersion composition (A-DW-DO-TY-TZ) having an effective base oil component concentration of 50 wt %. A dimethylpolysiloxane emulsion was added to the mixture as an anti-foaming agent.

The amount of each additive in the effective base oil component concentration (50 wt %) used for the friction test is shown in Table 13.

The pin wear rate was decreased by one digit by adding the oiliness improver and the solid lubricant other than the ultrafine diamond particles to the water phase (W phase) of the (O+ultrafine diamond particle)/(W+ultrafine diamond particle) emulsion composition (A-DW-DO) to obtain a multiple-composite dispersion composition.

Example 12

Another Multiple Dispersion Composition (A-DW-TY)

Similar to Example 11, in order to evaluate a reduction effect in pin wear rate using the Falex test, another multiple dispersion composition (A-DW-TY) was prepared by adding the oiliness improver to the water phase (W phase) of the O/(W+ultrafine diamond particle) emulsion composition (A-DW) in which the ultrafine diamond particles were dispersed in the water phase (W phase). The effective base oil component concentration was set to 50 wt % in the same manner as in Example 11 in order to perform the depletion test by Falex test.

The concrete production process of the multiple dispersion composition (A-DW-TY) of the present example is as follows.

First Step:

18.0 wt % of oleic acid-based oil (rapeseed oil), 15.0 wt % of methyl oleate, 6.0 wt % of polyoxyethylene (n=6 mol) oleate, and 8.0 wt % of potassium oleate were mixed. The mixture was stirred to prepare an emulsion composition. 20.0 wt % of phase inversion water was added to the composition to complete phase inversion emulsification to obtain a base emulsion (A). A kneader was used to produce the composition.

Second Step:

1. 3.0 wt % of higher amide alkylolated sulfonate calcium salt (Y1) as the oiliness improver was gradually post-added to the base emulsion (A), and the mixture was stirred to obtain a multiple dispersion composition (A-TY) that did not include the ultrafine diamond particles in the water phase (W phase) and corresponded to the base emulsion (A).

2. A dispersant-treated ultrafine diamond particle water dispersion (ultrafine diamond particle concentration: 5 wt %) was prepared in the same manner as in Example 11, specifically, by mixing 5 wt % of the ultrafine diamond particles, 2.5 wt % of a polyoxyethylene alkyl ether carboxylate (anionic dispersant), 2.5 wt % of a fatty acid ester (nonionic dispersant), and 90 wt % of water.

3. 6.0 wt % of the dispersant-treated ultrafine diamond particle water dispersion having a solid concentration of 5 wt % was added to the multiple-composite dispersion composition (A-TY) corresponding to the base emulsion (A) that did not include the ultrafine diamond particles in the water phase (W phase) to obtain a multiple dispersion composition (A-DW-TY) including the ultrafine diamond particles and the oiliness improver in the water phase (W phase).

4. Finally, 24.0 wt % of water was added to the multiple dispersion composition (A-DW-TY) including the ultrafine diamond particles and the oiliness improver in the water phase (W phase), and the mixture was stirred to obtain another multiple dispersion composition (A-DW-TY) having an effective base oil component concentration of 50 wt %. A dimethylpolysiloxane emulsion was added to the mixture as an anti-foaming agent. The amount of each additive in the effective base oil component concentration (50 wt %) used for the friction test is shown in Table 13.

As the result of Falex test, the pin wear rate was decreased to about half same as in Example 11 in comparison with that of the composition with no addition by adding the oiliness improver to the water phase (W phase) of the O/(W+ultrafine diamond particle) emulsion composition (A-DW).

It was confirmed that a composite dispersion composition (A-DW-TZ) obtained by adding the solid lubricant other than the ultrafine diamond particles to the water phase (W phase) of the O/(W+ultrafine diamond particle) emulsion composition (A-DW) and a multiple-composite dispersion composition (A-DW-TY-TZ) obtained by adding the oiliness improver and the solid lubricant other than the ultrafine diamond particles to the water phase (W phase) of the O/(W+ultrafine diamond particle) emulsion composition (A-DW) are another composite dispersion composition and multiple-composite dispersion composition, and can be prepared by using the steps of Example 11 and 12, respectively. The pin wear rates of both the composite dispersion composition (A-DW-TZ) and the multiple-composite dispersion composition (A-DW-TY-TZ) were together significantly lower than that of the O/(W+ultrafine diamond particle) emulsion composition (A-DW) in the depletion test by the Falex test.

In Examples 8 to 12, ultrafine diamond particles having an average particle size of 40 nm were used similar to Examples 1 to 3. As described in Examples 4 to 7, the friction coefficients of the multiple dispersion composition, the composite dispersion composition, and the multiple-composite dispersion composition were decreased by lowering the average particle size of the ultrafine diamond particles. The specific wear rate, the size of the wear scar, the friction torque, and a fluctuation range in friction torque (friction torque width) were better than those of Examples 8 to 12 even when the same composition ratio was used, or when an oiliness improver and a solid lubricant other than the above examples were used. It was confirmed that effects similar to those obtained by lowering the average particle size of the ultrafine diamond particles can be obtained by lowering the average particle size of the solid lubricant other than the ultrafine diamond particles added to the water phase (W phase).

Although Examples 8 to 12 illustrate the emulsion-type multiple dispersion composition, composite dispersion composition, multiple-composite dispersion composition and modifications thereof, similar lubrication properties can also be obtained in a microemulsion-type composition described in Examples 1 and 2 or a paste-type (grease-type) composition described in Examples 11 and 12. Note that this merely illustrates an example of the diamond lubricant composition. The diamond lubricant composition is not limited to this example.

Example 13

Anhydrous Lubricant Composition that does not Include Aqueous Component in the Components Thereof In examples 1 to 3, 8 to 12, and15 and 16 described later, phase inversion water, or water used at the last to achieve the desired effective base oil component concentration was one of the components of various emulsion compositions. Note that as a different composition and configuration, there may be provided an anhydrous lubricant composition that does not include the aqueous component in the O/W emulsion composition including the ultrafine diamond particles. The anhydrous lubricant composition may be used in an anhydrous state, or may be used in an O/W emulsion state by adding water to achieve the desired effective base oil component concentration. The anhydrous lubricant composition may include the base oil component of the base emulsion (A), the emulsifier, water or the oil dispersant-treated ultrafine diamond particles, the oiliness improver (Y), the solid lubricant other than the ultrafine diamond particles (Z) added and dispersed in the oil phase (O phase) and/or the water phase (W phase), the water dispersion dispersant, a secondary property improver, and the like. An all and arbitrary O/W emulsion composition according to the present invention including the ultrafine diamond particles can be prepared using the anhydrous lubricant composition unless otherwise indicated.

Note that a stable O/W emulsion may not be obtained if the ratio of the total content of the ultrafine diamond particles and the solid lubricant other than the ultrafine diamond particles (Z) added to the oil phase (O phase) and/or the water phase (W phase) of the anhydrous lubricant composition with respect to the base oil component (based on the definition of the effective base oil component concentration) exceeds 50 wt %. When producing the anhydrous lubricant composition, it is preferable to mix so that the total concentration of the oiliness improver (Y) and the base oil component (based on the definition of the effective base oil component concentration) also be 50 wt % or more. Specifically, important factor in the component configuration of the anhydrous lubricant composition is dispersion in water by self-emulsification, largely depends on the amount of emulsifier included in the base oil component. Therefore, it is preferable that the addition ratio of the emulsifier included in the base oil component (based on the definition of the effective base oil component concentration) be high in order to enhance the dispersibility into water. It is more preferable that the ratio of the emulsifier to the base oil component be 2 times or more. An anhydrous lubricant composition that exhibits excellent water dispersibility can be obtained by satisfying the above condition.

A current does not flow through the anhydrous lubricant composition when using a nonionic surfactant as the emulsifier for the anhydrous lubricant composition In this case, the anhydrous lubricant composition can be used as an insulating oil. Since the anhydrous lubricant composition has both non-conductivity and excellent lubricity which diamond has, the anhydrous lubricant composition can be provided as a lubricating oil used for an electrical system for which leakage current must be prevented. On the other hand, the anhydrous lubricant composition may be used as a contact improver by giving conductivity using an organic conductive substance or ultrafine diamond particles including non- or quasi-diamond carbon in a certain ratio, for example. A current does not flow through the anhydrous lubricant composition even when adding distilled water to achieve the desired effective base oil component concentration (about 8 μS (micro-siemens)). Therefore, the anhydrous lubricant composition can be used in various applications. Since the anhydrous lubricant composition has excellent biodegradability and easily emulsified with and dispersed in water, the anhydrous lubricant composition may suitably deal with when leakage may occur from a closed lubricant system. For example, the anhydrous lubricant composition may be used as a lubricating oil for a ship propeller shaft that may has high risk to the marine pollution. Since the anhydrous lubricant composition can be easily washed out with water when adhering to a human body, the anhydrous lubricant composition is highly safe composition in operation.

Although the anhydrous lubricant composition is sufficiently safe even in the example, the anhydrous lubricant composition may also be applied to machines and apparatuses used in the food field by utilizing a blending component material that can be used as a designated food additive.

The production and the lubrication properties of the anhydrous lubricant composition are described below.

(Preparation and Lubrication Properties of Anhydrous Lubricant Composition ((D,Y,Z)O))

3.0 wt % of a higher amide alkylolated sulfonate calcium salt (Y1), 10.0 wt % of the ultrafine diamond particle oil dispersion described in Example 2 (base oil P-2; ultrafine diamond particle concentration: 10 wt %), 1.0 wt % of melamine cyanulate (Z1), and 86.0 wt % of polyoxyethylene (n=9 mol) oleate were mixed. The mixture was stirred to prepare an anhydrous lubricant composition which does not contain water component.

The ratio of the emulsifier with respect to the total ((P-2)+Y1) of the base oil P-2 and the oiliness improver was about 7 times. The anhydrous lubricant composition had a viscosity of 62.3 cSt (40° C.). The sedimentation time of the solid lubricant other than the ultrafine diamond particles (melamine cyanulate) having an average particle size of 0.5 μm was measured. The solid lubricant deposited sediment within one hour when the viscosity of the anhydrous lubricant composition was 40 cSt or less (40° C.). Therefore, a viscosity necessary for maintaining the dispersion stability of a solid lubricant having a high specific gravity and a large average particle size is preferably 40 cSt or more (40° C.).

The anhydrous lubricant composition ((D,Y,Z)O) must be a self-emulsifying composition (microemulsion-type (B) or paste-type (grease-type) (C) composition classified by the particle size of the emulsified product described in Example 1) that is easily emulsified and dispersed upon addition of water.

Therefore, the amount of the emulsifier (EM) for the base emulsion (A) is equal to or larger than about seven times with respect to the total amount of the base oil P-2 and the oiliness improver. The anhydrous lubricant composition has every component constitution and various configuration composition elements, and it may be thus applied to a case where the oil phase (O phase) includes the oiliness improver (Y), the ultrafine diamond particles (or the oil dispersion ultrafine diamond particle solid lubricant), and the solid lubricant other than the ultrafine diamond particles (Z) (e.g., BY-(D,Z)O), or a case where the solid lubricant other than the ultrafine diamond particles (Z) and the ultrafine diamond particles (or the water dispersion ultrafine diamond particle solid lubricant) are dispersed in the water phase (W phase) (e.g., B-DW-DO-TZ), see Examples 15 and 16 described later in addition to the configurations of Examples 1 to 3 and 8 to 12. In order to prepare a microemulsion-type composition (B) in which the solid lubricant other than the ultrafine diamond particles (Z) and the ultrafine diamond particles (or the water dispersion ultrafine diamond particle solid lubricant) are dispersed in the water phase (W phase), self-emulsification is implemented using an aqueous dispersion of dispersing the dispersant-treated ultrafine diamond particle water dispersion (DW) of Example 1, or the dispersant-treated solid lubricant other than the ultrafine diamond particles (Z) water dispersion, and water is further added to achieve the desired effective base oil component concentration, or the solid lubricant may be post-added to the composition. The lubrication properties may be expected to be improved by adding the base oil component or the oiliness improver (Y), or changing the composition ratio.

In order to determine the frictional properties of the anhydrous lubricant composition using the high-speed four-ball friction tester, an anhydrous lubricant composition (whole components concentration: 100 wt %) was produced, and an O/W emulsion composition including ultrafine diamond particles was also produced by adding water to the anhydrous lubricant composition. The latter composition configuration prepared by adding water was an O/W emulsion composition (BY-(D,Z)O) including ultrafine diamond particles similar to (AY-(D,Z)O) prepared by adding the oiliness improver and the solid lubricant other than the ultrafine diamond particles to the oil phase (O phase) of an O/W emulsion composition including ultrafine diamond particles described later in Example 16. When preparing the latter, 85 wt % of an aqueous component was gradually added to 15 wt % of the anhydrous lubricant composition, and the mixture was sufficiently stirred until a homogenous mixture was obtained. The concentration of the ultrafine diamond particles was 0.15 wt %, and the concentration of the solid lubricant (Z1) other than the ultrafine diamond particles was also 0.15 wt %. The total solid lubricant particle concentration was 0.3 wt %, and the concentration of the oiliness improvers (Y1) was 0.45 wt %.

Note that though water was used as a dilution component for adjusting the concentration in the example, a part of the water phase (W phase) may be replaced by a hydrophilic solvent. Examples of the hydrophilic solvent include a commercially available anti-freeze solution, glycerol, oligosaccharides, polysaccharides, and the like. Specifically, the water phase (W phase) of the O/W emulsion composition is not limited to water alone. A hydrophilic solvent may be used instead of dilution water used in each example to achieve the desired concentration.

The specific wear rate of the O/W emulsion composition including the ultrafine diamond particles obtained by adding water to the anhydrous lubricant composition was $2.985\times10^{-9}$ $mm^2/N$, that is, excellent lubrication properties similar to those of the (A-DO) composition were confirmed.

The anhydrous lubricant composition is expected to exhibit excellent lubrication properties as is. Further, when subjecting the anhydrous lubricant composition to the friction test using the high-speed four-ball friction tester, a specific wear rate was $7.42\times10^{-9}$ $mm^2/N$. The lubrication properties of the anhydrous lubricant composition were equal to those of the composition obtained by adding the solid lubricant other than the ultrafine diamond particles to the water phase (W phase) of the base emulsion (A), and were significantly superior to those of a commercially available mineral oil-based lubricant (MOCl (MOCL)) obtained by adding a chlorinated paraffin to a commercially available grease or machine oil including ultrafine diamond particles (described later as a comparative example). Note that this merely illustrates an example of the configuration of the anhydrous lubricant composition. The anhydrous lubricant composition is not limited to this example.

Example 14

Verification as the Lubrication Improver or Coating Agent Utilizing Coating Function of Lubricant Composition According to the Present Invention Though it may be best way to alternate the conventional lubricant composition with the lubricant composition of the present invention as described above, the function of the lubricant composition according to the present invention whereby a sliding friction surface is coated as coating layer with the ultrafine diamond particles, the solid lubricant other than the ultrafine diamond particles, and the like may be used in the field for which an improvement in lubrication properties is important even if environmental preservation is adversely affected, or may be used as a pretreatment agent (e.g., a pretreatment agent for a pre-conditioning interim operation) in the field of a biodegradable lubricant that has not been widely used due to poor lubrication properties. For example, the lubricant composition according to the present invention may be used as various lubricants, such as vehicle lubricating oil, marine engine oil, various industrial lubricating oil, solid lubricant, synthetic lubricating oil, grease, metal working lubricant, rust-preventing oil, heating medium oil, and rubber processing oil and the like represented by a conventional mineral oil-based straight oil as shown in Comparative Example 2 (FIG. 11) and a grease as shown in Comparative Example 3 (FIG. 15) and classified into the lubricant category.

For example, a biodegradable lubrication coating layer (biodegradability function is only effective for the base oil and other additives and the like except for the solid substance) is formed by performing a pre-conditioning interim operation using the lubricant composition according to the present invention, removing the lubricant composition (biodegradable components) by washing with water, and drying the product (it is possible to directly dry without water washing). The lubricant composition can be supplied in the same manner as a conventional straight oil. Therefore, excellent lubrication properties can be obtained by a very simple operation.

Figure 22:
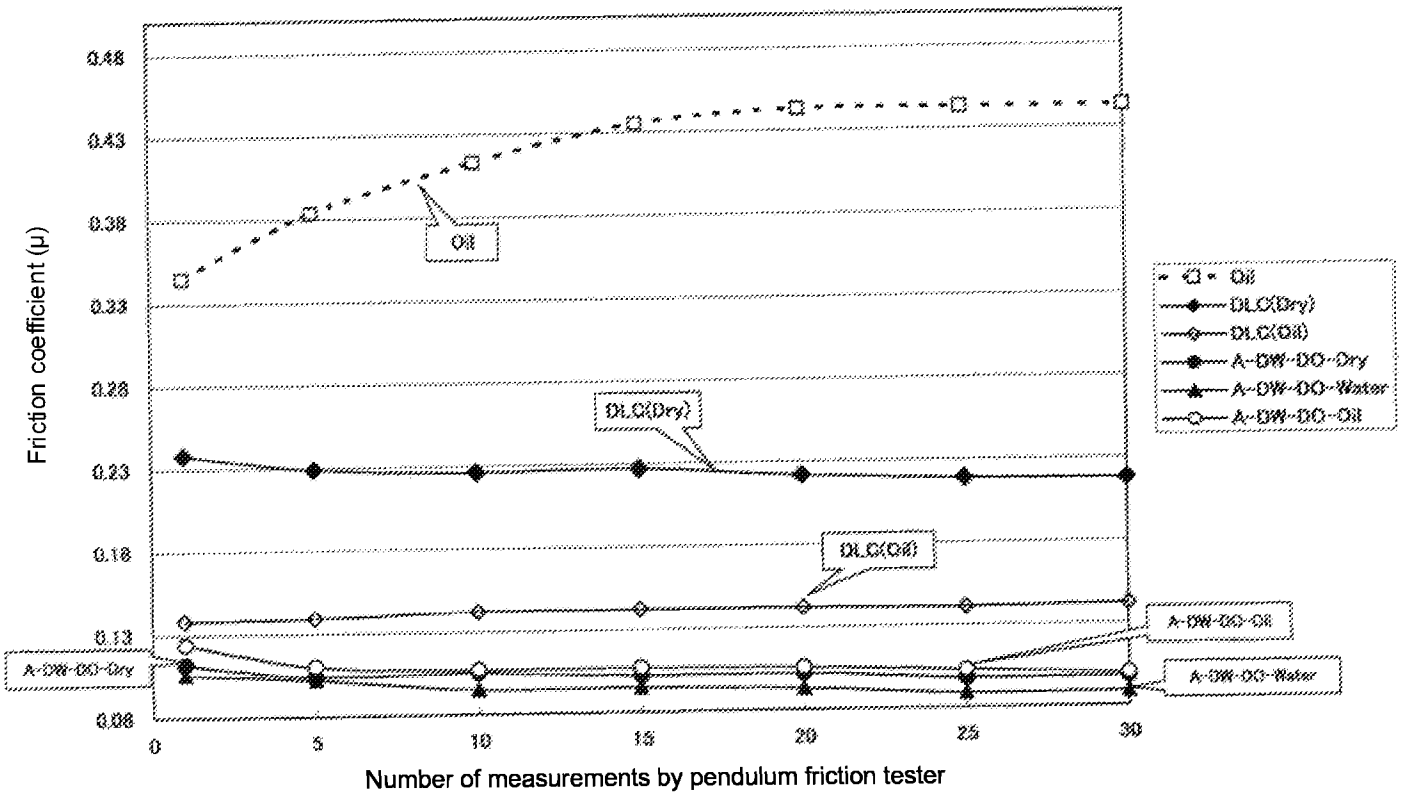
FIG. 22 shows the effects of a lubricant composition as a lubrication improver or a coating agent by friction fatigue properties determined by the Soda pendulum tester.

FIG. 22 shows the effects of the lubricant composition according to the present invention as a lubrication improver or a coating agent, in particular as friction fatigue properties determined by the Soda pendulum test shown in Examples 1 to 3. When performing the coating treatment according to the Soda pendulum test, the lubricant composition according to the present invention was applied to the pin side of the specimen. As a comparison, a Si-doped diamond-like carbon film (DLC film: Diamond Like Carbon film) was formed on the pin side of the specimen, and subjected to the friction fatigue test. As the lubricant composition according to the present invention used as a lubrication improver or a coating agent, specifically the (O+ultrafine diamond particle)/(W+ultrafine diamond particle) emulsion composition (A-DW-DO) described in detail in Example 3 was used. The effective base oil component concentration was 15 wt %, the average particle size of the ultrafine diamond particles added and dispersed in the water phase (W phase) and the oil phase (O phase) was 40 nm, and the total ultrafine diamond particle concentration was 1 wt %. A lubrication improving treatment or a coating treatment was performed as follows, and the friction fatigue properties were then measured. When subjecting a conventional straight oil (corresponds to "Oil") in FIG. 22 to the friction test, an untreated pin (normal specification) was used as a reference since the DLC film exhibits excellent lubrication properties in oil. An isoparaffin with a viscosity of 2.4 cSt (40° C.) was used as test oil. (Coating treatment steps using the lubricant composition)

First Step (Coating Treatment):

The pin of the specimen was subjected to the coating treatment as follows. A cup was filled with the (O+ultrafine diamond particle)/(W+ultrafine diamond particle) emulsion composition (A-DW-DO), and the friction test was repeatedly performed 10 times (reciprocating). The measurement was performed using the same specimen without changing.

Second Step (Drying Pin of Specimen Subjected to Coating Treatment):

The pin was taken out after the friction test, and the lubricant composition was applied and fixed or embedded on the pin as a coating layer. In detail, the following methods should be continuously selected, that is, the pin may be washed with water, and then dried using a drier (method 1), or may be dried in a state in which the lubricant composition adheres to the pin (method 2). In this example, the pin was dried by removing only water using the latter method. The coating treatment was thus completed. The coating-treated pin was then subjected to (1) a dry test (unlubricated condition), (2) an in-oil test, and (3) an in-water test.

(Friction Test Method)

(1) Unlubricated Condition (Dry) Test Method:

The dry test is a friction test that corresponds to the lubricant depletion test (the cup is empty) as a lubrication reliability test in Examples 1 to 3, but is performed under severer conditions in order to determine the life of the coating layer. The pendulum friction fatigue test was performed by setting the coated pin and replacing the ball to the new product, and measuring up to 30 times (reciprocating times: measurement was conducted by each 5 reciprocating) as the final measurement (Coating treatment case).

(2) In-oil Test Method:

When performing the friction test in a conventional straight oil, the cup was filled with an isoparaffin, and the pendulum friction fatigue test was performed in oil by setting the coated pin in a same manner as above and using a new ball (in the case of lubrication properties improving treatment).

The measurement conditions for the pendulum friction fatigue test after the lubrication properties improving treatment or the coating treatment were the same as described above.

(3) In-water Test Method:

In an environment in which an unlubricated state and friction in water alternately occur (described later), it is fear that the lubrication properties may decrease due to dissolution of the lubricant composition of the invention in water after the coating treatment. Therefore, in order to confirm the lubrication life and reliability, the cup was filled with water, and the pendulum friction fatigue test was also performed in water. The measurement conditions were the same as described above.

In FIG. 22, the pendulum friction fatigue test samples subjected to a different friction environment after the lubrication properties improving treatment or the coating treatment are indicated by "A-DW-DO-Dry" (unlubricated conditions after the coating treatment), "A-DW-DO-Oil" (friction in oil after the lubrication properties improving treatment), or "A-DW-DO-Water" (friction in water after the coating treatment) respectively.

The friction fatigue properties of the sample indicated by "A-DW-DO-Dry" correspond well the results obtained by the lubricant depletion test of Example 3. It was confirmed that the repeatability of forming the coating layer was very high, and the repeatability of the friction fatigue property was thus very high. The results after the lubrication properties improving treatment for the friction in oil "A-DW-DO-Oil" indicate that a significant decrease in friction coefficient nearly equal to that of the unlubricated conditions "A-DW-DO-Dry" is possible after the lubrication properties improving treatment even when using an oil having poor lubrication properties (isoparaffin: Comparative example 6) (see "Oil" and "A-DW-DO-Oil" in FIG. 22). The above results suggest a lubrication property improving effect as a pretreatment agent on any conventional known lubricant including a conventional straight oil and a grease (Comparative example 3) shown in Example 9 (see "Lubrication properties of composite dispersion composition (A-DO-TZ) determined using Falex tester" in Example 9). An excellent lubrication properties improving effect on the commercially available lubricating oil was confirmed by the similar method. The above results suggest that seizure and the like can be prevented even in an unstable oil friction environment in which the boundary lubrication state of a lubricating oil agent intermittently occurs, by combining the friction fatigue property results for the sample indicated by "A-DW-DO-Oil" after the lubrication properties improving treatment and the friction fatigue property results for the sample indicated by "A-DW-DO-Dry" after the coating treatment, so that the operation stability of a machine system or mechanical system and the like can be significantly improved. In this example, common inexpensive high carbon chromium steel (as a hard wear-resistant material) was used as the material for the pin and the ball (test pieces) used in the Soda pendulum test of this example. Specifically, an inexpensive material can be used instead of an expensive material such as gunmetal, sintered metallic alloy, cemented carbide or the like that has been used for a bearing and the like. Therefore, the economical effect is very high.

The friction fatigue properties of the sample in an unlubricated state indicated by "DLC (Dry)" after a DLC film was formed on the pin as described in Comparative example 7 in the figure, and the friction fatigue properties of the sample indicated by "DLC (Oil)" after a DLC film was similarly formed on the pin, regarding the friction in isoparaffin oil (Comparative example 8) did not exceed the results for the present invention. A considerable damage and partial avulsion removal were observed for the DLC film after the friction fatigue test.

A standby pump bearing environment is an example of an environment in which an unlubricated state and friction in water alternately occur. Since an idling unlubricated state and a high-load condition are necessary as premises for preventing water pollution in this environment, it has been difficult to deal with such a situation even if conventional surface treatment technology including DLC film describes above is used. According to the present invention, however, the standby pump bearing operation environment can be reproduced by combining the results for the sample indicated by "A-DW-DO-Water" (friction in water after the coating treatment) and the sample indicated by "A-DW-DO-Dry" (unlubricated conditions after the coating treatment), so that excellent lubrication properties can be implemented without using an expensive material.

The coating layer can be easily repaired by periodically supplying the lubricant composition, and performing an idling operation. Moreover, water pollution does not occur even by washing with water (biodegradability). The economical effect including maintenance is significantly high. When comparing the results for the sample indicated by "A-DW-DO-Water" (friction in water after the coating treatment) with the results for the sample indicated by "A-DW-DO-Dry" (unlubricated conditions after the coating treatment), it was found that the friction fatigue properties are further improved. Therefore, even in a severe environment in which an unlubricated state and friction in water alternately occur, the bearing can be provided with high lubrication properties by utilizing the lubricant composition as a coating agent, so that it can be proved that the system operation reliability can be significantly improved.

Examples of the application field that utilizes the coating agent, the coating method, the coating layer, a member or a device having the coating layer, and a system using the same include various industrial and public welfare fields, such as a coating for various office automation apparatuses for which contamination with oil is not desired, a hard disk positioning device, a high-speed journal bearing, a ball screw for precise positioning or a machine tool, a artificial joint for which biocompatibility is required, a ball of a ballpoint pen and a fastener, a bicycle chain, gear conversion mechanism, and light, a mouse for a computer, an automotive wiper and tire, and the like. The lubricant composition may also be used for gear spalling and chipping countermeasures (prevention), rail shelling countermeasures, smearing (congregation of minute seizure that occurs in a rolling bearing) countermeasures, ship screw cavitation countermeasures, solid particle erosive wear countermeasures, and fretting wear countermeasures. Moreover, the lubricant composition drastically revolutionizes a known solid lubrication configuration using a solid with low shear strength, such as $MoS_2$, graphite, PTFE, polyimide, silver, lead, $CaF_2$ and the like to a large extent, and makes it unnecessary to take into account a change in viscosity depending on the pressure and viscosity index as the temperature characteristics of a lubricating oil. When applying the lubricant composition to a bearing, it reduces the burden of design technology that optimizes the amount and flow of a lubricating oil for reducing stirring resistance, rolling viscous resistance, and the like. Note that this merely illustrates an example. A similar effect can be achieved by the lubrication properties improving treatment or the coating treatment using any other configuration of the lubricant composition according to the present invention. Therefore, the present invention is not limited to this example.

Examples 15 to 16

Another Advanced Emulsion Composition

As another advanced O/W emulsion lubricant composition including the ultrafine diamond particles, the inventors found that a lubricant composition (which has a configuration further controlled inside of the oil phase (O phase)) obtained by adding the oiliness improver or the solid lubricant other than the ultrafine diamond particles to the Oil phase (O phase) of the O/W emulsion composition including the ultrafine diamond particles exhibits more excellent lubrication properties as compared with the O/W emulsion composition including the ultrafine diamond particles (A-DO, A-DW, or A-DW-DO). This finding has also led to the completion of another invention of the present invention.

(Combination of Other Emulsion Compositions)

As example of the Another advanced emulsion composition, a composition obtained by adding the "oiliness improver" (Y) to the Oil phase (O phase) of the O/W emulsion composition (A-DO) including the ultrafine diamond particles in the oil phase (O phase) is referred to as "base oil (oil)/oil dispersion composition (AY-DO)", a composition obtained by adding the solid lubricant other than the ultrafine diamond particles (Z) is referred to as "base oil (solid)/oil dispersion composition (A-(D,Z)O)", and a composition obtained by adding both the oiliness improver (Y) and the solid lubricant other than the ultrafine diamond particles (Z) is referred to as "base oil (oil-solid)/oil dispersion composition (AY-(D,Z)O)". It attempted to explain briefly by thus giving symbols similar to the case of the configuration added to water phase (W phase). The term "oil dispersion composition" indicates that the ultrafine diamond particles are added and dispersed in the oil phase (O phase). A composition in which the ultrafine diamond particles are dispersed in the water phase (W phase) is referred to as "base oil (oil)/water dispersion composition (AY-DW)", for example. Note that a composition in which the ultrafine diamond particles are dispersed in the oil phase (O phase) and the water phase (W phase) is referred to as " . . . /dispersion composition" (corresponds to Example 15 described later). A composition obtained by adding the solid lubricant (Z) to the water phase (W phase) of the advanced composition is referred to as "base oil (oil)/composite oil dispersion composition (AY-DO-TZ)", "base oil (solid)/composite oil dispersion composition (A-(D,Z)O-TZ)", or "base oil (oil-solid)/composite oil dispersion composition (AY-(D,Z)O-TZ)". A composition obtained by adding the oiliness improver (Y) to the oil phase (O phase) of the composition (A-DW-DO) including (A-DO) and (A-DW) is referred to as "base oil (oil)/dispersion composition (AY-DW-DO)", a composition obtained by adding the solid lubricant (Z) is referred to as "base oil (solid)/dispersion composition (A-DW-(D,Z)O)", and a composition obtained by adding both the oiliness improver (Y) and the solid lubricant (Z) is referred to as "base oil (oil-solid)/dispersion composition (AY-DW-(D,Z)O)".

A composition obtained by adding the oiliness improver (Y) to the oil phase (O phase) of the O/W emulsion composition (A-DW) including the ultrafine diamond particles in the water phase (W phase) is referred to as "base oil (oil)/water dispersion composition (AY-DW)", a composition obtained by adding the solid lubricant other than the ultrafine diamond particles (Z) is referred to as "base oil (solid)/water dispersion composition (A-DW-ZO)", and a composition obtained by adding both the oiliness improver (Y) and the solid lubricant (Z) is referred to as "base oil (oil-solid)/water dispersion composition (AY-DW-ZO)". Similarly, for example, a composition obtained by adding the oiliness improver (Y), or the solid lubricant (Z) to the water phase (W phase) of the advanced composition (AY-DW) is referred to as "base oil (oil)/multiple water dispersion composition (AY-DW-TY)" or is referred to as "base oil (oil)/composite water dispersion composition (AY-DW-TZ)", respectively, and a composition obtained by adding both the oiliness improver (Y) and the solid lubricant (Z) is referred to as "base oil (oil)/multiple-composite water dispersion composition (AY-DW-TY-TZ)". This also applies to other combinations and may be called in the same way symbolized as described above.

The lubricant compositions of Examples 15 and 16 corespond to a base oil (oil) composition family obtained by adding the oiliness improver (Y) to the oil phase (O phase) of the O/W emulsion composition including the ultrafine diamond particles, a base oil (solid) composition family obtained by adding the solid lubricant other than the ultrafine diamond particles (Z), a base oil (oil-solid) composition family obtained by adding both the oiliness improver (Y) and the solid lubricant other than the ultrafine diamond particles (Z), and a composition obtained by post-adding the oiliness improver (Y) to the water phase (W phase) of the advanced composition, a composition obtained by post-adding the solid lubricant other than the ultrafine diamond particles (Z), and a composition obtained by post-adding both the oiliness improver (Y) and the solid lubricant other than the ultrafine diamond particles (Z). These lubricant compositions are a multiple, composite or multiple-composite water dispersion composition, or oil dispersion composition, further a combination thereof. According to Examples 15 and 16, it is possible to provide a lubricant composition that has an excellent specific wear rate and a small friction coefficient that cannot be achieved by a conventional water-soluble lubricant. It is also possible to provide excellent effects similar to those of the multiple dispersion composition, the composite dispersion composition, and the multiple-composite dispersion composition obtained by adding the oiliness improver (Y) and/or the solid lubricant other than the ultrafine diamond particles (Z) to the water phase (W phase) of the O/W emulsion composition including the ultrafine diamond particles.

Example 15

Base oil (Solid)/Dispersion Composition (A-DW-(D,Z)O) Including Ultrafine Diamond Particles in O Phase and W Phase As another advanced lubricant composition comprising an O/W emulsion lubricant composition including the ultrafine diamond particles, the inventors prepared an (O+ultrafine diamond particle+solid lubricant other than the ultrafine diamond particles)/(W+ultrafine diamond particle) emulsion composition (A-DW-(D,Z)O) including the ultrafine diamond particles and the solid lubricant other than the ultrafine diamond particles in the oil phase (O phase) and including the ultrafine diamond particles in the water phase (W phase), wherein part of the ultrafine diamond particles added and dispersed in the oil phase (O phase) of the O/W emulsion composition was replaced with fullerene (stable carbon allotrope). The composition was subjected to the friction test. The average particle size of the fullerene was 40 nm. The particle was a aggregate consisted from primary particle diameter of several nanometers. The effective base oil component concentration was set to 15 wt % similar to Example 14.

The total solid concentration of the water phase (W phase) and the oil phase (O phase) was 1 wt %, and the weight ratio of the ultrafine diamond particles to the fullerene in the oil phase (O phase) was 3/1. Excellent friction fatigue properties and low friction coefficient were obtained. The solid lubricant other than the ultrafine diamond particles added to the oil phase (O phase) together with the ultrafine diamond particles forms a composite coating layer, ensures long-term stabilization of the coating layer (prevents reverse transformation to carbonaceous substance or graphite, or prevents dissolution/absorption to the frictional material) by suppressing concentration of friction load on the ultrafine diamond particles (or ultrafine diamond particle coating layer fine particles) in a severe friction environment, and dispersing the friction load. Examples of a more advanced composition include a base oil (solid)/composite dispersion composition (A-DW-(D,Z)O-TZ) obtained by adding and dispersing the solid lubricant other than the ultrafine diamond particles (Z) to the water phase (W phase) of the (O+ultrafine diamond particle+solid lubricant other than the ultrafine diamond particles)/(W+ultrafine diamond particle) emulsion composition, a base oil (solid)/multiple dispersion composition (A-DW-(D,Z)O-TY) obtained by adding the oiliness improver (Y), a base oil (solid)/multiple-composite dispersion composition (A-DW-(D,Z)O-TY-TZ) obtained by adding and dispersing both the solid lubricant other than the ultrafine diamond particles (Z) and the oiliness improver (Y), a base oil (solid)/composite oil dispersion composition (A-(D,Z)O-TZ) obtained by adding and dispersing the solid lubricant other than the ultrafine diamond particles (Z) to the water phase (W phase) of the (O+ultrafine diamond particle+solid lubricant other than the ultrafine diamond particles)/W emulsion composition, a base oil (solid)/multiple oil dispersion composition (A-(D,Z)O-TY) obtained by adding and dispersing the oiliness improver (Y), and a base oil (solid)/multiple-composite oil dispersion composition (A-(D,Z)O-TY-TZ) obtained by adding and dispersing the solid lubricant other than the ultrafine diamond particles (Z) and the oiliness improver (Y). The effects of adding the ultrafine diamond particles and fullerene to the oil phase (O phase) were evaluated using the Shell high-speed four-ball friction test. It was confirmed that stable frictional properties can be achieved for a long time as compared with the case of adding and dispersing only the ultrafine diamond particles (A-DO or A-DW-DO) by adding and dispersing fullerene in the oil phase (O phase) including the ultrafine diamond particles. The friction surface was investigated in the same manner as in Examples 8 and 9 in order to evaluate the lubrication properties of the composition. It was confirmed that a composite concentration layer (coating layer) of the ultrafine diamond particles and fullerene was formed on the friction surface. It was thus found that a coating layer with lubrication properties and excellent coating layer forming effect can be similarly obtained even by adding the solid lubricant other than the ultrafine diamond particles to the oil phase (O phase). It was also found that an (O+fullerene nanoparticle)/W emulsion composition (A-ZO), an (O+fullerene nanoparticle)/(W+ultrafine diamond particle) emulsion composition (A-DW-ZO), or an (O+ultrafine diamond particle)/(W+fullerene nanoparticle) emulsion composition (A-ZW-DO) can be prepaired by replacing the ultrafine diamond particles in the oil phase (O phase) or the water phase (W phase) with fullerene and dispersing fullerene, and the lubrication properties thereof are superior than those of conventional lubricants. It was found that the lubrication properties can be further improved by further adding the oiliness improver to the oil phase (O phase) of the above emulsion composition (for example, AY-DW-ZO, AY-ZO or the like). Note that the above solid lubricant other than the ultrafine diamond particles added and dispersed in the O/W emulsion composition including the ultrafine diamond particles is merely an example of a component in the diamond containing lubricant composition. The present invention is not limited to this example.

When adding and dispersing the solid lubricant other than the ultrafine diamond particles in the oil phase (O phase), the average particle size is restricted by the diameters of oil droplets. The average particle size of the solid lubricant is preferably equal to or less than 1/10th to 1/100th the diameter of the emulsion-type oil droplets.

A configuration that achieves excellent lubrication properties may be selected from A-DW-ZO-TY, A-DW-ZO-TZ, and A-DW-ZO-TY-TZ family.

Example 16

Base Oil (Oil)/Composite Oil Dispersion Composition (AY-DO-TZ)

In Examples 8 to 12, the oiliness improver (Y) and/or the solid lubricant other than the ultrafine diamond particles (Z) was added to the water phase (W phase) of the O/(W+ultrafine diamond particle) emulsion composition (A-DW), the (O+ultrafine diamond particle)/W emulsion composition (A-DO), or the (O+ultrafine diamond particle)/(W+ultrafine diamond particle) emulsion composition (A-DW-DO), and the lubrication properties of the resulting compositions were evaluated. In example 13, the lubrication properties of the anhydrous lubricant composition ((Y,D,Z)O) were evaluated (the O/W emulsion composition including the ultrafine diamond particles that was self-emulsified by adding water was a microemulsion-type composition (BY-(D,Z)O)).

In Example 15, the solid lubricant other than the ultrafine diamond particles (Z) was added to the oil phase (O phase) of the (O+ultrafine diamond particle)/(W+ultrafine diamond particle) emulsion composition (A-DW-DO) to obtain a composition including the fine solid particles composited (A-DW-(D,Z)O) (not shown in FIG. 13). In Example 16, the oiliness improver (Y) was added first to the oil phase (O phase) of the (O+ultrafine diamond particle)/W emulsion composition (A-DO) to obtain a coexisting state of the ultrafine diamond particles and the oiliness improver (Y) in the oil phase (O phase), and to finally obtain a composition (AY-DO-TZ) the solid lubricant other than the ultrafine diamond particles (Z) was further added in the water phase (W phase) (also not shown in FIG. 13).

The base oil (oil)/composite oil dispersion composition (AY-DO-TZ) was prepared as follows.

First Step:

12.0 wt % of oleic acid-based oil, 16.0 wt % of methyl oleate, 2.5 wt % of the ultrafine diamond particle oil dispersion described in Example 2 (base oil P-2; ultrafine diamond particle concentration: 10 wt %), 10.0 wt % of a zinc dialkyldithiophosphate (ZnDTP), 3.5 wt % of polyoxyethylene (n=6 mol) oleate, and 6.0 wt % of potassium oleate were mixed. The mixture was stirred to prepare an emulsion composition. 21.0 wt % of phase inversion water was added to the composition to complete phase inversion emulsification.

Second Step:

0.25 wt % of polytetrafluoroethylene was gradually added to 28.75 wt % of residual part of water. The mixture was stirred to obtain a paste-type base oil (oil)/composite oil dispersion composition (CY-DO-TZ) having a effective base oil component concentration of 50 wt %. 0.01 wt % of dimethylpolysiloxane emulsion was added to the mixture as an antifoaming agent. The effective base oil component concentrations of the base oil (oil)/composite oil dispersion composition (AY-DO-TZ) for using the Shell high-speed four-ball friction test was 15 wt %. The concentration of the ultrafine diamond particles was 0.075 wt %, the concentration of the solid lubricant other than the ultrafine diamond particles (Z) was also 0.075 wt %. The total solid concentration of the oil phase (O phase) and the water phase (W phase) was 0.15 wt %. The concentration of the oiliness improver was 3.0 wt %.

(Lubrication Properties and Friction Surface Analysis of Base Oil (Oil)/Composite Oil Dispersion Composition (AY-DO-TZ) by Shell High-speed Four-ball Friction Tester)

The effective base oil component concentration of the composition subjected to the friction test was 15 wt %. The composition prepared as described above and having an effective base oil component concentration of 50 wt % was diluted with distilled water and then evaluated the lubrication properties. The specific wear rate was further lowered as compared with the multiple-composite dispersion composition (A-DO-TY-TZ) described in Example 10 by adding the oiliness improver to the oil phase (O phase) of (A-DO), and adding the solid lubricant other than the ultrafine diamond particles to the water phase (W phase) of (A-DO). When adding a zinc dialkyldithiophosphate (ZnDTP) as an oiliness improver (Y) to the oil phase (O phase) of the (O+ultrafine diamond particle)/W emulsion composition (A-DO), and adding polytetrafluoroethylene to the water phase (W phase) of the above product, the specific wear rate of the resultant composition was $0.38\times10^{-9}$.

In order to investigate the more excellent lubrication properties of this example, the lubrication mechanism was determined by observing the friction surface in the Shell high-speed four-ball friction test similar to Examples 8 and 9.

Figure 23:
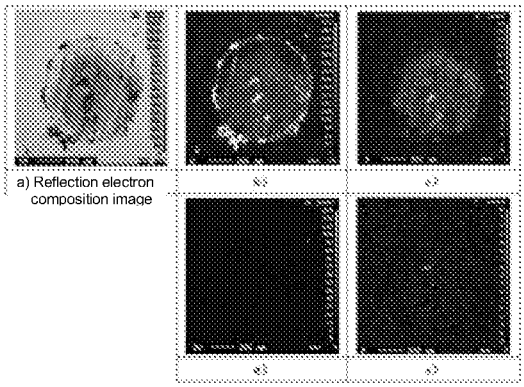
FIG. 23 shows the EPMA analysis results of the friction surface (wear scar) of the ball in Shell high-speed four-ball friction test for a lubricant composition of Example 16.

FIG. 23 shows the EPMA analysis results of the ball friction surface in the Shell high-speed four-ball friction test for the base oil (oil)/composite oil dispersion composition (AY-DO-TZ) of Example 16.

a) indicates a backscattering electron image of the ball friction surface. Elements having a small atomic number were concentrated (black area) similar to Examples 8 and 9. b) indicates the carbon characteristic X-ray intensity distribution, similarly c), d), and e) indicate the sulfur, zinc, and fluorine characteristic X-ray intensity distribution, respectively. It was confirmed that a composite concentration layer of the ultrafine diamond particles added to the oil phase (O phase), sulfur derived from the zinc dialkyldithiophosphate (ZnDTP) used as the oiliness improver (Y), and fluorine derived from polytetrafluoroethylene added to the water phase (W phase) was formed on the friction surface, taking account of identification results of the carbon concentration layer obtained by micro-Raman spectroscopy.

It was thus confirmed that the improvement in lubrication properties of the base oil (oil)/composite oil dispersion composition was bought by a multiple effect of the ultrafine diamond particles and the oiliness improver (Y) added to the oil phase (O phase) and a composite effect of the ultrafine diamond particles and the solid lubricant other than the ultrafine diamond particles (Z) added and dispersed in the water phase (W phase). Of special note is the improvement of the load-carrying capacity among the improvements in the lubrication properties of the base oil (oil)/composite oil dispersion composition (AY-DO-TZ).

Therefore, it is possible to provide a lubricant composition that improves the load-carrying capacity that cannot be improved in a conventional water-soluble lubricant, and can achieve excellent wear resistance and a small friction coefficient at the same time. This is an innovative result from the viewpoint of global warming countermeasure and environmental protection.

Although the configuration of the composition (AY-DO-TZ) that includes the oiliness improver (Y) in the oil phase (O phase), and includes the solid lubricant other than the ultrafine diamond particles (Z) in the water phase (W phase) has been described above, a configuration that achieves excellent lubrication properties may be selected from a base oil (oil)/oil dispersion composition: (AY-DO), a base oil (oil)/multiple oil dispersion composition: (AY-DO-TY), a base oil (oil)/multiple-composite oil dispersion composition: (AY-DO-TY-TZ) family, a base oil (oil-solid)/oil dispersion composition: (AY-(D,Z)O), a base oil (oil-solid)/composite oil dispersion composition: (AY-(D,Z)O-TZ), a base oil (oil-solid)/multiple oil dispersion composition: (AY-(D,Z)O-TY), a base oil (oil-solid)/multiple-composite oil dispersion composition: (AY-(D,Z)O-TY-TZ) family, a base oil (oil)/dispersion composition including the ultrafine diamond particles in the O phase and the W phase: (AY-DW-DO), a base oil (oil)/composite dispersion composition: (AY-DW-DO-TZ), a base oil (oil)/multiple dispersion composition: (AY-DW-DO-TY), a base oil (oil)/multiple-composite dispersion composition: (AY-DW-DO-TY-TZ) family, a base oil (oil-solid)/dispersion composition: (AY-DW-(D,Z)O), a base oil (oil-solid)/composite dispersion composition: (AY-DW-(D,Z)O-TZ), a base oil (oil-solid)/multiple dispersion composition: (AY-DW-(D,Z)O-TY), and a base oil (oil-solid)/multiple-composite dispersion composition: (AY-DW-(D,Z)O-TY-TZ) family. Further said configuration may also be selected from a base oil (oil)/water dispersion composition: (AY-DW), a base oil (oil)/multiple water dispersion composition: (AY-DW-TY), a base oil (oil)/composite water dispersion composition: (AY-DW-TZ), a base oil (oil)/multiple-composite water dispersion composition: (AY-DW-TY-TZ) family, a base oil (oil-solid)/water dispersion composition: (AY-DW-ZO), a base oil (oil-solid)/multiple water dispersion composition: (AY-DW-ZO-TY), a base oil (oil-solid)/composite water dispersion composition: (AY-DW-ZO-TZ), and a base oil (oil-solid)/multiple-composite water dispersion composition: (AY-DW-ZO-TY-TZ) family.

Comparative Example 9

For the comparison with the above examples, a composition (MO-Y2) produced by adding molybdenum dithiocarbamate as an oiliness improver to a commercially available mineral oil (machine oil #68 (68 cSt)), a composition (MOCl) produced by adding a chlorinated paraffin to the mineral oil, a composition (MO-Z2) produced by adding polytetrafluoroethylene as a solid lubricant other than ultrafine diamond particles to the mineral oil, a chlorinated paraffin (CL bond ratio: 40%) alone (Y3), and a commercially available Li grease (NDMO-2) dispersed the ultrafine diamond particles therein as comparison samples (Comparative example 9) were subjected to the Shell high-speed four-ball friction test under the same conditions as that in the example described above.

Table 18 shows the specific wear rate thus measured together with the specific wear rate of water and a commercially available mineral oil as comparison samples.

TABLE 18

| Sample name | Specific wear rate ($\times10^{-9}$) |
|---|---|
| Water | 482.52 |
| MO | 406.16 |
| MO-Y2 | 116.73 |
| MOCl (MOCL) | 11.24 |

TABLE 18-continued

| Sample name | Specific wear rate ($\times 10^{-9}$) |
|---|---|
| Y3 | 0.32 |
| MO-Z2 | 45.24 |
| NDMO-2 | 75.02 |

Figure 24:
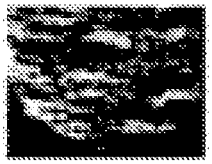
FIG. 24 is a view showing the wear scar and the specific wear rate of determined by the Shell high-speed four-ball friction test for each lubricant composition of Comparative example 9.
Figure 24:
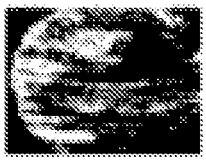
Figure 24:
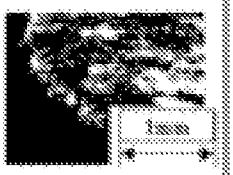
Figure 24:
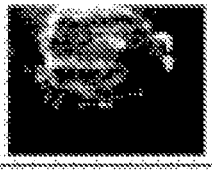
Figure 24:
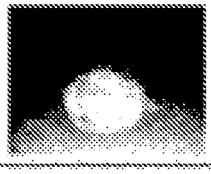
Figure 24:
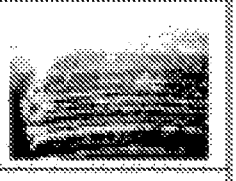

MO: Machine oil #68 (68 cSt)
MO-Y2: Machine oil #68 including 1 wt % of molybdenum dithiocarbamate (organomolybdenum)
MOC1(MOCL): Machine oil #68 including 1 wt % of paraffin wax ($C_{26}$) chlorinated paraffin (average chlorine content: 40%)
Y3: Paraffin wax ($C_{26}$) chlorinated paraffin (average chlorine content: 40%)
MO-Z2: Machine oil #68 including 1 wt % of polytetrafluoroethylene (average particle size: 5.0 μm)
NDMO-2: Commercially available Li grease in which ultrafine diamond particles were dispersed Table 18 shows the specific wear rate of each comparison sample of Comparative example 9. FIG. 24 is a view showing the wear scar and the specific wear rate of each lubricant composition of Comparative example 9 determined by the Shell high-speed four-ball friction test. The specific wear rate of the chlorinated paraffin (Y3) was almost equal to that of the multiple-composite dispersion composition (A-DO-TY-TZ) of Example 10 which was obtained by adding a higher amide alkylolated sulfonate calcium salt as the oiliness improver, and polytetrafluoroethylene as the solid lubricant other than the ultrafine diamond particles, or the base oil (oil)/composite oil dispersion composition (AY-DO-TZ) of Example 16. However, a chlorinated paraffin falls under the substances specified by the PoHS or the PRTR, in addition a chlorinated paraffin has high corrosiveness, and is a toxic substance in air. Therefore, none of the comparison samples are superior to the lubricant composition according to the present invention taking into account safety thereof

Example 17

Evaluation of Properties of Lubricating Coating Member Provided with Coating Layer (1)

The O/W emulsion composition including the ultrafine diamond particles was used as a coating agent in this example. A coating layer was formed on various members, and the effects of the coating layer on frictional properties were evaluated.

As a example of friction/sliding member, a coating layer was formed on a ball screw (typical screw mechanism), a bearing of a linear guide (guide element as Ball Way or bearing), a screw, a rail, and the like. As an apparatus that uses a ball screw and a linear guide mechanism, a high-rigidity electric uniaxial positioning apparatus integrally equipped a ball screw structure and a linear guide structure was provided. The effects of the ultrafine diamond particle coating layer on minute delamination occurred on the metal surface of bearing, screw, and rail or the like due to friction torque and rolling contact fatigue were examined.

A high carbon chromium steel ball screw with a diameter of 20 mm, a lead of 10 mm, and linear stroke of 600 mm was manufactured by NSK Ltd., and the nut portion thereof was an angular ball bearing mechanism (precision class ball screw is used). The diameter of the bearing (high carbon chromium steel ball) was about 15 mm. The linear guide was adopted a high-load precision type. A load of 30 kg was applied to the positioning table (dead weight: 19 kg) in the evaluation of rolling contact fatigue. The positioning table was directly connected to an AC servomotor by means of the instrument such as a blanket and a coupling, and controlled using a controller or a personal computer with controller.

The dynamic friction torque in a state in which the ball screw, the linear guide, and the positioning table were installed, and the static friction torque at startup corresponding to the lost motion (evaluated from the motor startup torque as alternative property) were evaluated. In order to eliminate an inevitable allowance on frictional properties, the friction torque of each member was beforehand measured in an unlubricated state to confirm that the acceptable allowance was within 10% to highlight the comparative examination. The coating effects were evaluated using a plurality of positioning apparatuses, and known conventional lubricants were also evaluated in a same condition and compared. An Li soap grease having a consistency of 207 was used as a comparison sample. The grease-type (O+ultrafine diamond particle)/(W+ultrafine diamond particle) emulsion composition (C-DW-DO) was used in this example as the coating agent. The effective base oil component concentration was adjusted to 50 wt % corresponding to the consistency of the grease for comparison. The solid concentration of the ultrafine diamond particles was 1 wt %. In a rolling contact fatigue test, a load of 30 kg was applied to the positioning stage. The bearing and the screw of the nut portion, the bearing of the linear guide, and the like were washed after horizontal reciprocating motion for 10,000 hours while repeating acceleration and deceleration (acceleration time: 0.05 sec, deceleration time: 0.05 sec, moving speed: 2.0 m/sec), and the degree of surface damage was observed using an optical microscope and an electron microscope.

(Formation of Coating Layer and Confirmation of Friction Torque and Rolling Contact Fatigue Life (Durability))

The coating treatment for the ball screw, bearing, rail, and the like were completed by a pre-conditioning interim operation. The coating agent was filled through the grease nipple set up the ball screw nut portion, and the like (or a dedicated greasing cartridge was installed), and the apparatus was operated under the rated load. Since the linear guide itself was assigned the load, and its load was applied to the positioning stage of the apparatus, the ball screw is preferably coated under reciprocating conditions with acceleration and deceleration. The coating operation may be effectively performed within a short time by adding precompression of an elastic deformation region to the angular bearing (ball screw) that reduces backlash, the bearing of the linear guide, and the like. The pre-conditioning interim operation conditions in this example were as follows. The load applied to the positioning stage was 20 kg, and the conditions of the horizontal reciprocating motion (20 min): the acceleration time was 0.1 sec, the deceleration time was 0.1 sec, and the moving speed was 1.0 m/sec.

After the pre-conditioning interim operation, the dynamic friction torque was measured without applying a load. The dynamic friction torque when forming the coating layer was 3.8 N·cm with respect to 6.0 N·cm of the conventional lubricant. The static friction torque at startup was evaluated from the motor startup torque as alternative property, and the motor startup torque was decreased by 30% or more when forming the coating layer.

The component parts were removed from the positioning apparatus after the rolling contact fatigue test, and washed. Scaly minute delamination and a wear scar that may decrease the positioning accuracy were observed on the bearing surface in the ball screw nut portion and on the screw groove surface when using the conventional lubricant. Almost no wear scar was observed when performing the coating treatment. It was confirmed by the EPMA analysis that a coating layer in which carbon derived from the ultrafine diamond particles was concentrated was formed. The coating layer formed on the lubricating coating member had a very low friction coefficient and excellent heat radiation and homogenization properties. It was confirmed that thermal displacement (due to frictional heat) during high-speed operation was suppressed, and a deterioration in positioning accuracy could be prevented. This makes it possible to reduce the heat displacement countermeasures considerably such as coercive cooling of ball screw, changing the lead, and temperature stabilization by high-speed warming-up for maintaining the positioning accuracy. Excellent frictional properties achieved by the lubricating coating member having the coating layer formed by the pre-conditioning interim operation have been described above regarding to the screw mechanism as a typical example of a power transmission mechanism and the rolling guide as a guide element, and the rolling bearing as rotation guide. Note that similar frictional properties can also be achieved for an arbitrary tribological member such as a link mechanism, a cam mechanism, a gear mechanism, friction transmission (such as belt transmission, hoisting machine, and traction drive or the like), a sliding guide as a guide element, a fluid static guide, a journal bearing as a rotation guide and the like. The lubricating coating member having the coating layer including the ultrafine diamond particles is not limited to this example.

Example 18

Evaluation of Properties of Lubricating Coating Member Provided with Coating Layer (2)

In this example, a coating layer was formed on a member that is not classified in various power transmission mechanism that can be performed by the basic pre-conditioning interim operation as described in Example 17, and the effects of the coating layer on frictional properties were confirmed.

This example focused on a friction force that occurs between a friction surface of a cubic moving object that moves on a planar surface and a planar surface facing the friction surface of the cubic. The lubrication property improving effect of the coating layer was confirmed by the friction coefficient calculated from the maximum static friction force when the moving object starts to slip down from a static state. The static friction force was calculated from the inclination angle as the simplest method when the cubic moving object placed on a slope (size is W: 100 mm×D: 100 mm×H: 10 mm, the inclination angle can be arbitrarily adjusted) started to move.

(Coating Layer-forming Method and Frictional Properties)

The coating layer-forming method is not particularly limited to any specific method insofar as a friction force can be applied to the friction surface. The coating layer-forming method may be arbitrarily selected depending on the shape of the friction surface (on which the coating layer is formed) and the like. An example of forming the coating layer on the planar surface slope (planar surface) formed of a high carbon chromium steel (J1S-SUJ2 bearing steel) is described below.

A polyurethane cylindrical friction tool (diameter: 10 mm) was attached to the main axis of a CNC machining center. A high carbon chromium steel flat plate that was secured in parallel with the axis of the friction tool and the cubic moving object (material: a high carbon chromium steel (J1S-SUJ2 bearing steel)) were placed in face-to-face contact on the XY table. The rotational speed of the friction tool was set to 300 rpm. The cutting depth (X-axis) for the steel plate of friction tool was 1 to 5 μm. The feed rate in the Y-axis direction was 150 mm/min. The surface of the high carbon chromium steel plate was rubbed with the friction tool several times while supplying a mist of the (O+ultrafine diamond particle)/(W+ultrafine diamond particle) emulsion composition (effective base oil component concentrationof (A-DW-DO): 20 wt %, ultrafine diamond particle concentration: 1 wt %) to form a coating layer. Note that the friction conditions for forming the coating layer, and the shape and the material of the friction tool are merely a example. Therefore, the present invention is not limited to this example.

The cubic moving object (30×30 mm) subjected to the coating treatment was placed on the slope that was similarly subjected to the coating treatment. The friction coefficient measured by the above method was 0.01, (it was far superior to that when forming a DLC film. It was confirmed by the EPMA analysis that a coating layer in which carbon derived from the ultrafine diamond particles was concentrated was formed on the slope. In this example, the coating layers were formed on both the friction surface of the slope and the friction surface of the moving object. It was confirmed that excellent frictional properties may be similarly obtained when forming a coating layer on either the friction surface of the slope or the friction surface of the moving object. After the formation of the coating layer, the coating layer may be dried as is, or may be washed with water, and then dried (refer to the lubricant depletion test and Example 14). Since a similar coating layer can be formed on a given path including three-dimensional path, and can be easily repaired, an unconventional excellent lubricating coating member can be provided. Although the (A-DW-DO) coating agent was used in this example, a composition that forms a composite coating layer or a composition of an arbitrary example may also be used. A lubricating coating member having an arbitrary coating layer can be formed. The present invention is not limited to this example.

The lubricating coating member provided with the coating layer by the pre-conditioning interim operation or the like exhibits very excellent lubrication properties even in an unlubricated state (as described in the lubricant depletion test, etc.). Therefore, such a lubricating coating member is suitable for applications for which use of a lubricant (e.g., oil, grease and the like) is restricted.

Example 19

Lubrication Properties at Low Temperature

In this example, the lubrication properties of the lubricant composition that can be used at a low temperature when using an anti-freeze solution which includes such as nontoxic glycerol, oligosaccharide, polysaccharide or the like as the dilutant for adjusting the concentration of the lubricant composition using in a cold environment area (as described in the example for the anhydrous lubricant composition).

(Friction Test Method)

When evaluating the lubrication properties of the lubricant composition using the Shell high-speed four-ball friction tester or the Falex tester described bove, it is difficult to evaluate the frictional properties keeping the luburicant temperature at a low temperature while maintaining the lubricant at a low temperature because the friction surface is disposed under the severe friction conditions. Therefore, the frictional properties at a low temperature were evaluated using the Soda pendulum type friction tester that rarely produces frictional heat. In order to keep the friction test environment at −20° C., a Peltier element was provided under the sample cup of the Soda pendulum type friction tester, and the measurement was performed when the temperature reached −20° C. The friction coefficient was measured by a standard method (the average value of three measured values).

(Freezing and Appearance of Lubricant Composition)

The measurement of the friction coefficient using the Soda pendulum type friction tester was affected by the viscosity to a large extent. Therefore, the appearance of the sample cooled in a freezer was examined. As the microemulsion-type base emulsion composition (B) (as a reference), the (O+ultrafine diamond particle)/W emulsion composition (B-DO), the multiple dispersion composition (B-DO-TY), and the composite dispersion composition (B-DO-TZ) described above were selected. The effective base oil component concentration of each composition was 50 wt % (paste-type (grease-type) (C)). After each sample were left in a freezer (−20° C.) as it is for 24 hours, the appearance was confirmed. Though no sample froze, each sample had a grease-like appearance, and that is thus not suitable for Soda pendulum test.

Therefore, glycerol was added to the sample progressively, and the appearance of the sample stored in a freezer was observed while altering the concentration of glycerol from grease-like to flowing liquid. The sample exhibited fluidity when the ratio of glycerol amount to the microemulsion-type composition sample amount (in the case where the effective base oil component concentration was 20 wt %) was 60/40 wt %. Specifically, in order to fluidize the composition so that Soda pendulum tester functioned for evaluation or practical usage, glycerol was added to the composition, at that time, the upper limit of the concentration of glycerol is 60 wt % or more when the effective base oil component concentration of the composition is 50 wt %.

In order to evaluate the frictional properties using the Soda pendulum type friction tester, the paste-type (grease-type) composition having an effective base oil component concentration of 50 wt % was diluted with glycerol instead of water to obtain a composition having an effective base oil component concentration of 15 wt %. The concentration of the main components was as follows: glycerol concentration was 70 wt %, the effective base oil component concentration (AI) was 15 wt %, and the water concentration was 15 wt %. The solid concentration of the ultrafine diamond particles was 0.3 wt %. A zinc dialkyldithiophosphate (ZnDTP) was used as the oiliness improver (Y), and polytetrafluoroethylene (PTFE) was used as the solid lubricant other than the ultrafine diamond particles (Z) of the composition (B-DO-TY), and each addition were followed in Table 13. Table 19 shows the results of friction coefficient, and the composition of the each emulsion composition (microemulsion-type (soluble) B) including the base emulsion composition (B) as a comparison and the measured temperatures.

TABLE 19

| Sample name | Glycerol concentration (wt %) | AI (wt %) | Water (wt %) | ND concentration (wt %) | PTFE concentration (wt %) | ZDTP concentration (wt %) | Friction coefficient (μ) Temperature before measurement (° C.) | Temperature after measurement (° C.) | μ |
|---|---|---|---|---|---|---|---|---|---|
| B | 70 | 15 | 15 | 0 | 0 | 0 | −20 | −19 | 0.117 |
| B-DO | 70 | 15 | 15 | 0.3 | 0 | 0 | −20 | −19 | 0.113 |
| B-DO-TZ (PTFE) | 70 | 15 | 15 | 0.15 | 0.15 | 0 | −20 | −19 | 0.095 |
| B-DO-TY (ZDTP) | 70 | 15 | 15 | 0.15 | 0 | 3.0 | −20 | −19 | 0.116 |

The compositions of this example according to the present invention had a excellent small friction coefficient at a low temperature similar to the friction coefficient at room temperature. It was thus confirmed that the composition according to the present invention functions well as a lubricant in a cold district or at a low temperature circumstance.

The sample (B-DO-TZ) having the best frictional properties at a low temperature had the lowest friction coefficient (0.093) at room temperature (20° C.). It was found that the sample (B-DO-TZ) is a lubricant composition that exhibits stable lubrication properties over the range of a normal temperature to a low temperature (−20° C.). Note that this merely illustrates the O/W emulsion lubricant composition including the ultrafine diamond particles and maintaining an excellent lubrication function even at a low temperature. any composition and any components constitution described in other examples according to the present invention can exert an excellent lubrication function. Therefore, the present invention is not limited to this example.

The present invention is not limited to the above embodiments. Various modifications may be made without departing from the scope of the invention. The elements of the above embodiments may also be arbitrarily combined without departing from the scope of the invention.

Industrial Applicability

The lubricant composition according to the present invention may be used as a lubricant related to atomic energy, micromachining, and food applications, for example. Moreover, coating effects can be achieved inexpensively as compared with a surface treatment such as CVD, sputtering and the like. This makes it unnecessary to use an conventional expensive composite sliding member.

According to the present invention, an anti-rust lubricant used in standard home and office that oil type lubricant is used, grease applied to a sliding area or a bearing of a robot that will be widely used in home and office, a bearing oil for wind power generation and machine applications, oil applied to a completely closed system such as space shuttle, space station or the like for which a maintenance-free application is desired, oil used for electric vehicles, and the like can be replaced with an aqueous type lubricant that has low environmental load.

Since a low wear rate and high lubrication stability can be achieved by the present invention, this high performance lubricant compositions according to the present invention may be applied underto the high-load applications such as fineblanking, wire drawing, deep drawing or the like while achieving a significant increase in productivity by maintaining the processing accuracy due to a reduction in die wear. From the results obtained by the above examples, lowering and stabilizing the friction torque are expected to reduce every frictional energy by solving problems such as energy loss due to insufficient torque of a small spindle rotation motor of driving transmission system that may be diversified more from now.

In recent years, nanometer-level positioning accuracy and a nanometer-level positioning mechanism have been desired in the micromachining field (for example, semiconductor production system and the like), and various instruments and robots have been increasingly developed. For example, a reduction in static friction force during positioning with an accuracy of 50 nm or less has been desired for a manipulator or a robot provided with an impact drive mechanism, a gene manipulation instrument, or the like. A positioning accuracy of several nanometers can be implemented by utilizing the lubricant composition according to the present invention. The lubricant composition according to the present invention may also be suitably used for other high-precision positioning (e.g., camera with impact driver, etc.) applications and the like.

The invention claimed is:

1. An oil-in-water (O/W) emulsion composition comprising ultrafine diamond particles having an average particle size of 100 nm or less, which is treated with a water dispersion dispersant and/or an oil dispersion dispersant, and wherein the ultrafine diamond particles are dispersed in a water phase (W phase) and/or an oil phase (O phase), wherein the ultrafine diamond particles are added and dispersed (1) in the water phase (W phase) as a dispersant-treated ultrafine diamond particle water dispersion prepared by treating the ultrafine diamond particles with a water dispersion dispersant and/or (2) in an oil phase (O phase) as a dispersant-treated ultrafine diamond particle water dispersion prepared by treating the ultrafine diamond particles with an oil dispersion dispersant, wherein the ultrafine diamond particles in the dispersant-treated ultrafine diamond particle oil dispersion (2) are ultrafine diamond particles which have a water dispersion dispersant and an oil dispersion dispersant.

2. The O/W emulsion composition according to claim 1, wherein the ultrafine diamond particles in the dispersant-treated ultrafine diamond particle water dispersion (1) are obtained by adding the water dispersion dispersant to water after or when dispersing ultrafine diamond particles in the water, and then removing the water.

3. The O/W emulsion composition according to claim 1, wherein the water dispersion dispersant comprises one or a plurality of an anionic dispersant, an amphoteric dispersant, and a nonionic dispersant.

4. The O/W emulsion composition according to claim 1, wherein the oil dispersion dispersant comprises any one or both of a polar dispersant and a nonpolar dispersant.

5. The O/W emulsion composition according to claim 1, further comprising an emulsifier which comprises one or a plurality of an anionic emulsifier, a cationic emulsifier, an amphoteric emulsifier, and a nonionic emulsifier.

6. The O/W emulsion composition according to claim 1, wherein the water phase (W phase) comprises partially a hydrophilic solvent.

7. An oil-in-water (O/W) emulsion composition comprising ultrafine diamond particles having an average particle size of 100 nm or less, which is treated with a water dispersion dispersant and/or an oil dispersion dispersant, and wherein the ultrafine diamond particles are dispersed in a water phase (W phase) and/or an oil phase (O phase), wherein said O/W emulsion composition comprises a multiple emulsion state that includes both the following 1) and 2), 1) and 3), or 1) to 3) at the same time:

1) an O/W emulsion composition that includes the ultrafine diamond particles in a water phase (W phase) and/or an oil phase (O phase), 2) another O/W emulsion composition newly produced by adding at least one oiliness improver to the water phase (W phase) of the O/W emulsion composition, and 3) an emulsion composition that is separately produced from 2) above and is at least one member selected from the group consisting of an oil-in-water (O/W) emulsion composition, a water-in-oil (W/O) emulsion composition, a water-in-oil-in-water (W/O/W) emulsion composition, and an oil-in-water-in-oil (O/W/O) emulsion composition.

8. The O/W emulsion composition according to claim 1, wherein the water phase (W phase) and/or the oil phase (O phase) of the O/W emulsion composition including the ultrafine diamond particles includes a solid lubricant other than the ultrafine diamond particles in composite state.

9. A lubricant comprising the O/W emulsion composition according to claim 1.

10. A coating agent comprising the O/W emulsion composition according to claim 1.

11. A coating member having a modified surface thereof, the coating member being obtained by coating the member with an oil-in-water (O/W) emulsion composition comprising ultrafine diamond particles having an average particle size of 100 nm or less, which is treated with a water dispersion dispersant and/or an oil dispersion dispersant, and wherein the ultrafine diamond particles are dispersed in a water phase (W phase) and/or an oil phase (O phase), and drying the coated member.

12. An anhydrous mixture that produces the O/W emulsion composition according to claim 1 upon addition of an aqueous component, comprising two or more of components selected from a base oil component (base oil or emulsifier), a dispersant, a dispersant-treated ultrafine diamond particle oil dispersion, water dispersion solid particles, oil dispersion solid particles, an oiliness improver, a solid other than ultrafine diamond particles, and a hydrophilic solvent.

13. The O/W emulsion composition according to claim 1, wherein the ultrafine diamond particles added and dispersed in both the oil phase (O phase) and the water phase (W phase) are contained in a concentration of not more than 10 wt %.

14. An oil-in-water (O/W) emulsion composition comprising ultrafine diamond particles having an average particle size of 100 nm or less, which is treated with a water dispersion dispersant and/or an oil dispersion dispersant, and wherein the ultrafine diamond particles are dispersed in a water phase (W phase) and/or an oil phase (O phase), wherein said O/W emulsion composition comprises a multiple emulsion state that includes following 1) and 2), 1) and 3), or 1) to 3) at the same time;

1) an O/W emulsion composition that includes the ultrafine diamond particles in a water phase (W phase) and/or an oil phase (O phase), 2) an O/W emulsion composition that is produced by adding an oiliness improver to the oil phase (O phase) of the O/W emulsion composition of the above 1), and 3) an emulsion composition that is separately produced from the above 1), and is at least one member selected from the group consisting of an oil-in-water (O/W) emulsion composition, a water-in-oil (W/O) emulsion composition, a water-in-oil-in-water (W/O/W) emulsion composition, and an oil-in-water-in-oil (O/W/O) emulsion composition.

15. A method of producing the coating member according to claim 11, comprising coating the member with the oil-in-water (O/W) emulsion composition comprising ultrafine diamond particles having an average particle size of 100 nm or less, which is treated with a water dispersion dispersant and/or an oil dispersion dispersant, and wherein the ultrafine diamond particles are dispersed in a water phase (W phase) and/or an oil phase (O phase) by and during a pre-conditioning interim operation.

* * * * *

UNITED STATES PATENT AND TRADEMARK OFFICE

CERTIFICATE OF CORRECTION

PATENT NO. : 8,507,414 B2
APPLICATION NO. : 12/937670
DATED : August 13, 2013
INVENTOR(S) : Takahama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 335 days.

Signed and Sealed this
Fifteenth Day of September, 2015

Michelle K. Lee

Michelle K. Lee
*Director of the United States Patent and Trademark Office*